US006489091B2

(12) United States Patent
Takiguchi

(10) Patent No.: US 6,489,091 B2
(45) Date of Patent: Dec. 3, 2002

(54) PHOTOTHERMOGRAPHIC MATERIAL

(75) Inventor: Hideki Takiguchi, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/795,866

(22) Filed: Feb. 28, 2001

(65) Prior Publication Data

US 2001/0041313 A1 Nov. 15, 2001

(30) Foreign Application Priority Data

Mar. 2, 2000 (JP) ..... 2000-057004

(51) Int. Cl.[7] ..... G03C 1/498; G03C 1/09

(52) U.S. Cl. ..... 430/619; 430/603; 430/604; 430/605; 430/611; 430/613; 430/620

(58) Field of Search ..... 430/619, 620, 430/604, 605, 603, 613, 611

(56) References Cited

U.S. PATENT DOCUMENTS 5,871,898 A * 2/1999 Mifune et al. ..... 430/603
6,268,118 B1 * 6/2001 Iwasaki et al. ..... 430/619

* cited by examiner

*Primary Examiner*—Thorl Chea
(74) *Attorney, Agent, or Firm*—Bierman, Muserlian and Lucas

(57) ABSTRACT

A photothermographic material disclosed, comprising on a support a light sensitive layer containing an organic silver salt, light sensitive silver halide grains and a solvent, wherein the organic silver salt comprises tabular organic silver salt grains exhibiting an average needle ratio of not less than 1.1 and less than 10.0, the light sensitive silver halide grains having been subjected to chemical sensitization.

16 Claims, No Drawings

PHOTOTHERMOGRAPHIC MATERIAL

FIELD OF THE INVENTION

The present invention relates to photothermographic materials exhibiting enhanced sensitivity and superior storage stability and in particular to black-and-white photothermographic materials exhibiting enhanced sensitivity and superior storage stability of silver images after thermal development.

BACKGROUND OF THE INVENTION

In the field of medical treatment and graphic arts, there have been problems in working property with respect to effluents produced from wet-processing of image forming materials, and recently, reduction of the processing effluent is strongly demanded in terms of environmental protection and space saving.

Accordingly, there are needed techniques regarding photothermographic materials for photographic use which are capable of forming black images exhibiting high sharpness, enabling efficient exposure by means of a laser imager or laser image setter. As one such a technique is known a thermally developable photosensitive material, which comprises a support having thereon an organic silver salt, light-sensitive silver halide grains and a reducing agent, as described in U.S. Pat. Nos. 3,152,904 and 3,487,075; and D. H. Klosterboer, "Thermally Processed Silver Systems" (Imaging Processes and Materials, Neblette, 8th Edition, edited by J. M. Sturge, V. Walworth, and A. Shepp, page 279, 1989), etc.

One feature of the photothermographic material, which comprises a light sensitive layer containing silver halide grains as a photo-sensor and an organic silver salt as a silver ion source and an incorporated reducing agent is that images are formed through thermal development at a temperature of 80 to 140° C., without further fixing. To achieve not only a consistent supply of silver ions to the silver halide but also prevention of deterioration in transparency caused by light scattering, it has been attempted to improve the shape of organic silver salt particles so that the particles are optimally arranged in the light sensitive layer without disadvantageously affecting light scattering.

However, in the photothermographic materials, image problems have still tended to occur because normal image formation is locally hindered due to the presence of silver halide and organic silver coagula.

On the other hand, when silver halides or organic silver salts are forcibly disperse-pulverized by employing a homogenizer, problems occur in which fog increases, sensitivity decreases, leading to deteriorated image quality. Therefore, techniques have been demanded which are capable of yielding greater light sensitivity as well as higher density without an increase in the silver amount, while decreasing fogging.

SUMMARY OF THE INVENTION

Accordingly, it is an object of the present invention to provide a thermally developable photothermographic material exhibiting enhanced sensitivity and reduced fogging caused after storage over a long period of time and also exhibiting superior stability silver images after thermal development, and an image forming process by the use thereof.

The object of the invention can be accomplished by the following constitution:

1) A photothermographic material comprising on a support a light sensitive layer containing an organic silver salt, light sensitive silver halide grains and a solvent, wherein the organic silver salt comprises tabular organic silver salt grains exhibiting an average needle ratio of not less than 1.1 and less than 10.0, the silver halide grains having been subjected to chemical sensitization
2) a photothermographic material comprising a light sensitive layer containing an organic silver salt, a light sensitive silver halide and a solvent, wherein the organic silver salt comprises tabular grains exhibiting an aspect ratio of not less than 3 and an average needle ratio measured from the major face direction of not less than 1.1 and less than 10.0; the silver halide being chemically sensitized;
3) a photothermographic material comprising a support having thereon a light sensitive layer containing an organic silver salt, a light sensitive silver halide, a reducing agent and a binder , wherein when a cross section vertical to the surface of the support is electron-microscopically observed, not less than 70% of the total projected area of the organic silver salt particles is accounted for by organic silver salt particles having a particle projected area of less than 0.025 $\mu m^2$ and not more than 10% of the total projected area of the organic silver salt particles is accounted for by organic silver salt particles having a particle projected area of not less than 0.2 $\mu m^2$; the silver halide being chemically sensitized;
4) The photothermographic material described in 1), 2) or 3), wherein the light sensitive silver halide is subjected to chemical sensitization which is performed using an organic sensitizer containing a chalcogen atom in the absence of an oxidizing agent during the process of manufacturing the photothermographic material, the silver halide being mixed with the organic silver salt, dispersed, dewatered and dried.

DETAILED DESCRIPTION OF THE INVENTION

One of the preferred embodiments of the invention is that the light sensitive silver halide relating to this invention is subjected to chemical sensitization, which is achieved using an organic sensitizer containing a chalcogen atom in the absence of an oxidizing agent in the manufacturing process of the photothermographic material.

The organic sensitizers containing a chalcogen atom include, for example, organic sensitizers having various structures, described in JP-A No 60-150046, 4-109240 and 11-218874 (hereinafter, the term, JP-A refers to an unexamined, published Japanese Patent Application).

Examples of atomic groups containing a group for promoting adsorption onto silver halide include an atomic group containing a mercapto group (e.g., mercaptooxadiazole, mercaptotetrazole, mercaptotriazole, mercaptodiazole, mercaptothiazole, mercaptothiadiazole, mercaptooxazole, mercaptoimidazole, mercaptobenzothiazole, mercaptobenzoxazole, mercaptobenzimidazole, mercaptotetrazaindene, mercaptopyridyl, mercaptoquinolyl, 2-mercaptopyridyl, mercaptophenyl, mercaptonaphthyl, etc.), an atomic group containing a thione group (e.g., thiazoline-2-thione, oxazoline-2-thione, imidazoline-2-thione, benzothiazoline-2-thione, benzimidazoline-2-thione, thiazolidine-2-thion, etc.), an atomic group capable of forming an imino silver (e.g., triazole, tetrazole, benzotriazole, hydroxyazaindene, benzimidazole, indazole, etc.), and an atomic group containing an ethenyl group (e.g., 2-[N-(2-propynyl)amino] benzothiazole, N-(propynyl)carbazole, etc.}.

In this invention, the group for promoting adsorption onto silver halide is distinct from a labile chalcogen atom site. Thus, it is not a group capable of releasing a chalcogen atom to form a silver chalcogenide.

In this invention, the compound containing a labile chalcogen atom site refers to a compound capable of forming a silver chalcogenide in the presence of silver nitrate. Further, the chalcogen atom means a sulfur atom, selenium atom or tellurium atom.

Examples of the atomic group containing a labile sulfur atom site include a thiourea group containing atominc group [e.g., N,N'-diethylthiourea, N-ethyl-N'-(2-thiazolyl) thiourea, N,N-dimethylthiourea, N-phenylthiourea, etc.], a thioamido group containing atomic group (e.g., thiobenzamide, thioacetoamide, etc.), an atomic group containing a polysulfide or phosphine sulfide group [e.g., bis (pentafluorophenyl)phenylphoshine sulfide, diethylphosphine sulfide, dimethylphenylphosphine sulfide, etc.], and a thioxoazolidinone group containing atomic group (e.g., ethylrhodanine, 5-benzylidene-3-ethylrhodanine, 1,3-diphenyl-2-thiohydantoin, 3-ethyl-4-oxooxazolidine-2-thione, etc.).

Examples of the atomic group containing a labile selenium atom site include a selenourea group containing atomic group [e.g., N,N-dimethylselenourea, selenourea, N-acetyl-N,N'-diethylselenourea, N-trifluoroacetyl-N',N'-dimethylselenourea, N-ethyl-N'-(2-thiazolyl)selenourea, N,N'-diphenylselenourea, etc.], a selenoamido group containing atmic group (e.g., N-methyl-selenobenzamide, N-phenyl-selenobenzamide, N-ethyl-selenobenzamide, etc.), a phosphine selenide group containing atomic group (e.g., triphenylphosphine selenide, diphenyl [pentafluorophenyl]phosphine selenide, trism-chlorophenyl) phosphine selenide, etc.], a selenophosphate group containing atomic group [tris(p-tolyl)selenophosphate, etc.], a seleno-ester group containing atomic group [e.g., p-methoxyselenobenzoic acid (=O) isopropyl ester, selenobenzoic acid (=Se)-3'-oxobutyl ester, p-methoxyselenobenzoic acid (=Se)-3'-oxocyclohexyl ester, etc.], a selenide grou containing atomic group [e.g., bis(2,6-dimethoxybenzoyl)selenide, bis(n-butoxycarbonyl) selenide, bis(benzyloxycarbonyl)selenide, bis(N,N-dimethylcarbamoyl)selenide, etc.], triselenane group containing atomic group [2,4,6-tris(p-methoxyphenyl) triselenane, etc.], and a seleno ketone group containing atomic group (e.g., 4-methoxyselenoacetophenone, 4,4-methoxyselenobenzophenone, etc.).

Examples of the atomic group containing a labile tellurium atom site include a phosphine telluride group containing atomic group (e.g., butyl-di-isopropylphosphine telluride, triscyclohexylphosphine telluride, etc.), a tellurourea group containing atomic group (e.g., N,N'-diethyl-N,N'-diethylenetellurourea, N,N'-dimethylene-N,N'-dimethyltellurourea, etc.), a telluroamido group containing atomic group [e.g., N,N-dimetyl-telluroamide, N,N-tetramethylene-(p-tolyl)tellurophosphate, tributyltellurophosphate, etc.], and a tellurophosphoric amido group containing atomic group (e.g., hexamethyltellurophosphoric amide, etc.).

In addition to the foregoing, atomic groups containing a labile selenium or tellurium site may be selected from the compounds described in JP-A Nos. 4-25832, 4-109240, 4-147250, 4-33043, 5-40324, 5-24332, 5-24333, 5-303157, 5-306268, 6-27573, 6-43576, 6-75328, 6-17528, 6-180478, 6-17529, 6-208184, 6-208186, 6-317867, 7-92599, 7-98483, 7-104415, 7-140579, and 7-301880.

The compound containing a group for promoting adsorption onto silver halide and a labile chalcogen atom site within the molecule is preferably a compound represented by the following formula(C):

formula (C)

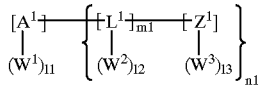

wherein $A^1$ represents an atomic group containing a group for promoting adsorption onto silver halide; $L^1$ represents a bivalent linkage group; $Z^1$ represents an atomic group containing a labile chalcogen atom site; $W^1$, $W^2$ and $W^3$ each represent a carboxylic acid group, a sulfonic acid group, sulfinic acid group, phosphoric acid group, phosphorous acid group or a boric acid group; m1 is 0 or 1; n1 is an integer of 1 to 3; 11, 12, and 13 each are an integer of 0 to 2.

The bivalent linkage group represented by $L^1$ is a group comprised of a carbon atom, hydrogen atom, oxygen atom, nitrogen atom or a sulfur atom; exemplary examples thereof include an alkylene group having 1 to 20 carbon atoms (e.g., methylene, ethylene, propylene, hexylene), an arylene group (e.g., phenylene, naphthylene), —$CONR_1$—, —$SO_2NR_2$—, —O—, —S—, —$NR_3$—, —$NR_4CO$—, —$NR_5SO_2$—, —$NR_6CONR_7$—, —CO—O—, —O—CO—, —CO— and a combination of these groups, in which $R_1$, $R_2$, $R_3$, $R_4$, $R_5$, $R_6$ and $R_7$ each represents a hydrogen atom, an aliphatic group, alicyclic group, an aromatic group or a heterocyclic group. The aliphatic group represented by $R_1$ through $R_7$ include an alkyl group (e.g., methyl, ethyl, isopropyl, 2-ethyl-hexyl, etc.9, an alkenyl group (e.g., propenyl, 3-pentenyl, 2-butenyl, cyclohexynyl, etc.), an alkynyl group (e.g., propargyl, 3-pentynyl, etc.), and an aralkyl group (e.g., benzyl, phenethyl, etc.). The alicyclic groups include an alicyclic groups having 6 to 10 carbon atoms (e.g., cyclopentyl, cyclohexyl, etc.); the aromatic groups include a monocyclic groups having 5 to 8 carbon atoms and its condensed ring groups (e.g., phenyl, naphthyl, etc.); the heterocyclic groups include oxygen, sulfur or nitrogen containing, 5- to 7-membered monocyclic groups and those which are condensed with another ring, such as furyl, thienyl, benzofuryl, pyrrolyl, indolyl, thiazolyl, imidazolyl, morpholyl, piperadyl, and pyrazyl. The groups represented by $R_1$ through $R_7$ each may be substituted by any atom or group at any position. Examples of substituent atom or group include hydroxy group, a halogen atom (e.g., fluorine atom, chlorine atom, bromine atom, iodine atom), cyano group, an amino group (e.g., methylamino, anilino, diethylamino, 2-hydroxyethylamino), an acyl group (e.g., acetyl, benzoyl, propanoyl), a carbamoyl group e.g., carbamoyl, N-methylcarbamoyl, N,N-tetramethylenecarbamoyl, N-methanesulfonylcarbamoyl, N-acetylcarbamoyl), an alkoxy group (e.g., methoxy, ethoxy, 2-hydroxyethoxy, 2-methoxyethoxy), an alkoxycarbonyl group (e.g., methoxycarbonyl, ethoxycarbonyl, 2-ethoxycarbonyl, 2-methoxyethoxycarbonyl), a sulfonyl group (e.g., methanesulfonyl, trifluoromethanesulfonyl, benzenesulfonyl, p-toluenesulfonyl), a sulfamoyl group (e.g., e.g., sulfamoyl, N,N-dimethylsulfamoyl, morpholinosulfonyl, N-ethylsulfamoyl), an acylamino group (e.g., acetoamide, trifluoroacetoamide, benzamido, thienocarbonylamino, benzenesulfonamido, and an alkoxycarbonylamino group (methoxycarbonylamino, N-methylethoxycarbonylamino).

The carboxylic acid group, a sulfonic acid group, sulfinic acid group, phosphoric acid group, phosphorous acid group or a boric acid group represented by $W^1$, $W^2$ and $W^3$ may be in the form of a free acid or may form a counter salt with an alkali metal, an alkaline earth metal, ammonium or an organic amine.

Examples of the compounds represented by formula (C) are shown below but are by no means limited to these.

C-1

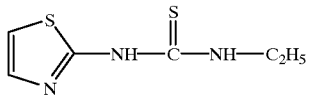

C-2

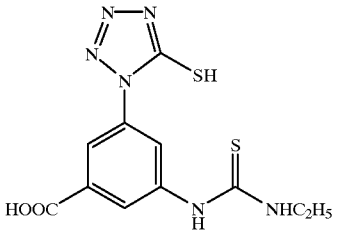

C-3

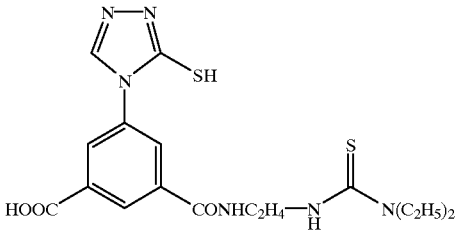

C-4

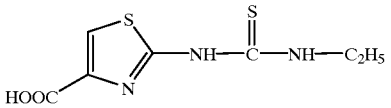

C-5

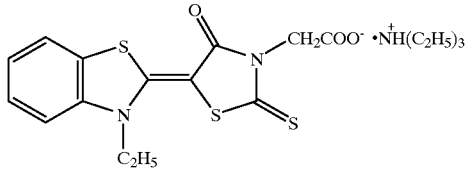

C-6

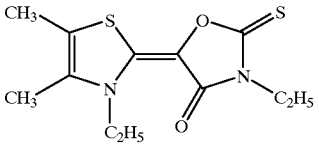

-continued

C-7

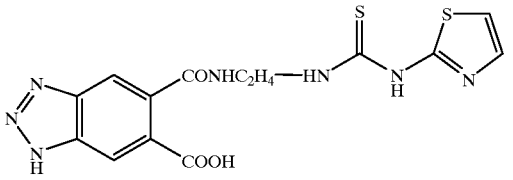

C-8

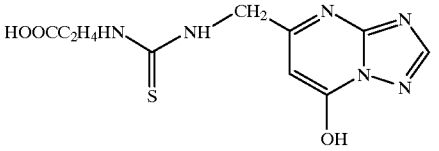

C-9

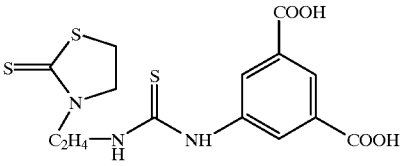

C-10

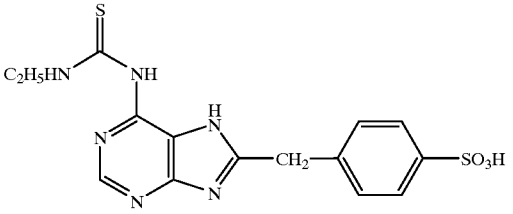

C-11

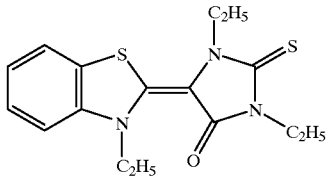

C-12

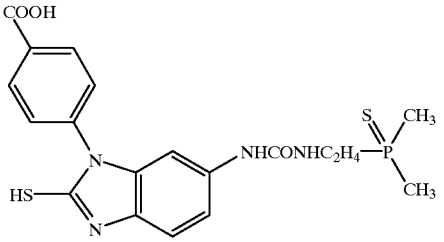

C-13

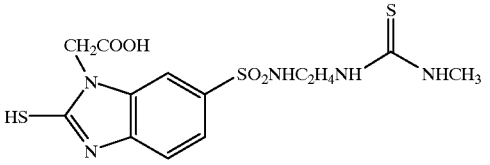

C-14

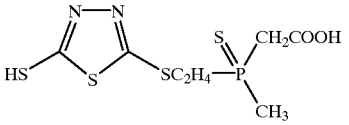

-continued
C-15
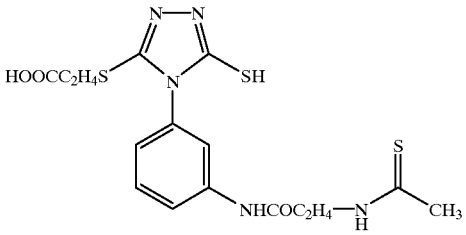
C-16
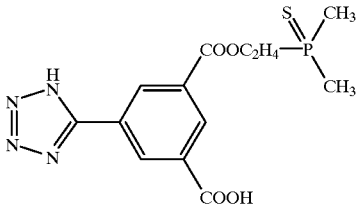
C-17
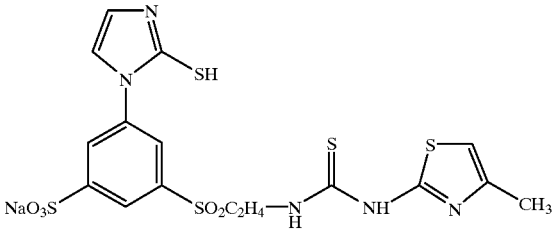
C-18
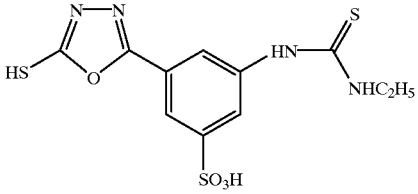
C-19
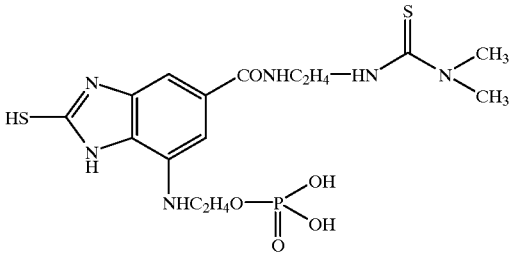
C-20
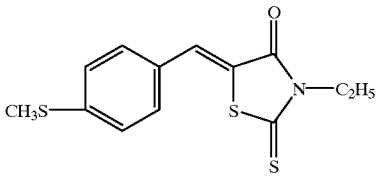
C-21
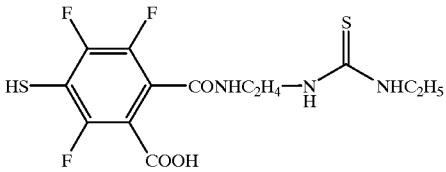
-continued
C-22
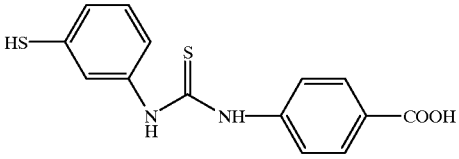
C-23
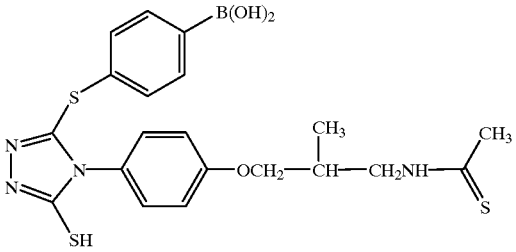
C-24
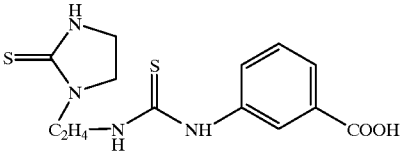
C-25
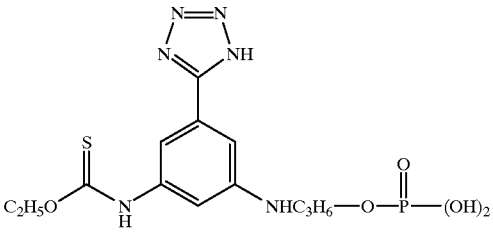
C-26
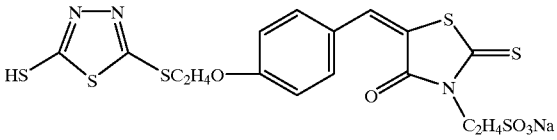
C-27
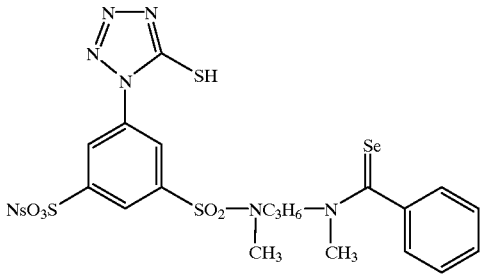
C-28
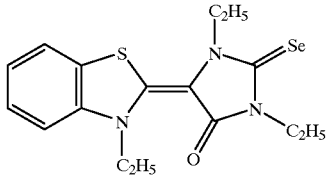

-continued
C-29
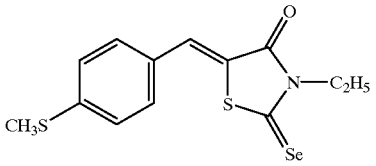
C-30
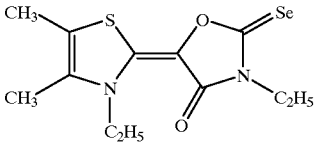
C-31
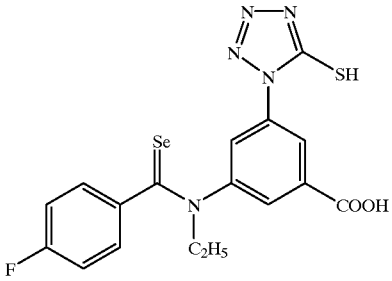
C-32
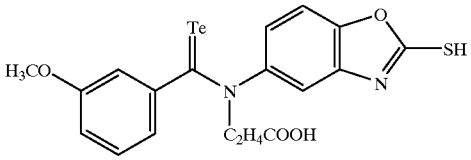
C-33
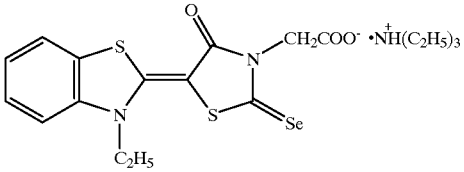
C-34
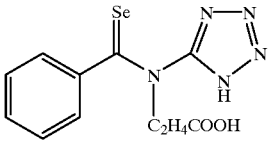
C-35
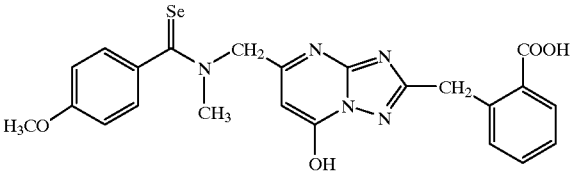
C-36
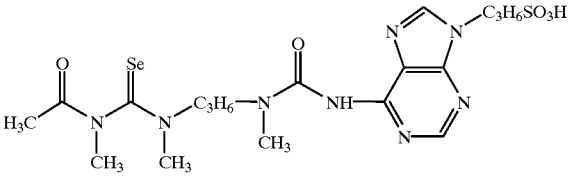
-continued
C-37
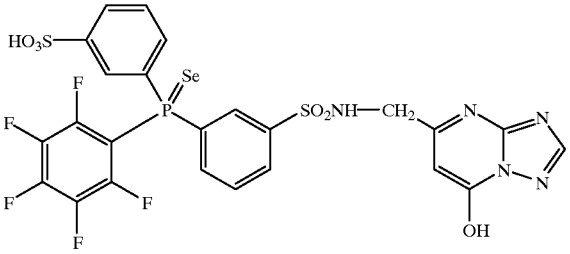
C-38
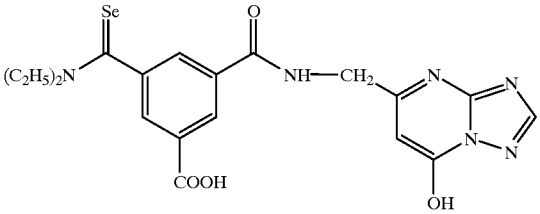
C-39
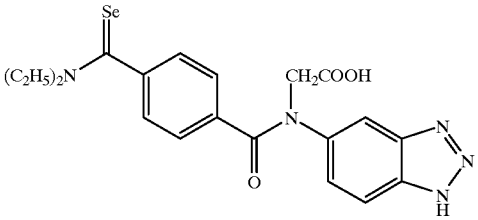
C-40
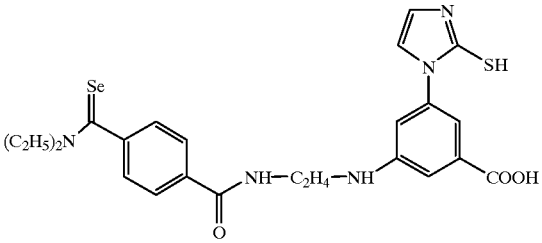
C-41
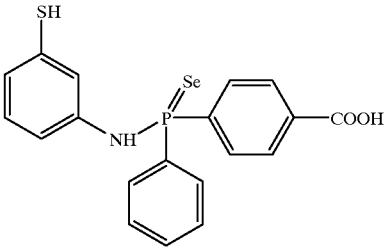
C-42
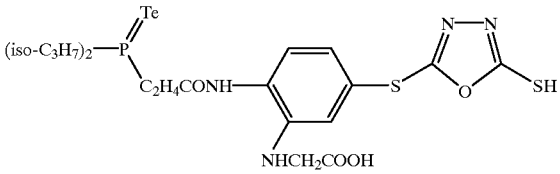

-continued
C-43
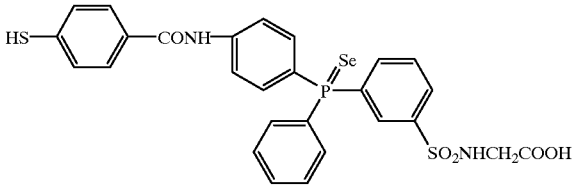
C-44
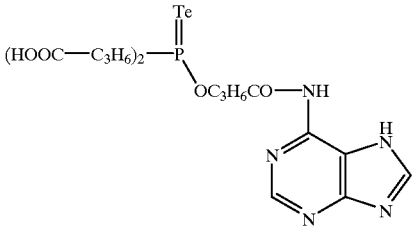
C-45
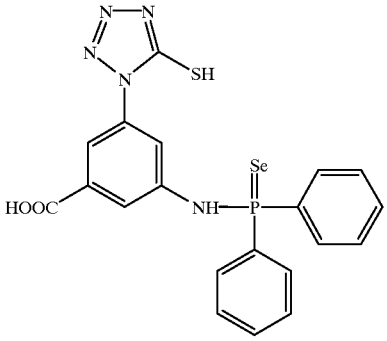
C-46
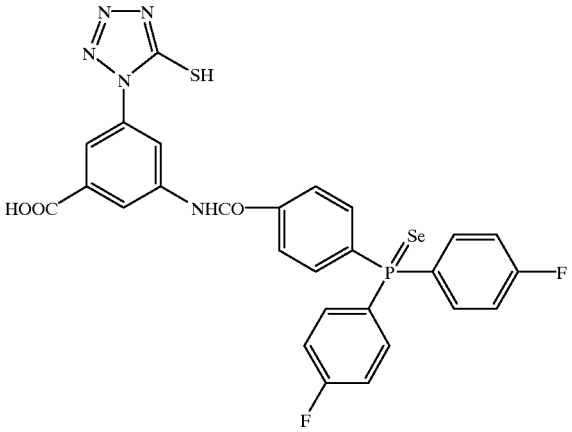
C-47
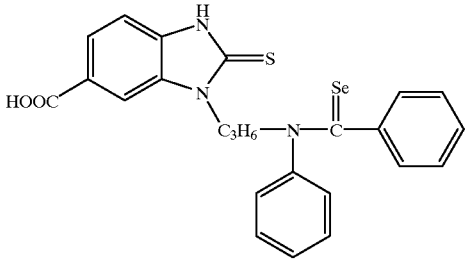
-continued
C-48
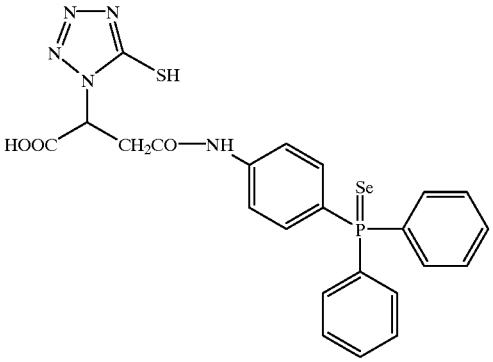
C-49
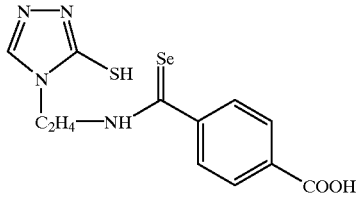
C-50
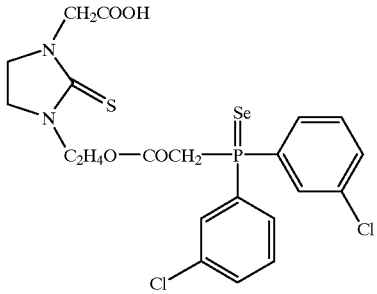
C-51
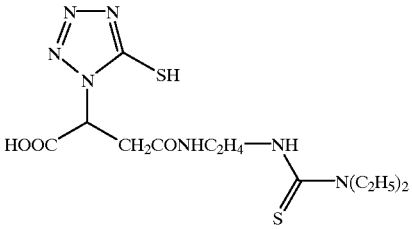
C-52
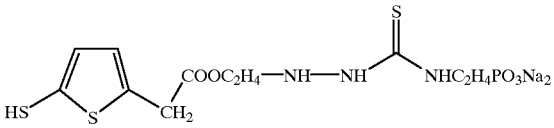
C-53
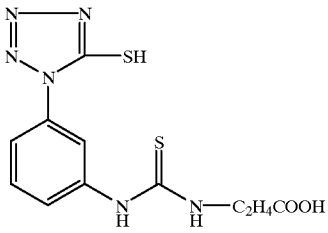

-continued
C-54
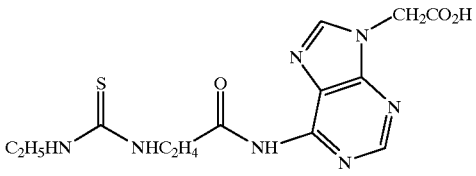
C-55
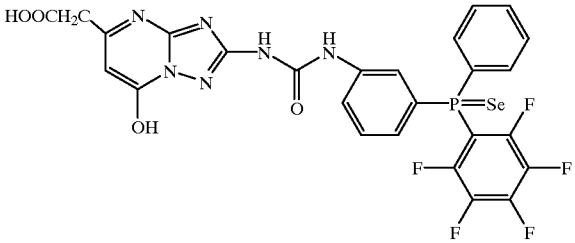
C-56
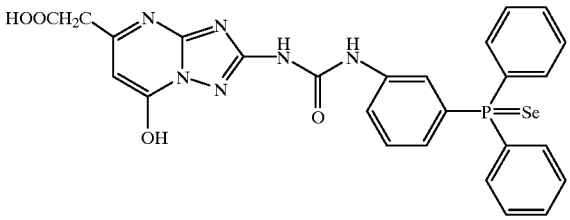
C-57
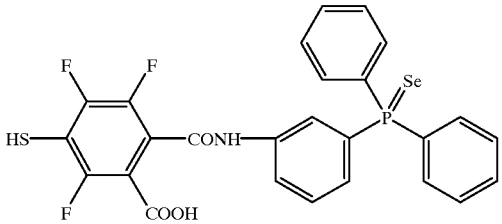
C-58
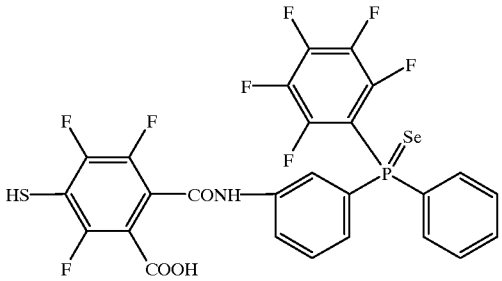
C-59
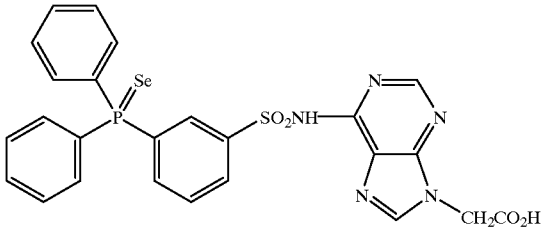
-continued
C-60
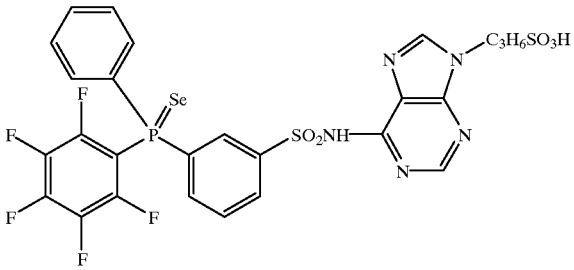
C-61
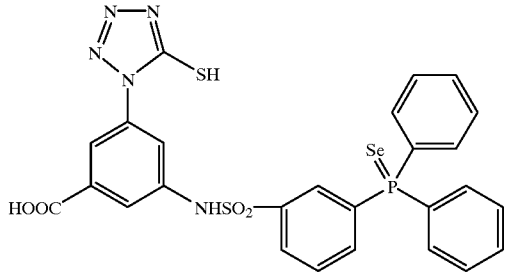
C-62
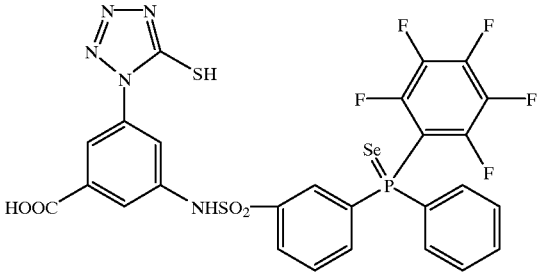
C-63
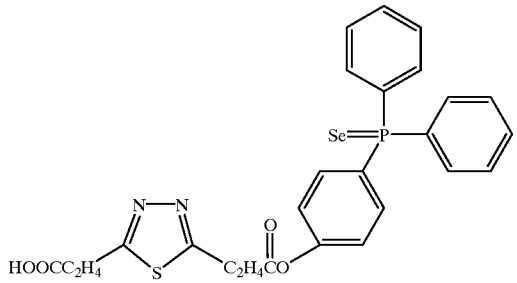
C-64
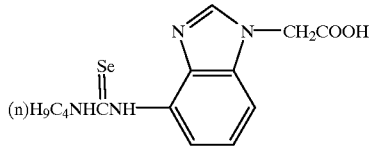
C-65
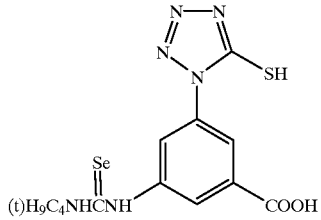

-continued

C-66

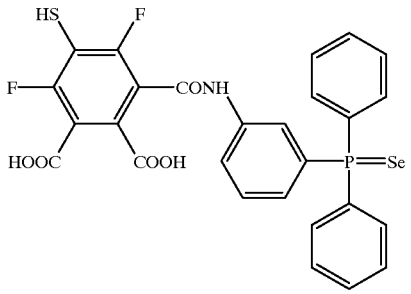

The amount of the chalcogen compound (i.e., chalcogen atom-containing compound) to be used is variable, depending of the kind thereof, silver halide grains and chemical. sensitization environment but is preferably $10^{-8}$ to $10^{-2}$ and more preferably $10^{-7}$ to $10^{-3}$ mol per mol of silver halide. The chemical sensitization environment relating to this invention is not specifically limited, but the pAg is preferably 6 to 11, and more preferably 7 to 10; the pH is preferably 4 to 10, and more preferably 5 to 8, and the temperature is preferably 40 to 90° C., and more preferably 45 to 80° C.

In one preferred embodiment of chemical sensitization relating to this invention, light sensitive silver halide is subjected to chemical sensitization, which is achieved using an organic sensitizer containing a chalcogen atom, substantially in the absence of an oxidizing agent during the process of manufacturing the photothermographic material. Herein, the expression "substantially in the absence of an oxidizing agent" means that the oxidizing agent is present in an amount exerting no effect on photographic performance or no oxidizing agent is present. This chemical sensitization is different from chemical sensitization which is performed in the presence of an oxidizing agent such as pyridinium perbromide hydrobromide (or pyridinium bromide perbromide), as disclosed in U.S. Pat. No. 5,891,615. Thus, the chemical sensitization relating to this invention is performed using an organic sensitizer containing a chalcogen atom under conditions in which an oxidizing agent is not concurrently present and in the subsequent process, an oxidizing agent may be added thereto for purposes other than sensitization, such as antifogging, in which addition of the oxidizing agent is controlled so that chemical sensitization is not additionally performed. The oxidizing agent relating to this invention refers to a compound capable of oxidizing a cluster comprised of one or more silver atoms or a silver chalcogenide. Examples of the compound having such a function include a nitrogen-containing heterocyclic compound hydrogen bromide salt, such as piridinium perbromide hydrobromide, as described in U.S. Pat. No. 5,028,523, European Patent No. 460,826, and JP-A No. 4-232939; a halogen compound, such as 2-(tribromomethylsulfonyl) quinoline, as described in JP-A Nos. 50-12028 and 6-208193; and a compound capable of releasing a halogen atom, as described later.

To add the oxidizing agent under such controlled conditions that the addition does not substantially cause any additional chemical sensitization, it is preferable to cause 100% of the organic sensitizer to react in the process of chemical sensitization or to remove the unreacted chemical sensitizer in the process of washing, cause the unreacted organic sensitizer to decompose with an oxidizing agent having no sensitizing effect, or to remove it in the subsequent process.

Silver halide which is to be subjected to chemical sensitization may be formed in the presence of an organic silver salt, may be formed in the absence of an organic silver salt, or may be a mixture thereof.

As a reducing agent used in photothermographic materials are employed reducing agents containing a proton, such as bisphenols and sulfonamidophenols. Accordingly, a compound generating a labile species which is capable of abstracting a proton to deactivate the reducing agent is preferred. More preferred is a compound as a non-colored photooxidizing substance, which is capable of generating a free radical as a labile species on exposure. Any compound having such a function is applicable. However, a halogen radical, which easily forms silver halide is not preferred. An organic free radical composed of plural atoms is preferred. Any compound having such a function and exhibiting no adverse effect on the photothermographic material is usable irrespective of its structure.

Of such free radical generation compounds, a compound containing an aromatic, and carbocyclic or heterocyclic group is preferred, which provides stability to the generated free radical so as to be in contact with the reducing agent for a period sufficient to react with the reducing agent to deactivate it. Representative examples of such compounds include biimidazolyl compounds and iodonium compounds. The imidazolyl compounds generate two imidazolyl radicals as a free radical upon exposure to ultraviolet or visible radiation, which are capable of oxidizing a reducing agent remaining after development, thereby inhibiting reduction of silver salts. It is surprising that the imidazolyl compound is photo-active and capable of oxidizing a reducing agent effective in heat-promoted reduction of a substantially non-photosensitive organic silver salt.

Of such imidazolyl compounds, a compound represented by the following formula [1] is preferred:

Formula [1]

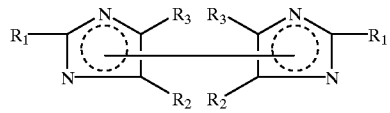

wherein $R_1$, $R_2$ and $R_3$ (,which may be the same or different) each are a hydrogen atom, an alkyl group (e.g., methyl, ethyl, hexyl), an alkenyl group (e.g., vinyl, allyl), an alkoxyl group (e.g., methoxy, ethoxy, octyloxy), an aryl group (e.g., phenyl, naphthyl, tolyl), hydroxy, a hydrogen atom, a halogen atom, an aryloxyl (e.g., phenoxy), an alkylthio group (e.g., methlthio, butylthio), an arylthio group (e.g., phenylthio), a heterocyclic group (e.g., pyridyl, triazyl), an acyl group (e.g., acetyl, propionyl, butylyl, valeryl), a sulfonyl group (e.g., methylsulfonyl, phenylsulfonyl), an acylamino group, sulfonylamino group, an acyloxy group (e.g., acetoxy, benzoxy), carboxy, cyano, a sulfo group, or an amino group. Of these groups are preferred an aryl group, a heterocyclic group, an alkenyl group and cyano group.

The biimidazolyl compounds can be synthesized in accordance with the methods described in U.S. Pat. No. 3,734,733 and British Patent 1,271,177. Preferred Examples thereof are shown below.

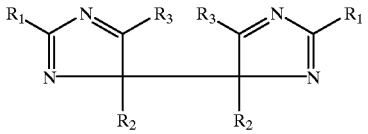
| | $R_1$ | $R_2$ | $R_3$ |
|---|---|---|---|
| BI-1 | H | CN | H |
| BI-2 | CN | H | CN |
| BI-3 | $CF_3$ | H | $CF_3$ |
| BI-4 | 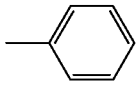 | 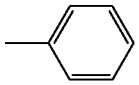 | 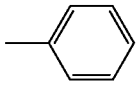 |
| BI-5 | 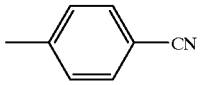 | 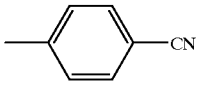 | 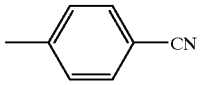 |
| BI-6 | 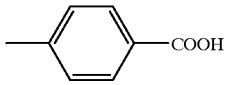 | 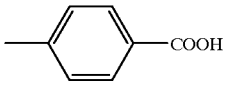 | 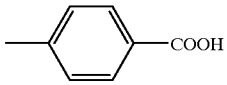 |
| BI-7 | H | —CH=$CH_2$ | H |
| BI-8 | 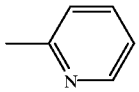 | 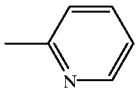 | 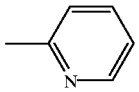 |
| BI-9 | 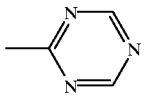 | 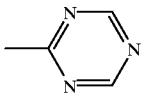 | 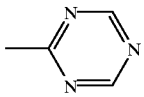 |
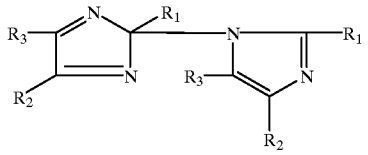
| | $R_1$ | $R_2$ | $R_3$ |
|---|---|---|---|
| BI-10 | H | 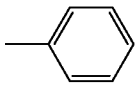 | 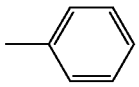 |
| BI-11 | CN | H | H |
| BI-12 | CN | 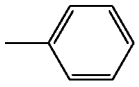 | 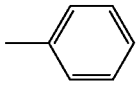 |
| BI-13 | H | 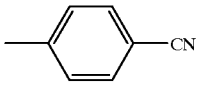 | 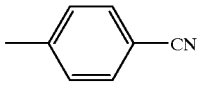 |
| BI-14 | H | $CF_3$ | H |
| BI-15 | H | 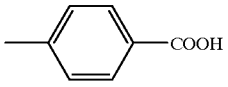 | 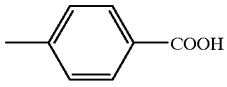 |

-continued

| | | |
|---|---|---|
| BI-16 H | 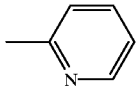 | 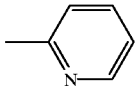 |

Similarly preferred compounds include iodonium compounds represented by the following formula (2):

Formula [2]

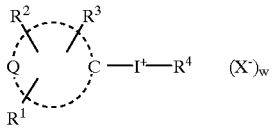

wherein Q is a group of atoms necessary to complete a 5-, 6-, or 7-membered ring, and the atoms being selected from a carbon atom, nitrogen atom, oxygen atom and sulfur atom; and $R^1$, $R^2$ and $R^3$ (,which may be the same or different) are each a hydrogen atom, an alkyl group (e.g., methyl, ethyl, hexyl), an alkenyl group (e.g., vinyl, allyl), an alkoxyl group (e.g., methoxy, ethoxy, octyloxy), an aryl group (e.g., phenyl, naphthyl, tolyl), hydroxy, a halogen atom, an aryloxyl (e.g., phenoxy), an alkylthio group (e.g., methylthio, butylthio), an arylthio group (e.g., phenylthio), an acyl group (e.g., acetyl, propionyl, butylyl, valeryl), a sulfonyl group (e.g., methylsulfonyl, phenylsulfonyl), an acylamino group, sulfonylamino group, an acyloxy group (e.g., acetoxy, benzoxy), carboxy, cyano, a sulfo group, or an amino group. Of these groups are preferred an aryl group, an alkenyl group and cyano group, provided that $R^1$, $R^2$ and $R^3$ may be bonded with each other to form a ring; $R^4$ is a carboxylate group such as acetate, benzoate or trifluoroacetate, or $O^-$; W is 0 or 1, provided that when $R^3$ is a sulfo group or a carboxy group, W is O and $R^4$ is $O^-$; $X^-$ is an anionic counter ion, including $CH_3CO_2$—, $CH_3SO_3$— and $PF_6^-$.

Of these is specifically preferred a compound represented by the following formula [3]:

Formula [3]

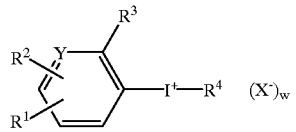

wherein $R^1$, $R^2$, $R^3$, $R^4$, $X^-$ and W are each the same as defined in formula [2]; Y is a carbon (i.e., —CH═) to form a benzene ring or a nitrogen atom (—N═) to form a pyridine ring.

The iodonium compounds described above can be synthesized in accordance with the methods described in Org. Syn., 1961 and Fieser, "Advanced Organic Chemistry" (Reinhold, N.Y., 1961). Examples of the suitable compounds are represented by the following general formulas.

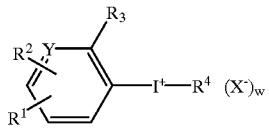

| Compound | $R^1$ | $R^2$ | $R^3$ | $R^4$ | W | X | Y |
|---|---|---|---|---|---|---|---|
| I-1 | H | H | H | $OCOCH_3$ | 1 | $OCOCH_3$ | C |
| I-2 | H | H | H | $OCOCF_3$ | 1 | $OCOCF_3$ | C |
| I-3 | H | $CH_3$ | H | $OCOCH_3$ | 1 | $OCOCH_3$ | C |
| I-4 | H | $CH_3$ | $CO_2H$ | $O^-$ | 0 | — | C |
| I-5 | H | H | $CO_2H$ | $O^-$ | 0 | — | C |
| I-6 | H | CN | $CO_2H$ | $O^-$ | 0 | — | C |
| I-7 | $OCH_3$ | $CH_3$ | H | $OCOCH_3$ | 1 | $OCOCH_3$ | C |
| I-8 | $CH_3$ | $CH_3$ | $CH_3$ | $OCOCH_3$ | 1 | $OCOCH_3$ | C |
| I-9 | $CH_3$ | $CH_3$ | H | $OCOCH_3$ | 1 | $OCOCH_3$ | C |
| I-12 | $CH_3$ | $CH_3$ | $CO_2H$ | $O^-$ | 0 | — | C |
| I-13 | H | H | $SO_3H$ | $O^-$ | 0 | — | C |
| I-14 | H | CN | $CO_2H$ | $O^-$ | 0 | — | C |
| I-15 | $OCH_3$ | Cl | H | $OCOCH_3$ | 1 | $OCOCH_3$ | C |
| I-16 | $CO_2H$ | H | H | $OCOCH_3$ | 1 | $OCOCH_3$ | C |
| I-17 | $OCH_3$ | Cl | $CH_3$ | $OCOCH_3$ | 1 | $OCOCH_3$ | C |
| I-18 | H | H | H | $OCOCH_2CH_3$ | 1 | $OCOCH_2CH_3$ | C |
| I-19 | H | $CH_2OH$ | H | $OCOCH_3$ | 1 | $OCOCH_3$ | C |
| I-20 | Cl | $CH_2OH$ | $CO_2H$ | $O^-$ | 0 | — | C |
| I-21 | Cl | $CH_3$ | $SO_3H$ | $O^-$ | 0 | — | C |
| I-22 | $CH_3$ | CN | $CO_2H$ | $O^-$ | 0 | — | C |
| I-23 | $CF_3$ | Cl | H | $OCOCH_3$ | 1 | $OCOCH_3$ | C |
| I-24 | $CO_2H$ | H | H | $OCOCH_3$ | 1 | $OCOCH_3$ | C |
| I-25 | $OCCH_3$ | H | $C_6H_5$ | $OCOCH_3$ | 1 | $OCOCH_3$ | C |
| I-26 | $C_6H_5$ | H | H | $OCOCH_3$ | 1 | $OCOCH_2CH_3$ | C |

-continued

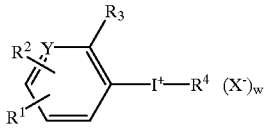

| Compound | $R^1$ | $R^2$ | $R^3$ | $R^4$ | W | X | Y |
|---|---|---|---|---|---|---|---|
| I-27 | $C_6H_4CO_2H$ | H | H | $OCOCH_3$ | 1 | $OCOCH_3$ | C |
| I-28 | H | $CH_2OH$ | $CO_2H$ | $O^-$ | 0 | — | C |
| I-29 | $SO_2CH_3$ | H | H | $OCOCH_3$ | 1 | $OCOCH_3$ | C |
| I-30 | Cl | CN | $CO_2H$ | $O^-$ | 0 | — | C |
| I-31 | $CF_3$ | $OCH_3$ | H | $OCOCH_3$ | 1 | $OCOCH_3$ | C |
| I-32 | $CO_2H$ | $CO_2H$ | H | $OCOCH_3$ | 1 | $OCOCH_3$ | C |
| I-33 | H | H | H | $OCOCH_3$ | 1 | $OCOCH_3$ | N |
| I-34 | H | H | H | $OCOCF_3$ | 1 | $OCOCF_3$ | N |
| I-35 | H | COOH | COOH | $O^-$ | 1 | $OCOCH_3$ | N |
| I-36 | H | CN | COOH | $O^-$ | 0 | — | N |

I-37

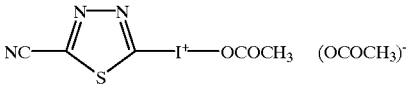

I-38

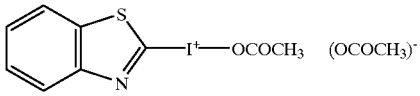

The compound releasing a labile species other than a halogen atom, such as represented by formula [1] or [2] is incorporated preferably in an amount of 0.001 to 0.1 mol/$m^2$, and more preferably 0.005 to 0.05 mol/$m^2$. The compound may be incorporated into any component layer of the photothermographic material relating to the invention and is preferably incorporated in the vicinity of a reducing agent.

As a compound capable of deactivating a reducing agent to inhibit reduction of an organic silver salt to silver by the reducing agent are preferred compounds releasing a labile species other than a halogen atom. However, these compounds may be used in combination with a compound capable of releasing a halogen atom as a labile species. The compound capable of releasing a halogen atom as a labile species is used preferably in an amount of 0.001 to 0.1 mol/$m^2$ and more preferably 0.005 to 0.05 mol/$m^2$. Exemplary examples of the compound releasing an active halogen atom include a compound represented by the following formula [4]:

Formula [4]

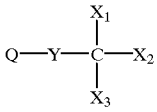

wherein Q is an aryl group or a heterocyclic group; $X_1$, $X_2$ and $X_3$ are each a hydrogen atom, a halogen atom, a haloalkyl group, an acyl group, an alkoxycarbonyl group, an aryloxycarbonyl group, a sulfonyl group, an aryl group or a heterocyclic group, provided that at least of them a halogen atom; Y is —C(=O)—, —SO— or —$SO_2$—. The aryl group represented by Q may be a monocyclic group or condensed ring group and is preferably a monocyclic or di-cyclic aryl group having 6 to 30 carbon atoms (e.g., phenyl, naphthyl), more preferably a phenyl or naphthyl group, and still more preferably a phenyl group. The heterocyclic group represented by Q is a 3- to 10-membered, saturated or unsaturated heterocyclic group containing at least one of N, O and S, which may be a monocyclic or condensed with another ring to a condensed ring.

The heterocyclic group is preferably a 5- or 6-membered unsaturated heterocyclic group, which may be condensed, more preferably a 5- or 6-membered aromatic heterocyclic group, which may be condensed, still more preferably a N-containing 5- or 6-membered aromatic heterocyclic group, which may be condensed, and optimally a 5- or 6-membered aromatic heterocyclic group containing one to four N atoms, which may be condensed. Exemplary examples of heterocyclic rings included in the heterocyclic group include imidazole, pyrazole, pyridine, pyrimidine, pyrazine, pyridazine, triazole, triazines, indole, indazole, purine, thiazole, oxadiazole, quinoline, phthalazine, naphthyridine, quinoxaline, quinazoline, cinnoline, pteridine, acrydine, phenanthroline, phenazine, tetrazole, thiazole, oxazole, benzimidazole, benzoxazole, benzthiazole, indolenine and tetrazaindene. Of these are preferred imidazole, pyridine, pyrimidine, pyrazine, pyridazine, triazole, triazines, thiadiazole, oxadiazole, quinoline, phthalazine, naphthylizine, quinoxaline, quinazoline, cinnoline, tetrazole, thiazole, oxazole, benzimidazole, and tetrazaindene; more preferably imidazole, pyrimidine, pyridine, pyrazine, pyridazine, triazole, triazines, thiadiazole, quinoline, phthalazine, naphthyridine, quinoxaline, quinazoline, cinnoline, tetrazole, thiazole, benzimidazole, and benzthiazole; and still more preferably pyridine, thiazole, quinoline and benzthiazole.

The aryl group or heterocyclic group represented by Q may be substituted by a substituent, in addition to -Y-C ($X_1$) ($X_2$) ($X_3$). Preferred examples of the substituent include an alkyl group, an alkenyl group, an aryl group, an alkoxyl group, an aryloxyl group, an acyloxy group, an acyl group, an alkoxycarbonyl group, an aryloxycarbonyl group, an acyloxy group, an acylamino group, an alkoxycarbonylamino group, an aryloxycarbonylamino group, a sulfonylamino group, a sulfamoyl group, a carbamoyl group, a sulfonyl group, a ureido group, phosphoramido group, a halogen atom, cyano group, sulfo group, carboxy group, nitro group and heterocyclic group. Of these are preferred an alkyl group, an aryl group, an alkoxyl group, an aryloxyl group, an acyl group, an acylamino group, an aryloxyl group, acyl group, an acylamino group, an alkoxycarbonyl group, an aryloxycarbonylamino group, a sulfonylamino group, a sulfamoyl group, a carbamoyl group, a ureido group, phosphoramido group, a halogen atom, cyano group, nitro group, and a heterocyclic group; and more preferably an alkyl group, an aryl group, an alkoxyl group, an aryloxyl group, an acyl group, an acylamino group, a sulfonylamino group, a sulfamoyl group, a carbamoyl group, a halogen group, cyano group, nitro group and a heterocyclic group; and still more preferably an alkyl group, an aryl group and a halogen atom.

$X_1$, $X_2$ and $X_3$ are preferably a halogen atom, a haloalkyl group, an acyl group, an alkoxycarbonyl group, an aryloxycarbonyl group, a carbamoyl group, a sulfamoyl group, a sulfonyl group, and a heterocyclic group, more preferably a halogen atom, a haloalkyl group, an acyl group, an alkoxycarbonyl group, an aryloxycarbonyl group, and a sulfonyl group; and still more preferably a halogen atom and trihalomethyl group; and most preferably a halogen atom. Of halogen atoms are preferably chlorine atom, bromine and iodine atom, and more preferably chlorine atom and bromine atom, and still more preferably bromine atom. Y is —C(=O)—, —SO—, and —$SO_2$—, and preferably —$SO_2$—.

Exemplary examples of these compounds are shown below.

4-1

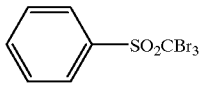

4-2

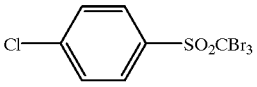

4-3

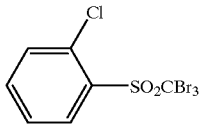

4-4

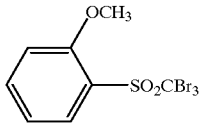

4-5

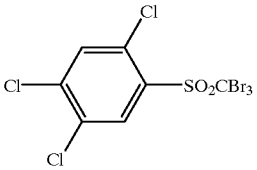

4-6

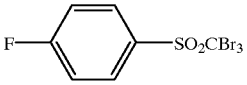

-continued 4-7

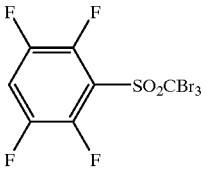

4-8

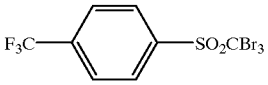

4-9

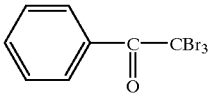

4-10

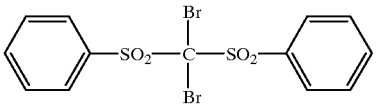

4-11

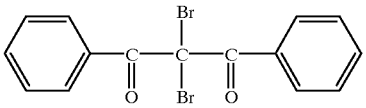

4-12

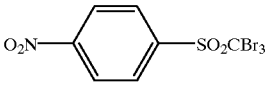

4-13

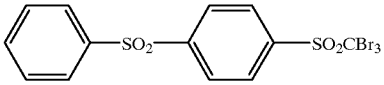

4-14

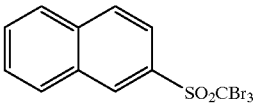

4-15

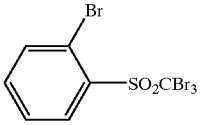

4-16

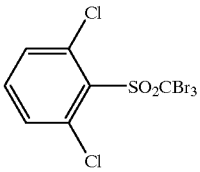

4-17

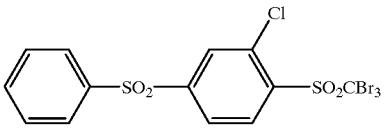

-continued
4-18
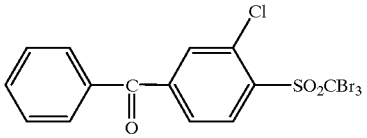
4-19
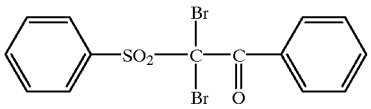
4-20
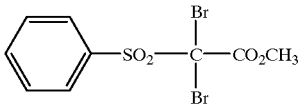
4-21
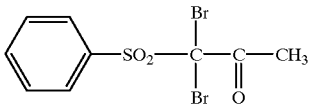
4-22
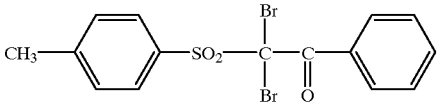
4-23
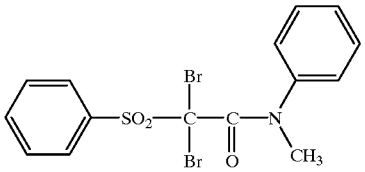
4-24
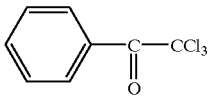
4-25
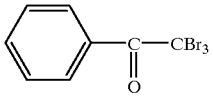
4-26
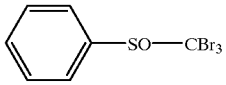
4-27
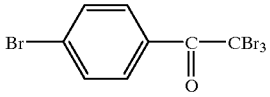
4-28
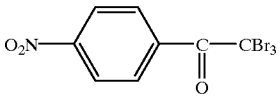
4-29
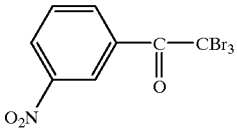
-continued
4-30
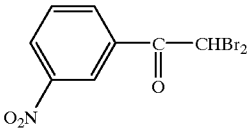
4-31
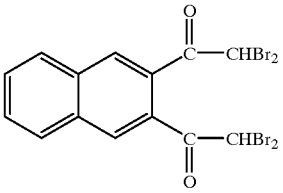
4-32
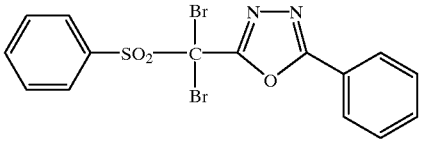
4-33
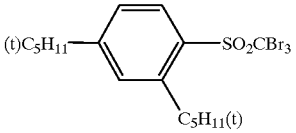
4-34
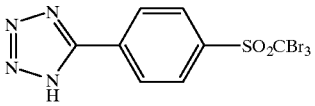
4-35
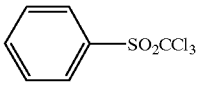
4-36
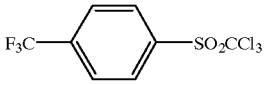
4-37
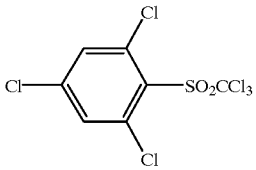
4-38
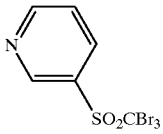
4-39
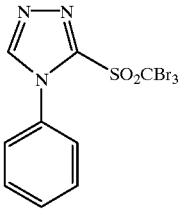

-continued
4-40
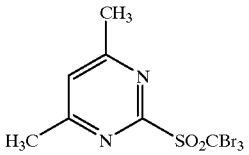
4-41
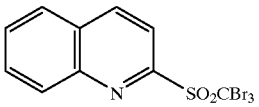
4-42
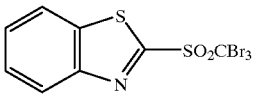
4-43
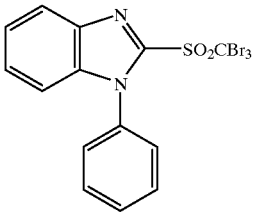
4-44
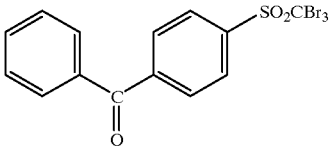
4-45
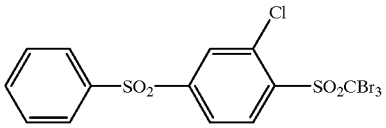
4-46
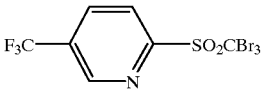
4-47
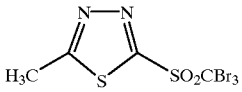
4-48
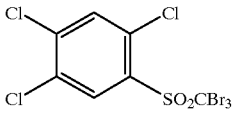
4-49
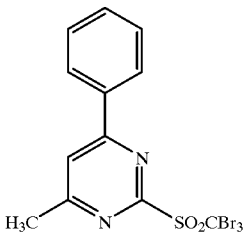
-continued
4-50
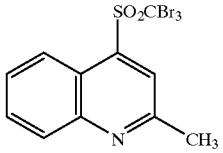
4-51
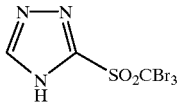
4-52
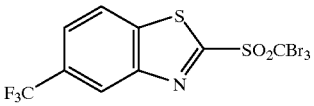
4-53
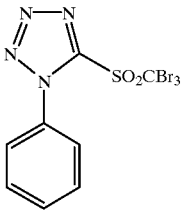
4-54
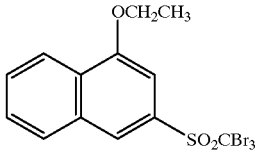
4-55
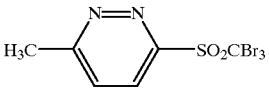
4-56
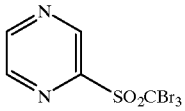
4-57
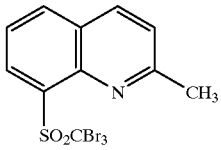
4-58
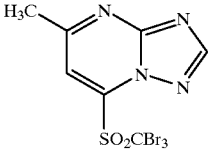
4-59
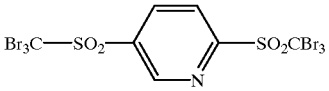

-continued 4-60

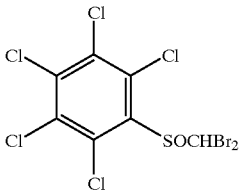

4-61

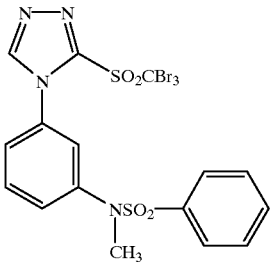

4-62

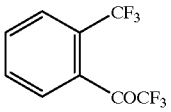

4-63

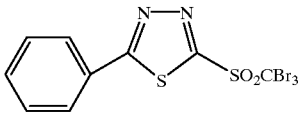

4-64

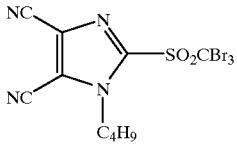

These compounds are incorporated in an amount within a range such that increased formation of print-out silver produces substantially no problem, preferably in an amount of not more than 150%, and more preferably not more than 100% based on the compound releasing a labile species other than a halogen atom. As afore-mentioned, these compounds deactivate a reducing agent included in the thermally developable light sensitive layer, enhancing storage stability of the photothermographic material. Reducing agents used in the photothermographic materials and capable of deactivating a free radical will be described.

Reducing agents are incorporated into the photothermographic material of the present invention. Examples of suitable reducing agents are described in U.S. Pat. Nos. 3,770,448, 3,773,512, and 3,593,863, and Research Disclosure Items 17029 and 29963, and include the following: aminohydroxycycloalkenone compounds (for example, 2-hydroxypiperidino-2-cyclohexane); esters of amino reductones as the precursor of reducing agents (for example, piperidinohexose reducton monoacetate); N-hydroxyurea derivatives (for example, N-p-methylphenyl-N-hydroxyurea); hydrazones of aldehydes or ketones (for example, anthracenealdehyde phenylhydrazone; phosphamidophenols; phosphamidoanilines; polyhydroxybenzenes (for example, hydroquinone, t-butylhydroquinone, isopropylhydroquinone, and (2,5-dihydroxy-phenyl) methylsulfone); sulfydroxamic acids (for example, benzenesulfhydroxamic acid); sulfonamidoanilines (for example, 4-(N-methanesulfonamide)aniline); 2-tetrazolylthiohydroquinones (for example, 2-methyl-5-(1-phenyl-5-tetrazolylthio)hydroquinone); tetrahydroquinoxalines (for example, 1,2,3,4-tetrahydroquinoxaline); amidoxines; azines (for example, combinations of aliphatic carboxylic acid arylhydrazides with ascorbic acid); combinations of polyhydroxybenzenes and hydroxylamines, reductones and/or hydrazine; hydroxamic acids; combinations of azines with sulfonamidophenols; α-cyanophenylacetic acid derivatives; combinations of bis-β-naphthol with 1,3-dihydroxybenzene derivatives; 5-pyrazolones, sulfonamidophenol reducing agents, 2-phenylindane-1,3-dione, etc.; chroman; 1,4-dihydropyridines (for example, 2,6-dimethoxy-3,5-dicarboethoxy-1,4-dihydropyridine); bisphenols (for example, bis(2-hydroxy-3-t-butyl-5-methylphenyl)methane, bis(6-hydroxy-m-tri)mesitol, 2,2-bis(4-hydroxy-3-methylphenyl)propane, 4,5-ethylidene-bis(2-t-butyl-6-methyl)phenol, UV-sensitive ascorbic acid derivatives and 3-pyrazolidones. Of these, particularly preferred reducing agents are hindered phenols. As preferred hindered phenols, listed are compounds represented by the general formula (A) described below:

Formula (A)

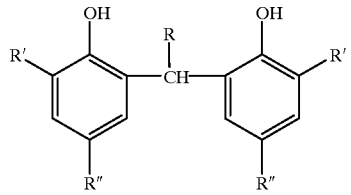

wherein R represents a hydrogen atom or an alkyl group having from 1 to 10 carbon atoms (for example, isopropyl, —$C_4H_9$, 2,4,4-trimethylpentyl), and R' and R" each represents an alkyl group having from 1 to 5 carbon atoms (for example, methyl, ethyl, t-butyl).

Exemplary examples of the compounds represented by the formula (A) are shown below.

A-1

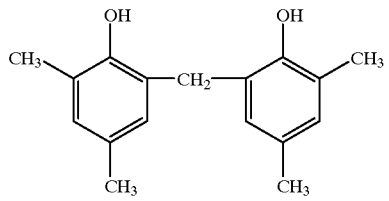

A-2

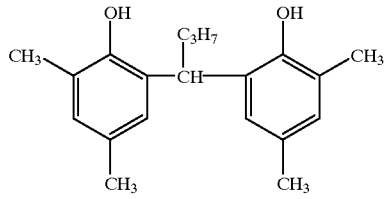

-continued

A-3

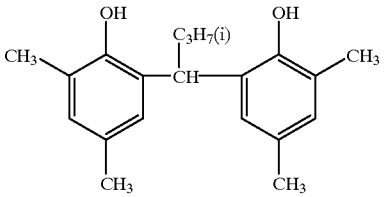

A-4

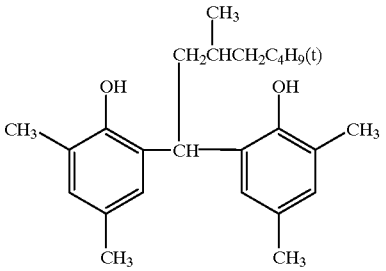

A-5

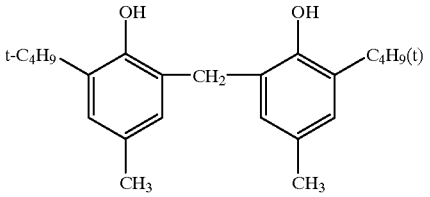

A-6

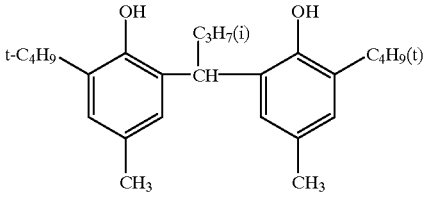

A-7

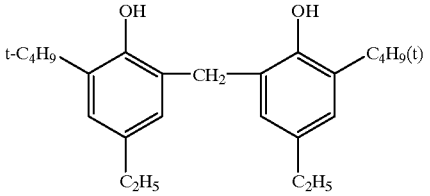

The used amount of reducing agents represented by the above-mentioned general formula (A) is preferably between $1\times10^{-2}$ and 10 moles, and is more preferably between $1\times10^{-2}$ and 1.5 moles per mole of silver.

The photothermographic material according to the invention contains a light sensitive silver halide and an organic silver salt.

Light sensitive silver halide grains used in the invention will be described. Silver halide emulsions used in the invention can be prepared according to the methods described in P. Glafkides, Chimie Physique Photographique (published by Paul Montel Corp., 19679; G. F. Duffin, Photographic Emulsion Chemistry (published by Focal Press, 1966); V. L. Zelikman et al., Making and Coating of Photographic Emulsion (published by Focal Press, 1964). Any one of acidic precipitation, neutral precipitation and ammoniacal precipitation is applicable and the reaction mode of aqueous soluble silver salt and halide salt includes single jet addition, double jet addition and a combination thereof. Specifically, preparation of silver halide grains with controlling the grain formation condition, so-called controlled double-jet precipitation is preferred. The halide composition of silver halide is not specifically limited and may be any one of silver chloride, silver chlorobromide, silver iodochlorobromide, silver bromide, silver iodobromide and silver iodide.

The grain formation process is usually classified into two stages of formation of silver halide seed crystal grains (nucleation) and grain growth. These stages may continuously be conducted, or nucleation (seed grain formation) and grain growth may be separately performed. The controlled double-jet precipitation, in which grain formation is undergone with controlling grain forming conditions such as pAg and pH, is preferred to control the grain form or grain size. In cases when nucleation and grain growth are separately conducted, for example, a soluble silver salt and a soluble halide salt are homogeneously and promptly mixed in an aqueous gelatin solution to form nucleus grains (seed grains), thereafter, grain growth is performed by supplying soluble silver and halide salts, while being controlled at a pAg and pH to prepare silver halide grains. After completing the grain formation, the resulting silver halide grain emulsion is subjected to desalting to remove soluble salts by commonly known washing methods such as a noodle washing method, a flocculation method, a ultrafiltration method, or electrodialysis to obtain desired emulsion grains.

In order to minimize cloudiness after image formation and to obtain excellent image quality, the less the average grain size, the more preferred, and the average grain size is preferably not more than 0.2 $\mu$m, more preferably between 0.01 and 0.17 $\mu$m, and still more preferably between 0.02 and 0.14 $\mu$m. The average grain size as described herein is defined as an average edge length of silver halide grains, in cases where they are so-called regular crystals in the form of cube or octahedron. Furthermore, in cases where grains are tabular grains, the grain size refers to the diameter of a circle having the same area as the projected area of the major faces. Furthermore, silver halide grains are preferably monodisperse grains. The monodisperse grains as described herein refer to grains having a coefficient of variation of grain size obtained by the formula described below of not more than 7%; more preferably not more than 5%, still more preferably not more than 3%, and most preferably not more than 1%.

Coefficient of variation of grain size (%)=standard deviation of grain diameter/average grain diameter×100

The grain form includes cubic, octahedral or tetradecahedral grains, tabular grains, spherical grains, bar-like grains, and potato-shaped grains. Of these, cubic grains, octahedral grains, tetradecahedral grains and tabular grains are specifically preferred.

The aspect ratio of tabular grains is preferably 2 to 100, and more preferably 3 to 50. These grains are described in U.S. Pat. Nos. 5,264,337, 5,314,798 and 5,320,958 and desired tabular grains can be readily obtained. Silver halide grains having rounded corners are also preferably employed.

The silver halide grain shape is not specifically limited, but a high ratio accounted for by a Miller index [100] plane is preferred. This ratio is preferably at least 50%; is more preferably at least 70%, and is most preferably at least 80%. The ratio accounted for by the Miller index [100] face can be obtained based on T. Tani, J. Imaging Sci., 29, 165 (1985) in which adsorption dependency of a [111] face or a [100] face is utilized.

It is preferred to use low molecular gelatin having an average molecular weight of not more than 50,000 in the preparation of silver halide grains used in the invention, specifically, in the stage of nucleation. Thus, the low molecular gelatin has an average molecular eight of not more than 50,000, preferably 2,000 to 40,000, and more preferably 5,000 to 25,000. The average molecular weight can be determined by means of gel permeation chromatography. The low molecular gelatin can be obtained by subjecting an aqueous gelatin conventionally used and having an average molecular weight of ca. 100,000 to enzymatic hydrolysis, acid or alkali hydrolysis, thermal degradation at atmospheric pressure or under high pressure or ultrasonic degradation.

The concentration of dispersion medium used in the nucleation stage is preferably not more than 5% by weight, and more preferably 0.05 to 3.0% by weight.

In the preparation of silver halide grains, it is preferred to use a compound represent by the following formula [5], specifically in the nucleation stage:

Formula [5]

$$YO(CH_2CH_2O)m(C(CH_3)HCH_2O)p(CH_2CH_2O)nY$$

wherein Y is a hydrogen atom, —$SO_3M$ or —CO-B-COOM, in which M is a hydrogen atom, alkali metal atom, ammonium group or ammonium group substituted by an alkyl group having carbon atoms of not more than 5, and B is a chained or cyclic group forming an organic dibasic acid; m and n each are 0 to 50; and p is 1 to 100. The compound represented by formula [5] has been employed as a defoaming agent to inhibit marked foaming occurred when stirring or moving emulsion raw materials, specifically in the stage of preparing an aqueous gelatin solution, adding a water-soluble silver and halide salts to the aqueous gelatin solution or coating an emulsion on a support during the process of preparing silver halide photographic light sensitive materials. A technique of using these compounds as a defoaming agent is described in JP-A 44-9497. The compound represented by formula [5] also functions as a defoaming agent during nucleation.

The compound represented by formula [5] is used preferably in an amount of not more than 1%, and more preferably 0.01 to 0.1% by weight, based on silver. The compound is to be present at the stage of nucleation, and may be added to a dispersing medium prior to or during nucleation. Alternatively, the compound may be added to an aqueous silver salt solution or halide solution used for nucleation. It is preferred to add it to a halide solution or both silver salt and halide solutions in an amount of 0.01 to 2.0% by weight. It is also preferred to make the compound represented by formula [5] present over a period of at least 50% (more preferably, at least 70%) of the nucleation stage. The compound may be added in the form of powder or solution using a solvent such as methanol. Representative examples of the compound represented by formula [5] are shown below, but are not limited to these.

E-1

$$HO(CH_2CH_2O)_m(C(CH_3)HCH_2O)_{19.8}(CH_2CH_2O)_nH \quad (m+n=9.77)$$

E-2

$$NaO_2C(CH_2)OCO(CH_2CH_2O)_m(C(CH_3)HCH_2O)_{17}(CH_2CH_2O)_n CO(CH_2)_2CO_2Na \quad (m+n=5.7)$$

E-3

$$KO_2CCH{=}CHCOO(CH_2CH_2O)_m(C(CH_3)HCH_2O)_{34.2}(CH_2CH_2O)_nCOCH{=}CHCO_2K \quad (m+n=8.5)$$

E-4

$$NaO_3SO(C(CH_3)HCH_2O)_{17}SO_3Na$$

E-4

E-5

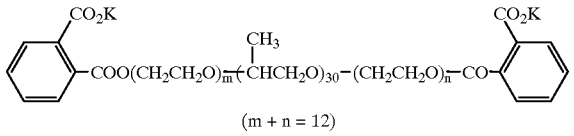

E-6

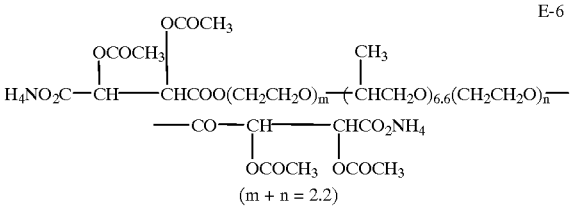

The temperature during the stage of nucleation is preferably 5 to 60° C., and more preferably 15 to 50° C. Even when nucleation is conducted at a constant temperature, in a temperature-increasing pattern (e.g., in such a manner that nucleation starts at 25° C. and the temperature is gradually increased to reach 40° C. at the time of completion of nucleation) or its reverse pattern, it is preferred to control the temperature within the range described above.

Silver salt and halide salt solutions used for nucleation are preferably in a concentration of not more than 3.5N, and more preferably 0.01 to 2.5N. The flow rate of aqueous silver salt solution is preferably $1.5\times10^{-3}$ to $3.0\times10^{-1}$ /min per lit. of the solution, and more preferably $3.0\times10^{-3}$ to $8.0\times10^{-2}$ mol/min. per lit. of the solution. The pH during nucleation is within a range of 1.7 to 10, and since the pH at the alkaline side broadens the grain size distribution, the pH is preferably 2 to 6. The pBr during nucleation is 0.05 to 3.0, preferably 1.0 to 2.5, and more preferably 1.5 to 2.0.

Silver halide may be incorporated into an image forming layer by any means, in which silver halide is arranged so as to be as close to reducible silver source as possible. It is general that silver halide, which has been prepared in advance, added to a solution used for preparing an organic silver salt. In this case, preparation of silver halide and that of an organic silver salt are separately performed, making it easier to control the preparation thereof. Alternatively, as described in British Patent 1,447,454, silver halide and an organic silver salt can be simultaneously formed by allowing a halide component to be present together with an organic silver salt-forming component and by introducing silver ions thereto.

Silver halide can also be prepared by reacting a halogen containing compound with an organic silver salt through conversion of the organic silver salt. Thus, a silver halide-forming component is allowed to act onto a pre-formed organic silver salt solution or dispersion or a sheet material containing an organic silver salt to convert a part of the organic silver salt to light sensitive silver halide. The thus formed silver halide is effectively in contact with the organic silver salt, exhibiting favorable actions. In this case, the silver halide-forming component refers to a compound capable of forming silver salt upon reaction with the organic silver salt. Such a compound can be distinguished by the following simple test. Thus, a compound to be tested is to be mixed with the organic silver salt, and if necessary, the presence of a specific peak in silver halide can be confirmed by the X-ray diffractometry, after heating. Compounds that have been confirmed to be effective as a silver halide-forming component include inorganic halide compounds, onium halides, halogenated hydrocarbons, N-halogen compounds and other halogen containing compounds. These compounds are detailed in U.S. Pat. Nos. 4,009,039, 3,457,075 and 4,003,749, British Patent 1,498,956 and JP-A 53-27027 and 53-25420. Exemplary examples thereof are shown below:

(1) Inorganic halide compound: e.g., a halide compound represented by formula, M×n, in which M represents H, NH4 or a metal atom; n is 1 when M is H or NH4 and a number equivalent to a valence number of the metal atom when M is the metal atom; the metal atom includes lithium, sodium, potassium, cesium, magnesium, calcium, strontium, barium, zinc, cadmium, mercury, tin, antimony, chromium, manganese, cobalt, rhodium, and cerium, and molecular halogen such as aqueous bromine being also effective;

(2) Onium halide: e.g., quaternary ammonium halides such as trimethylphenylammonium bromide, cetylethyldimethylammonium bromide, and trimethylbenzylammonium bromide; and tertiary sulfonium halides such as trimethylsulfonium iodide;

(3) Halogenated hydrocarbons: e.g., iodoform, bromoform, carbon tetrachloride and 2-brom-2-methylpropane;

(4) N-halogeno compounds: e.g., N-chlorosuccinimide, N-bromosucciimde, N-bromophthalimide, N-bromoacetoamide, N-iodosuccinimide, N-bromophthalazinone, N-bromooxazolinone, N-chlorophthalazinone, N-bromoacetoanilide, N,N-dibromobenzenesulfonamide, N-bromo-N-methylbenzenesulfonamide, 1,3-dibromo-4,4-dimethylhydantoin and N-bromourazole;

(5) Other halogen containing compounds: e.g., triphenylmethyl chloride, triphenylmethyl bromide 2-bromoacetic acid, 2-bromoethanol and dichlorobenzophenone.

The silver halide forming components may be used in combination. As described above, although silver halide can be formed by converting a part or all of an organic silver salt to silver halide through reaction of the organic silver salt and a halide ion, it is preferred to use silver halide separately prepared which can be easily controlled with respect to grain size or grain form. The silver halide separately prepared may be used in combination with silver halide prepared by conversion of at least apart of an organic silver salt. The silver halide which is separately prepared or prepared through conversion of an organic silver salt is used preferably in an amount of 0.001 to 0.7 mol, and more preferably 0.03 to 0.5 mol per mol of organic silver salt.

Silver halide preferably occludes ions of metals belonging to Groups 6 to 11 of the Periodic Table. Preferred as the metals are W; Fe, Co, Ni, Cu, Ru, Rh, Pd, Re, Os, Ir, Pt and Au. These metals may be introduced into silver halide in the form of a complex. In the present invention, regarding the transition metal complexes, six-coordinate complexes represented by the general formula described below are preferred:

Formula:$(ML_6)^m$:

wherein M represents a transition metal selected from elements in Groups 6 to 11 of the Periodic Table; L represents a coordinating ligand; and m represents 0, 1-, 2-, 3- or 4-.

Exemplary examples of the ligand represented by L include halides (fluoride, chloride, bromide, and iodide), cyanide, cyanato, thiocyanato, selenocyanato, tellurocyanato, azido and aquo, nitrosyl, thionitrosyl, etc., of which aquo, nitrosyl and thionitrosyl are preferred. When the aquo ligand is present, one or two ligands are preferably coordinated. L may be the same or different.

Exemplary examples of transition metal ligand complexes are shown below.

1: $[RhCl_6]^{3-}$
2: $[RuCl_6]^{3-}$
3: $[ReCl_6]^{3-}$
4: $[RuBr_6]^{3-}$
5: $[OsCl_6]^{3-}$
6: $[CrCl_6]^{4-}$
7: $[IrCl_6]^{4-}$
8: $[IrCl_6]^{3-}$
9: $[Ru(NO)Cl_5]^{2-}$
10: $[RuBr_4(H_2O)]^{2-}$
11: $[Ru(NO)\ (H_2O)Cl_4]^{-}$
12: $[RhCl_5(H_2O)]^{2-}$
13: $[Re(NO)Cl_5]^{2-}$
14: $[Re(NO)(CN)_5]^{2-}$
15: $[Re(NO)Cl(CN)_4]^{2-}$
16: $[Rh(NO)_2Cl_4]^{-}$
17: $[Rh(NO)\ (H_2O)Cl_4]^{-}$
18: $[Ru(NO)(CN)_5]^{2-}$
19: $[Fe(CN)_6]^{3-}$
20: $[Rh(NS)Cl_5]^{2-}$
21: $[Os(NO)Cl_5]^{2-}$
22: $[Cr(NO)Cl_5]^{2-}$
23: $[Re(NO)Cl_5]^{-}$
24: $[Os(NS)Cl_4(TeCN)]^{2-}$
25: $[Ru(NS)Cl_5]^{2-}$
26: $[Re(NS)Cl_4(SeCN)]^{2-}$
27: $[Os(NS)Cl(SCN)_4]^{2-}$
28: $[Ir(NO)Cl_5]^{2-}$

With regard to cobalt or iron compounds, hexacyano cobalt or iron complexes are preferably used and exemplary examples thereof are shown below:

29: $[Fe(CN)_6]^{4-}$
30: $[Fe(CN)_6{}^{3-}$
31: $(Co(CN)_6]^{3-}$

Compounds, which provide these metal ions or complex ions, are preferably incorporated into silver halide grains through addition during the silver halide grain formation. These may be added during any preparation stage of the silver halide grains, that is, before or after nuclei formation, growth, physical ripening, and chemical ripening. However, these are preferably added at the stage of nuclei formation, growth, and physical ripening; furthermore, are preferably added at the stage of nuclei formation and growth; and are most preferably added at the stage of nuclei formation. These compounds may be added several times by dividing the added amount. Uniform content in the interior of a silver halide grain can be carried out. As disclosed in JP-A No. 63-29603, 2-306236, 3-167545, 4-76534, 6-110146, 5-273683, the metal can be distributively occluded in the interior of the grain.

These metal compounds can be dissolved in water or a suitable organic solvent (for example, alcohols, ethers, glycols, ketones, esters, amides, etc.) and then added. Furthermore, there are methods in which, for example, an aqueous metal compound powder solution or an aqueous solution in which a metal compound is dissolved along with NaCl and KCl is added to a water-soluble silver salt solution during grain formation or to a water-soluble halide solution; when a silver salt solution and a halide solution are simultaneously added, a metal compound is added as a third solution to form silver halide grains, while simultaneously mixing three solutions; during grain formation, an aqueous solution comprising the necessary amount of a metal compound is placed in a reaction vessel; or during silver halide preparation, dissolution is carried out by the addition of other silver halide grains previously doped with metal ions or complex ions. Specifically, the preferred method is one in which an aqueous metal compound powder solution or an aqueous solution in which a metal compound is dissolved along with NaCl and KCl is added to a water-soluble halide solution. When the addition is carried out onto grain surfaces, an aqueous solution comprising the necessary amount of a metal compound can be placed in a reaction vessel immediately after grain formation, or during physical ripening or at the completion thereof or during chemical ripening.

Silver halide grain emulsions used in the invention may be desalted after the grain formation, using the methods known in the art, such as the noodle washing method and flocculation process.

The light sensitive silver halide grains used in the invention is chemically sensitized with not only the foregoing chalcogen atom-containing organic sensitizer, but also by the commonly known chemical sensitization such as noble metal sensitization and reduction sensitization. These sensitization may be employed in combination.

Examples of the compounds used in the noble metal sensitization include chloroauric acid, potassium chloroaurate, potassium aurothiocyanate, gold sulfide, gold selenide, compounds described U.S. Pat. No. 2,448,060 and British Patent No. 618,061. Examples of the compounds used in the reduction sensitization include ascorbic acid, thiourea dioxide, stannous chloride, aminoiminomethanesulfinic acid, hydrazine derivatives, borane compounds, silane compounds and polyamine compounds. The reduction sensitization can be carried out by ripening an emulsion with keeping the pH and pAg at not less than 7 and not more than 8.3, respectively.

Silver halide used in the invention is preferably spectral-sensitized by allowing a sensitizing dye to adsorb onto the silver halide. Spectral sensitizing dues usable in the invention include cyanine dyes, merocyanine dyes, complex cyanine dyes, complex merocyanine dyes, holopolar cyanine dyes, styryl dyes, hemi-cyanine dyes, oxonol dyes and hemi-oxonol dyes, as described in JP-A 63-159841, 60-140335, 63-231437, 63-259651, 63-304242, and 63-15245; U.S. Pat. Nos. 4,639,414, 4,740,455, 4,741,966, 4,751,175 and 4,835,096. Useful sensitizing dyes used in the invention are also described in RD17643, sect. IV-A (December, 1978, page 23) and RD18431 sect. IX (August, 1978, page 437). It is specifically preferred to use sensitizing dyes exhibiting spectral sensitivity suited for spectral characteristics of light sources used in a laser imager or a scanner, as described in JP-A 9-34078, 9-54409 and 9-80679.

Useful cyanine dyes are those which contain a basic nucleus, such as a thiazoline nucleus, oxazoline nucleus, pyrroline nucleus, pyridine nucleus, oxazole nucleus, thiazole nucleus, selenazole nucleus and imidazole nucleus. Useful preferred merocyanine dyes include acidic nuclei such as a thiohydantoin nucleus, rhodanine nucleus, oxazolidinedione nucleus, thiazolinedione nucleus, barbituric acid nucleus, thiazolinone nucleus, malononirile nucleus and pyrazolone nucleus, as well as basic nuclei described above.

It is specifically preferred to use sensitizing dyes exhibiting sensitivity to the infrared region. Examples of preferred infrared sensitizing dyes used in the invention include those described in U.S. Pat. Nos. 4,536,473, 4,515,888 and 4,959,294.

Specifically, preferred sensitizing dyes are dyes represented by the following formulas (1) to (4):

Formula (S1)

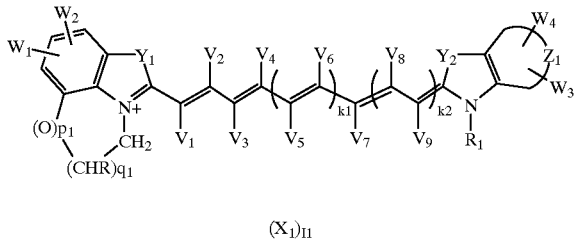

$(X_1)_{I1}$

Formula (S2)

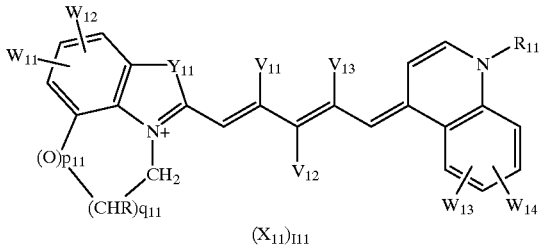

$(X_{11})_{I11}$

Formula (S3)

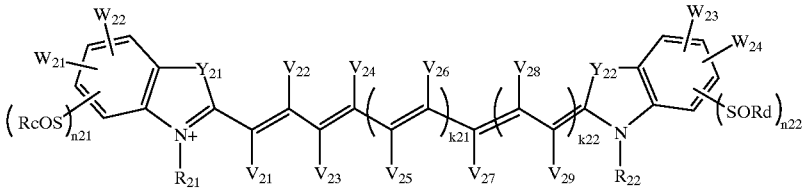

$(X_{21})_{I21}$

-continued

Formula (S4)

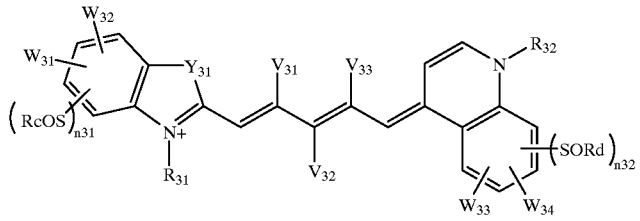

$(X_{31})_{I31}$

In formulas (S1) to (S4), $Y_1$, $Y_2$, $Y_{11}$, $Y_{21}$, $Y_{22}$ and $Y_{31}$ each are independently an oxygen atom, a sulfur atom, a selenium atom, —C(Ra)(Rb)— group or —CH═CH— group, in which Ra and Rb each are a hydrogen atom, an alkyl group (preferably having 1 to 5 carbon atoms) or a non-metallic atom group necessary to form an aliphatic spiro ring; $Z_1$ is a non-metallic atom group necessary to form a 5- or 6-membered ring; $R_1$, $R_{11}$, $R_{21}$, $R_{22}$, $R_{31}$ and $R_{32}$ each are an aliphatic group or a non-metallic atom group necessary to form a condensed ring between $R_1$ and $W_3$ or between $R_{11}$ and $W_{14}$; Rc and Rd each are independently an unsubstituted lower alkyl group, a cycloalkyl group, an aralkyl group, an aryl group or a heterocyclic group; $W_1$, $W_2$, $W_3$, $W_4$, $W_{11}$, $W_{12}$, $W_{13}$, $W_{14}$, $W_{21}$, $W_{22}$, $W_{23}$, $W_{24}$, $W_{31}$, $W_{32}$, $W_{33}$ and $W_{34}$ each are independently a hydrogen atom, a substituent or a non-metallic atom group necessary to form a condensed ring by bonding between $W_1$ and $W_2$, $W_{11}$ and $W_{12}$, $W_{21}$ and $W_{22}$, $W_{23}$ and $W_{24}$, $W_{31}$ and $W_{32}$, or $W_{33}$ and $W_{34}$; $V_1$ to $V_9$, $V_{11}$ to $V_{13}$, $V_{21}$ to $V_{29}$, and $V_{31}$ to $V_{33}$ each are independently a hydrogen atom, a halogen atom, an amino group, an alkylthio group, an arylthio group, a lower alkyl group, a lower alkoxy group, an aryl group, an aryloxy group, a heterocyclic group or a non-metallic atom group necessary to form a 5- to 7-membered ring by bonding between $V_1$ and $V_3$, $V_2$ and $V_4$, $V_3$ and $V_5$, $V_2$ and $V_6$, $V_5$ and $V_7$, $V_6$ and $V_8$, $V_7$ and $V_9$, $V_{11}$ and $V_{13}$, $V_{21}$ and $V_{23}$, $V_{22}$ and $V_{24}$, $V_{23}$ and $V_{25}$, $V_{24}$ and $V_{26}$, $V_{25}$ and $V_{27}$, $V_{26}$ and $V_{28}$, $V_{27}$ and $V_{29}$, or $V_{31}$ and $V_{33}$; $X_{21}$ and $X_{31}$, provided that at least one of $V_1$ to $V_9$ and at least one of $V_{11}$ to $V_{13}$ are a group other than a hydrogen atom; $X_1$, $X_{11}$, $X_{21}$ and $X_{31}$ each are an ion necessary to compensate for an intramolecular charge; 11, 111, 121 and 131 each an ion necessary to compensate for an intramolecular charge; k1, k2, k31 and k32 each are 0 or 1; n21, n22, n31 and n32 each are 0, 1 or 2;, provided that n1 and n22, and n31 and n32 are not 0 at the same time; p1 and p11 are each 0 or 1; q1 and q11 each are 1 or 2, provided that the sum of p1 and q1 and the sum of p11 and q11 each are respectively not more than 2.

Of formulas (S1) and (S2), a compound represented by the following formula (S1-1) or (S2–1) is more preferred:

Formula (S1-1)

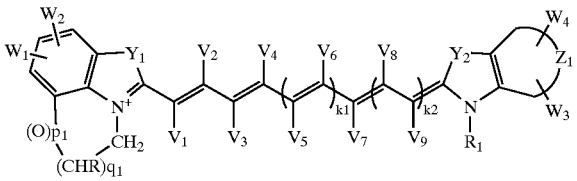

$(X_1)_{I1}$

-continued

Formula (S2-1)

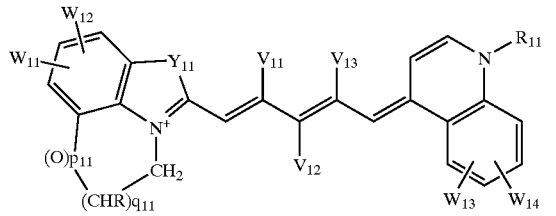

$(X_{11})_{I11}$ wherein $Y_1$, $Y_2$ and $Y_{11}$ each are independently an oxygen atom, a sulfur atom, a selenium atom, —C(Ra)(Rb)— group or —CH═CH— group, in which Ra and Rb each are a hydrogen atom, a lower alkyl group or an atomic group necessary to form an aliphatic spiro-ring when Ra and Rb are linked with each other; $Z_1$ is an atomic group necessary to form a 5- or 6-membered ring; R is a hydrogen atom, a lower alkyl, a cycloalkyl group, an aralkyl group, a lower alkoxy group, an aryl group, a hydroxy group or a halogen atom; $W_1$, $W_2$, $W_3$, $W_4$, $W_{11}$, $W_{12}$, $W_{13}$ and $W_{14}$ each are independently a hydrogen atom, a substituent or a non-metallic atom group necessary to form a condensed ring by bonding between $W_1$ and $W_2$ or $W_{11}$ and $W_{12}$; $R_1$ and $R_{11}$ are each an aliphatic group or a non-metallic atom group necessary to form a condensed ring by bonding between $R_1$ and $W_3$ or $R_{11}$ and $W_{14}$; $L_1$ to $L_9$, and $L_{11}$ to $L_{15}$ each are independently a methine group; $X_1$ and $X_{11}$ each are an ion necessary to compensate for an intramolecular charge; 11 and 111 each an ion necessary to compensate for an intramolecular charge; k1 and k2 each are 0 or 1; p1 and p11 are each 0 or 1; q1 and q11 each are 1 or 2, provided that the sum of p1 and q1 and the sum of p11 and q11 each are respectively not more than 2.

Substituents will be further described. Thus, the substituent groups of the compounds represented by formulas (S1), (S2), (S1-1), (S2–1), (S3), and (S4) will be explained below.

The 5- or 6-membered condensed rings completed by an atomic group represented by $Z_1$ include a condensed cyclohexene ring, a condensed benzene ring, a condensed thiophene ring, a condensed pyridine ring, and a condensed naphthalene ring. Exemplary examples thereof include a benzoxazole ring, tetrahydrobenzoxazole ring, naphthooxazole ring, benzonephthooxazole ring, benzothiazole ring, tetrahydrobenzothiazole ring, naphthothiazole ring, benzonaphthothiazole ring; thienothiazole ring, thianaphthenothiazole ring, pyridothiazole ring, benzoselenazole ring, tetrahydrobenzoselenazole ring, naphthoselenazole ring, benzonaphthoselenazole ring, quinoline ring, 3,3-dialkylindolenine and 3,3-dialkylpyridopyrroline. Any substituent such as one represented by $W_1$ to $W_4$ described later can be substituted on the ring described above.

Examples of the aliphatic group represented by $R_1$, $R_{11}$, $R_{21}$, $R_{22}$, $R_{31}$, and $R_{32}$ include a branched or straight-chained alkyl group having 1 to 10 carbon atoms (e.g., methyl, ethyl, propyl, butyl, pentyl, i-pentyl, 2-ethyl-hexyl, octyl, decyl), an alkenyl group having 3 to 10 carbon atoms (e.g., 2-propenyl, 3-butenyl, 1-methyl-3-propenyl, 3-pentenyl, 1-methyl-3-butenyl, 4-hexenyl), and an aralkyl group having 7 to 10 carbon atoms (e.g., benzyl, phenethyl). These groups may further be substituted with a substituent, including groups such as a lower alkyl group (preferably having 1 to 5 carbon atoms, e.g., methyl, ethyl, propyl), a halogen atom (e.g., fluorine atom, chlorine atom, or bromine atom), a vinyl group, an aryl group (e.g., phenyl, p-tolyl, p-bromophenyl), trifluoromethyl, an alkoxyl group (e.g., methoxy, ethoxy, methoxyethoxy), an aryloxyl group (e.g., phenoxy, p-tolyloxy), cyano, a sulfonyl group (e.g., methanesulfonyl, trifluoromethansulfonyl), p-toluenesulfonyl), an alkoxycarbonyl group (e.g., ethoxycarbonyl, butoxycarbonyl), an amino group (e.g., amino, biscarboxymethylamino), an aryl group (e.g., phenyl, carboxyphenyl), a heterocyclic group (e.g., tetrahydrofurfuryl, 2-pyrrolidinone-1-yl), an acyl group (e.g., acetyl, benzoyl), an ureido group (e.g., ureido, 3-methylureido, 3-phenylureido), a thioureido group (e.g., thioureido, 3-methylthioureido), an alkylthio group (e.g., methylthio, ethylthio), an arylthio group (e.g., phenylthio), a heterocyclic-thio group (e.g., 2-thienythio, 3-thienylthio, 2-imidazolylthio), a carbonyloxy group (e.g., acetyloxy, propanoyloxy, benzoyloxy), an acylamino group (e.g., acetylamino, benzoylamino); and hydrophilic groups, such as a sulfo group, a carboxy group, a phosphono group, a sulfate group, hydroxy, mercapto, sulfino group, a carbamoyl group (e.g., carbamoyl, n-methylcarbamoyl, N,N-tetramethylene-carbamoyl), a sulfamoyl group (e.g., sulfamoyl, N,N-3-oxapentamethylenaminosulfonyl), a sulfonamido group (e.g., methanesulfonamido, butanesulfoneamido), a sulfonylamino-carbonyl group(e.g., methanesulfonylaminocarbonyl, ethanesulfonylaminocarbonyl), an acylaminosulfonyl group (e.g., acetoamidosulfonyl, methoxyacetoamidosulfonyl), an acylaminocarbonyl group (e.g., acetoamidocarbonyl, methoxyacetoamidocarbonyl), and a sulfinylaminocarbonyl group (e.g., methasulfinylaminocarbonyl, ethanesulfinylamino-carbonyl). Examples of aliphatic groups substituted by a hydrophilic group include carboxymethyl, carboxypentyl, 3-sulfatobutyl, 3-sulfopropyl, 2-hydroxy-3-sulfopropyl, 4-sulfobutyl, 5-sulfopentyl, 3-sulfopentyl, 3-sulfinobutyl, 3-phosphonopropyl, hydroxyethyl, N-methanesulfonylcarbamoyl-methyl, 2-carboxy-2-propenyl, o-sulfobenzyl, p-sulfobenzyl and p-carboxybenzyl.

The lower alkyl group represented by R include, for example, a straight-chained or branched one having 1 to 5 carbon atoms, such as methyl, ethyl, propyl, pentyl and isopropyl. The cycloalkyl group includes, e.g., cyclopropyl, cyclobutyl and cyclopentyl. The aralkyl group includes, e.g., benzyl, phenethyl, p-methoxyphenylmethyl and o-acetylaminophenylethyl; the lower alkoxy group includes one having 1 to 4 carbon atoms, including methoxy, ethoxy, propoxy and i-propoxy; the aryl group includes substituted or unsubstituted one, such as phenyl, 2-naphthyl, 1-naphthyl, o-tolyl, o-methoxyphenyl, m-chlorophenyl, m-bromophenyl, p-tolyl and p-ethoxyphenyl. These groups may be substituted by a substituent group, such as a phenyl group, a halogen atom (e.g., fluorine atom, chlorine atom, bromine atom, iodine atom), an alkoxy group or hydroxy.

The lower alkyl group represented by Ra or Rb are the same as defined in R.

The lower alkyl group represented by Rc, and Rd includes a straight-chained or branched one having 1 to 5 carbon atoms, such as methyl, ethyl, propyl, pentyl and isopropyl. The cycloalkyl group includes, e.g., cyclopropyl, cyclobutyl and cyclopentyl. The aralkyl group includes, e.g., benzyl, phenethyl, p-methoxyphenylmethyl and o-acetylaminophenyl-ethyl; the aryl group includes substituted or unsubstituted one, such as phenyl, 2-naphthyl, 1-naphthyl, o-tolyl, o-methoxyphenyl, m-chlorophenyl, m-bromophenyl, p-tolyl and p-ethoxyphenyl; and the heterocyclic group includes substituted or unsubstituted one, such as 2-furyl, 5-methyl-2-furyl, 2-thienyl, 2-imidazolyl, 2-methyl-1-imidazolyl, 4-phenyl-2-thiazolyl, 5-hydroxy-2-benzothiazolyl, 2-pyridyl and 1-pyrrolyl. These groups, as described above, may be substituted by a substituent group, such as a phenyl group, a halogen atom, an alkoxy group or hydroxy.

Examples of the substituent groups represented by $W_1$ to $W_4$, $W_{11}$ to $W_{14}$, $W_{21}$ to $W_{24}$, $W_{31}$ to $W_{34}$, $W_{41}$ to $W_{44}$ and $W_{51}$ to $W_{54}$ include an alkyl group (e.g., methyl, ethyl, butyl, I-butyl), an aryl group (including monocyclic and polycyclic ones such as phenyl and naphthyl), a heterocyclic group (e.g., thienyl, furyl, pyridyl, carbazolyl, pyrrolyl, indolyl), a halogen atom (e.g., fluorine atom, chlorine atom, bromine atom, iodine atom), a vinyl group, trifluoromethyl, an alkoxy group (e.g., methoxy, ethoxy, methoxyethoxy), an aryloxy group (e.g., phenoxy, p-tolyloxy), a sulfonyl group (e.g., methanesulfonyl, p-toluenesulfonyl), an alkoxycarbonyl group (e.g., ethoxycarbonyl, ethoxycarbonyl), an amino group (e.g., amino, biscarboxymethylamino), an acyl group (e.g., acetyl, benzoyl), an ureido group (e.g., ureido, 3-methylureido), a thioureido group (e.g., thioureido, 3-methylthioureido), an alkylthio group (e.g., methylthio, ethylthio), an alkenyl thio group, an arylthio group (e.g., phenylthio), hydroxy and styryl.

These groups may be substituted by the same substituent groups as described in the aliphatic group represented by $R_1$. Examples of substituted alkyl group include 2-methoxyethyl, 2-hydroxyethyl, 3-ethoxycarbonylpropyl, 2-carbamoylethyl, 2-methanesulfonylethyl, 3-methanesulfonylaminopropyl, benzyl, phenethyl, carboxymethyl, carboxymethyl, allyl, and 2-furylethyl. Examples of substituted aryl groups include p-carboxyphenyl, p-N,N-dimethylaminophenyl, p-morpholinophenyl, p-methoxyphenyl, 3,4-dimethoxyphenyl, 3,4-methylene-dioxyphenyl, 3-chlorophenyl, and p-nitrophenyl. Further, examples of substituted heterocyclic group include 5-chloro-2-pyridyl, 2-ethoxycarbonyl-2-pyridyl and 5-carbamoyl-2-pyridyl. $W_1$ and $W_2$, $W_3$ and $W_4$, $W_{11}$ and $W_{12}$, $W_{13}$ and $W_{14}$, $W_{21}$ and $W_{22}$, $W_{23}$ and $W_{24}$, $W_{31}$ and $W_{32}$, $W_{33}$ and $W_{34}$ each pair may combine to form a condensed ring, such as 5- or 6-membered saturated or unsaturated condensed carbon rings, which are further substituted by substituent groups as described in the aliphatic group.

Among the groups represented by $V_1$ to $V_9$, $V_{11}$ to $V_{13}$, $V_{21}$ to $V_{29}$, and $V_{31}$ to $V_{33}$, the halogen atom includes, e.g., a fluorine atom, chlorine atom, bromine atom and iodine atom; the amino group includes, e.g., amino, dimethylamino, diphenylamino, and methylphenylamino; the alkylthio group includes substituted and substituted ones, such as phenylthio or m-fluorphenylthio; the lower alkyl group includes straight-chained or branched one having five or less carbon atoms, such as methyl, ethyl, propyl, butyl, pentyl or isopropyl; the lower alkoxy group includes one having four or less carbon atoms, such as methoxy, ethoxy, propoxy, or iso-propoxy; the aryl group includes substituted and unsubstituted ones, such as phenyl, 2-naphthyl, 1-naphthyl, o-tolyl, o-methoxyphenyl, m-chlorophenyl, m-bromophenyl, p-tolyl, and p-ethoxy phenyl; the aryloxyl group includes substituted and unsubstituted ones, such as phenoxy, p-tolyloxy, and m-carboxyphenyloxy; and the heterocyclic group includes substituted or unsubstituted ones, such as 2-furyl, 5-methyl-2-furyl2-thienyl, 2-imidazolyl, 2-methyl-1-imidazolyl, 4-phenyl-2-thiazolyl, 5-hydroxy-2-benzothiazolyl, 2-pyridyl, and 1-pyrrolyl. These groups may further be substituted by a substituent group, such as a phenyl group, a halogen atom, alkoxy group, or hydroxy. $V_1$ and $V_3$, $V_2$ and $V_4$, $V_3$ and $V_5$, $V_4$ and $V_6$, $V_5$ and $V_7$, $V_6$ and $V_8$, $V_7$ and $V_9$, $V_{11}$ and $V_{13}$, $V_{21}$ and $V_{23}$, $V_{22}$ and $V_{24}$, $V_{23}$ and $V_{25}$, $V_{24}$ and $V_{26}$, $V_{25}$ and $V_{27}$, $V_{26}$ and $V_{28}$, $V_{27}$ and $V_{29}$, and $V_{31}$ and $V_{33}$ each pair may combine to form a 5- to 7-membered ring, such as a cyclopentene ring, cyclohexene ring, cycloheptene ring, and decalin ring, each of which may further be substituted by a lower alkyl group, lower alkoxy group or aryl group, as described in R.

The methylene group represented by $L_1$ to $L_9$, $L_{11}$ to $L_{15}$ are each a substituted or unsubstituted methylene group. Examples of the substituent group thereof include fluorine and chlorine atoms, a substituted or unsubstituted lower alkyl group(e.g., methyl, ethyl, I-propyl, benzyl), and a substituted or unsubstituted alkoxy group (e.g., methoxy, ethoxy), a substituted or unsubstituted aryloxy group (e.g., phenoxy, naphthoxy), a substituted or unsubstituted aryl group (e.g., phenyl, naphthyl, p-tolyl, o-carboxyphenyl), $N(U_1)$ $(U_2)$, -SRg, a substituted or unsubstituted heterocyclic group [e.g., 2-thienyl, 2-furyl, N,N'-bis(methoxyethyl)-barbituric acid], in which Rg is a lower alkyl group (preferably having 1 to 5 carbon atoms), an aryl group or a heterocyclic group and examples of -SRg include methylthio, ethylthio, benzylthio, phenylthio and tolylthio groups; $U_1$ and $U_2$ are each a substituted or unsubstituted lower alkyl group or aryl group, provided that $V_1$ and $V_2$ may combine to form a 5- or 6-membered nitrogen containing heterocyclic ring (e.g., pyrazole ring, pyrrol ring, pyrrolidine ring, morpholine ring, pyperizine ring, pyridine, pyrimidine ring, etc.). Two methylene groups which are adjacent or distant by one may combine to form a 5- or 6-membered ring.

In cases where the compound represented by formula (S1), (S1—1), (S2–1), (S3) or (S4) is substituted with a cationic- or anionic-charged group, a counter ion is formed by an anionic or cationic equivalent to compensate an intramolecular charge. As an ion necessary to compensate the intramolecular charge which is represented by $X_1$, $X_{11}$, $X_{21}$, or $X_{31}$, examples of cations include a proton, an organic ammonium ion (e.g., triethylammonium, triethanolammonium) and inorganic cations (e.g., cations of lithium, sodium and potassium); and examples of acid anions include halide ions (e.g., chloride ion, bromide ion, iodide ion), p-toluenesulfonate ion, perchlorate ion, tetrafluoroborate ion, sulfate ion, methylsulfate ion, ethylsulfate ion, methanesulfonate ion, trifluoromethanesulfonate ion).

The infrared sensitizing dye according to the invention is preferably a dye characterized in that a three ring-condensed heterocyclic nucleus is formed by bonding between a nitrogen atom contained in a benzothiazole ring and a carbon atom at a peri-position; or that the dye is a long chain polymethine dye, in which a sulfonyl group is substituted on the benzene ring of the benzothiazole ring.

Exemplary examples of the sensitizing dyes represented by formulas (S1), (S1-1), (S2–1), (S3) and (S4)are shown below, but are not limited to these.

No.S-1

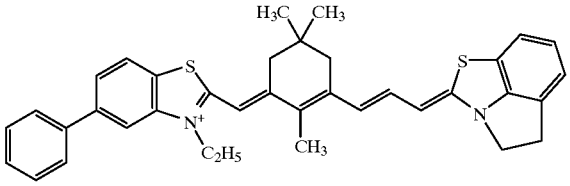

p-Ts⁻

No.S-2

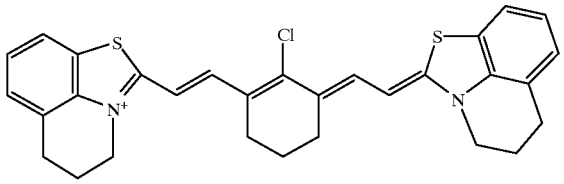

I⁻

No.S-3

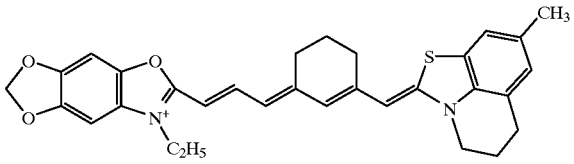

p-Ts⁻

No.S-4

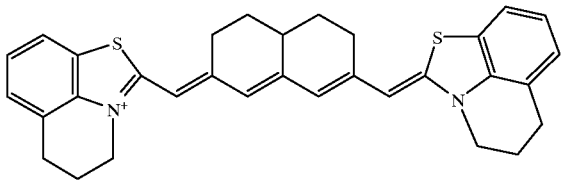

$BF_4^-$

-continued
No.S-5
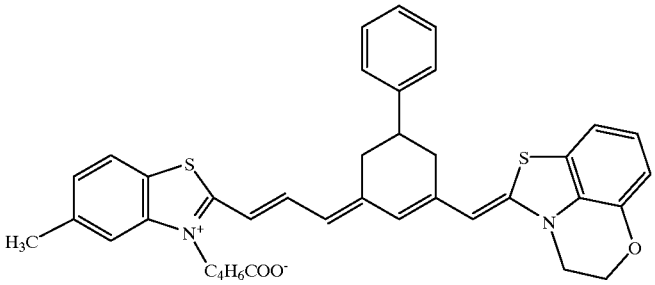
No.S-6
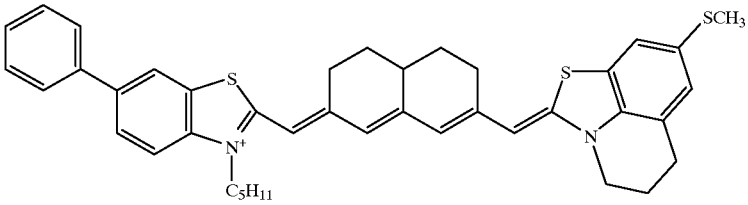
$p\text{-}Ts^-$
No.S-7
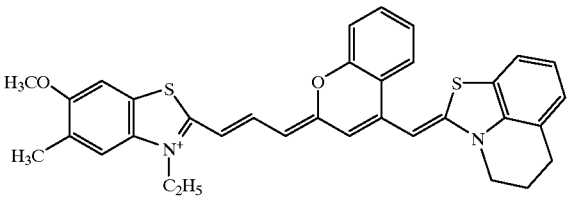
$BF_4^-$
No.S-8
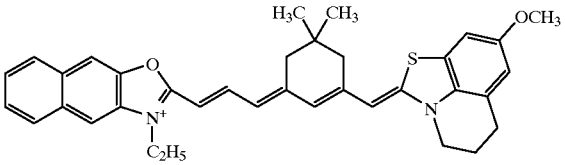
$BF_4^-$
No.S-9
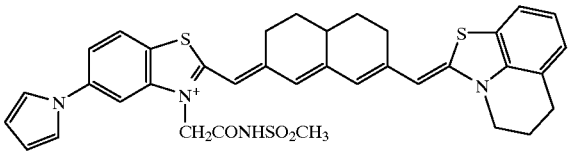
$p\text{-}Ts^-$
No.S-10
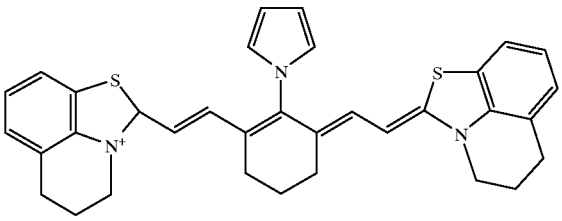
$BF_4^-$
No.S-11
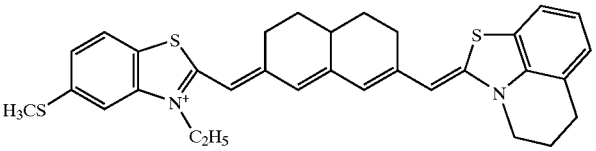
$BF_4^-$
No.S-12
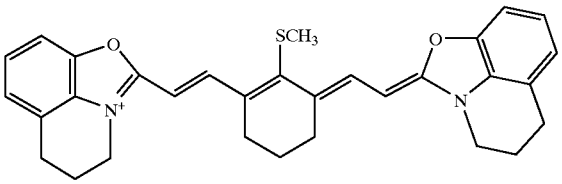
$BF_4^-$ -continued
No.S-13
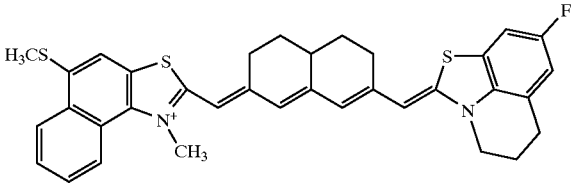
p-Ts⁻
No.S-14
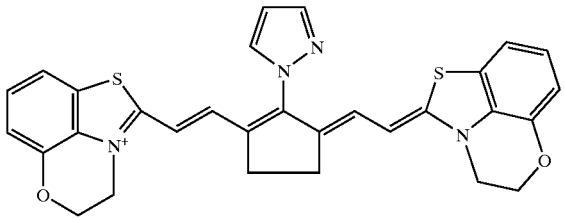
$BF_4^-$
No.S-15
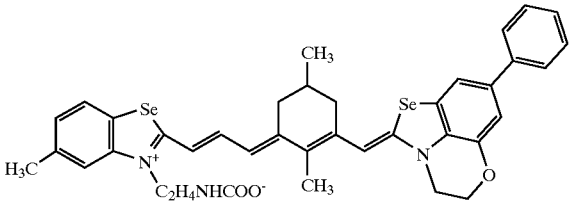
No.S-16
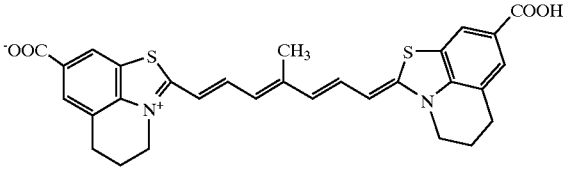
No.S-17
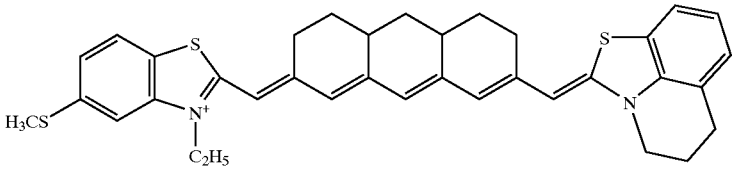
p-Ts⁻
No.S-18
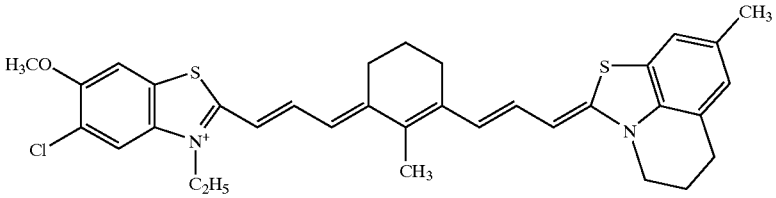
$BF_4^-$
No.S-19
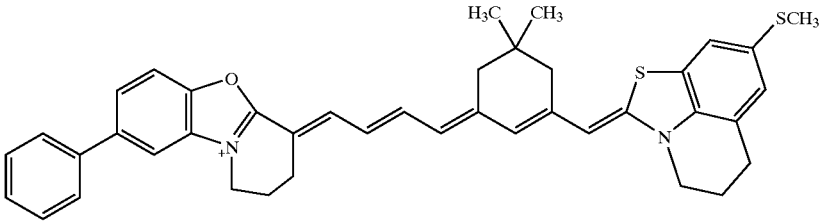
$BF_4^-$
No.S-20
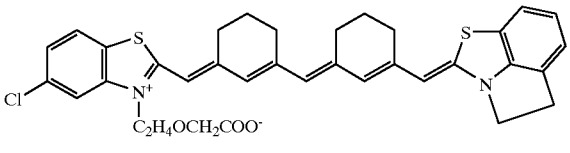
No.S-21
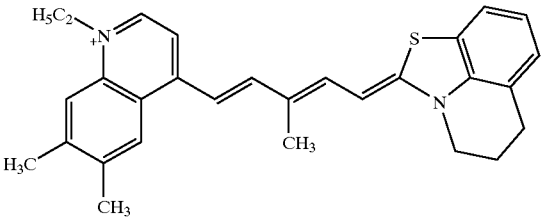
p-Ts⁻

-continued
No.S-22
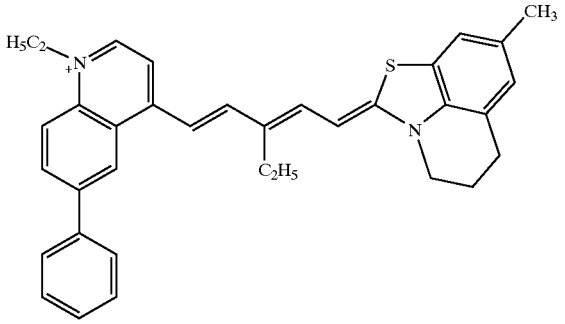
p-Ts⁻
No.S-23
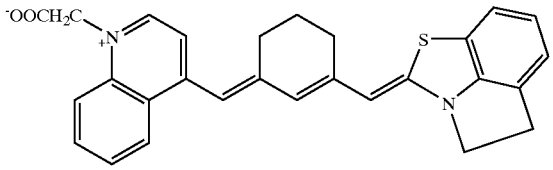
No.S-24
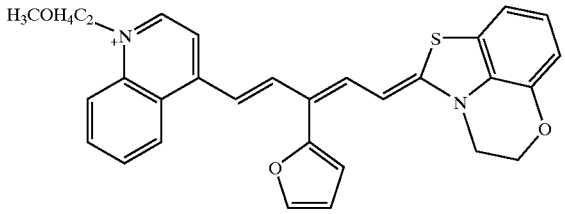
p-Ts⁻
No.S-25
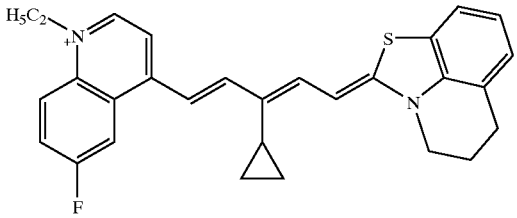
p-Ts⁻
No.S-26
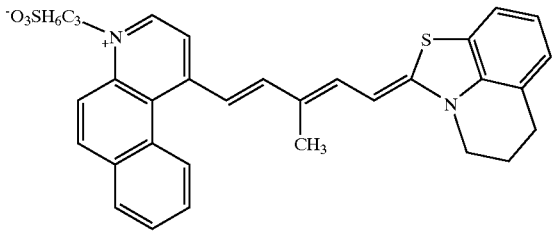
No.S-27
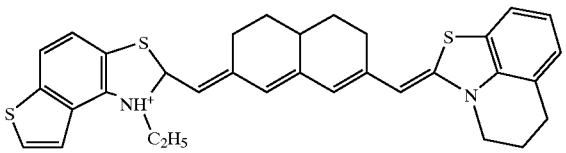
$BF_4^-$
No.S-28
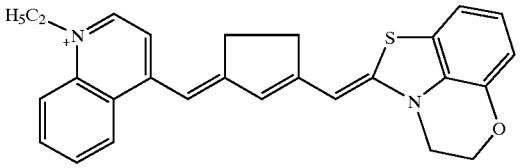
p-Ts⁻
No.S-29
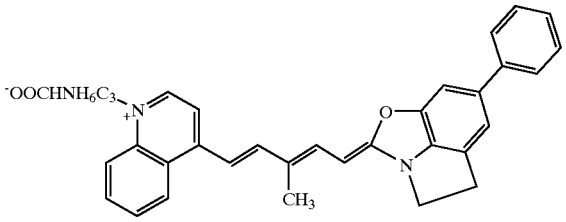
No.S-30
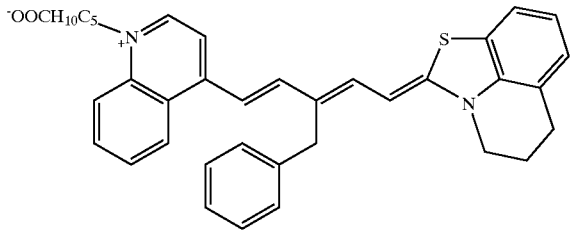
No.S-31
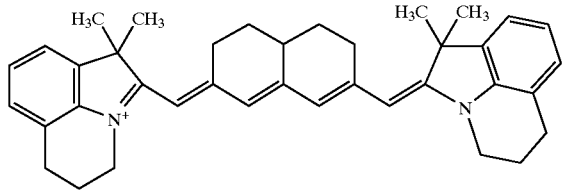
$BF_4^-$ -continued
No.S-32
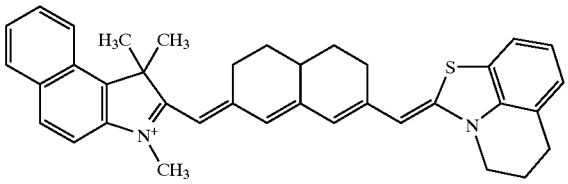
p-Ts⁻
No.S-33
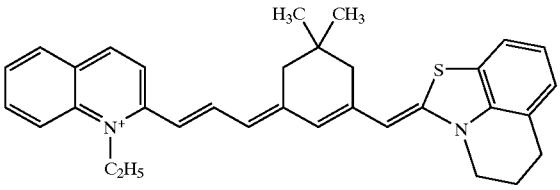
$C_2H_5OSO_3^-$
No.S-34
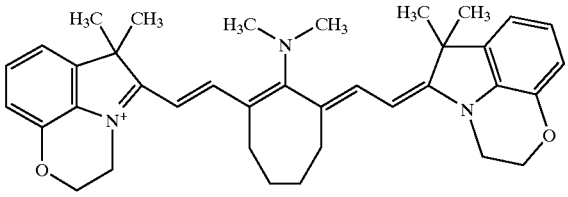
$PF_6^-$
No.S-35
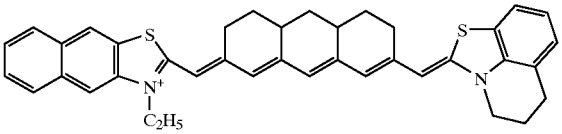
p-Ts⁻
No.S-36
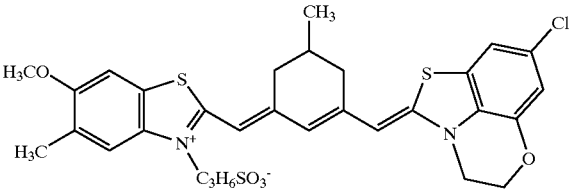
No.S-37
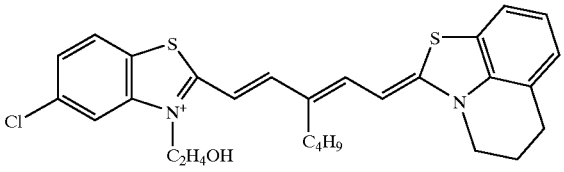
p-Ts⁻
No.S-38
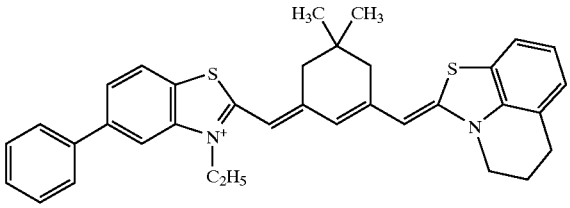
$BF_4^-$
No.S-39
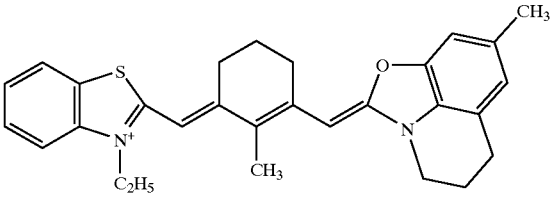
$BF_4^-$
No.S-40
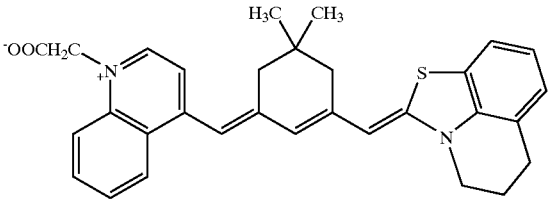
No.S-41
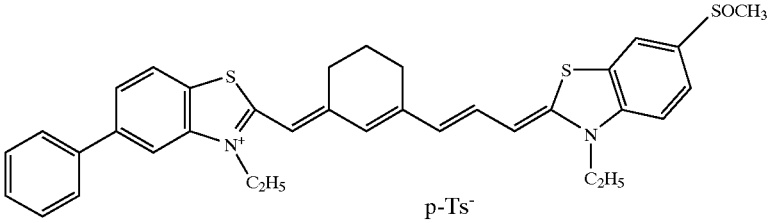
p-Ts⁻

-continued
No.S-42
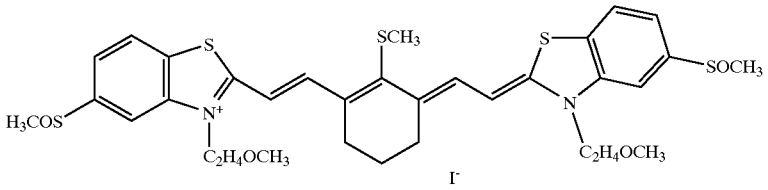
No.S-43
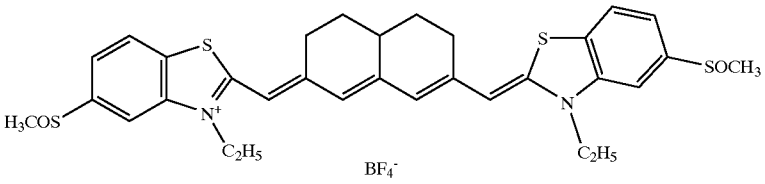
No.S-44
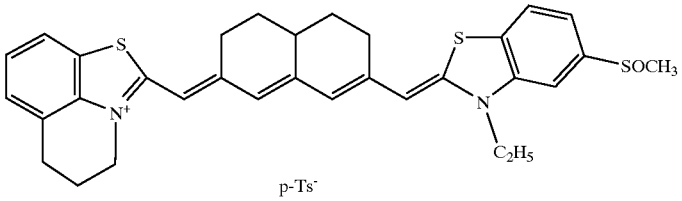
No.S-45
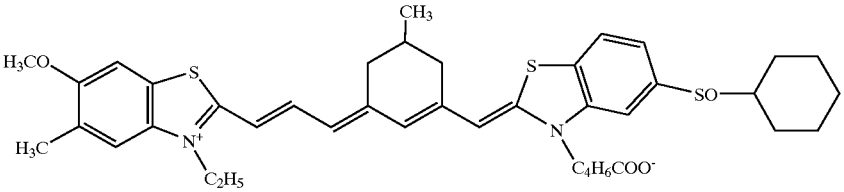
No.S-46
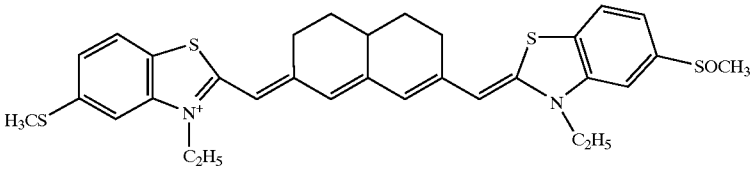
No.S-47
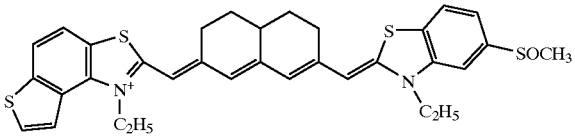
No.S-48
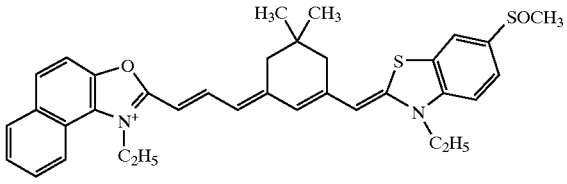
No.S-49
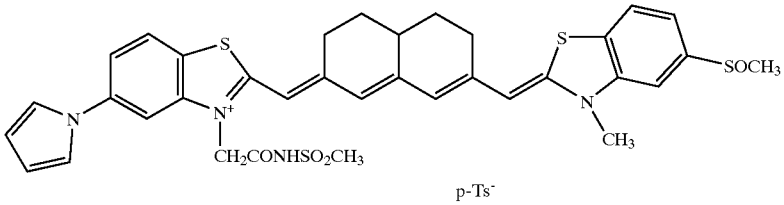

-continued
No.S-50
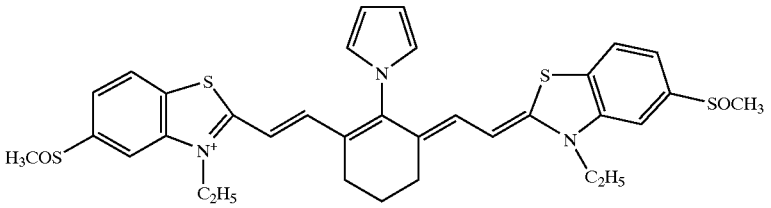
No.S-51
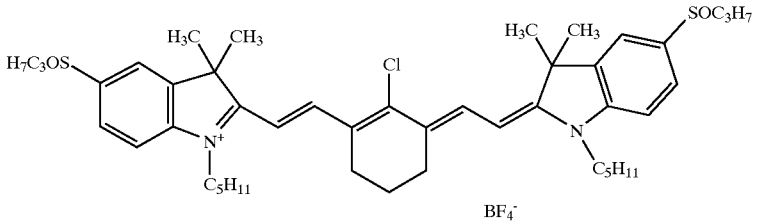
No.S-52
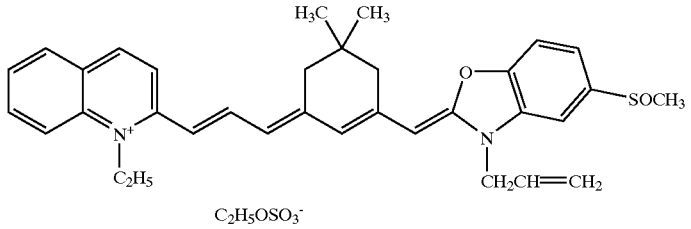
No.S-53
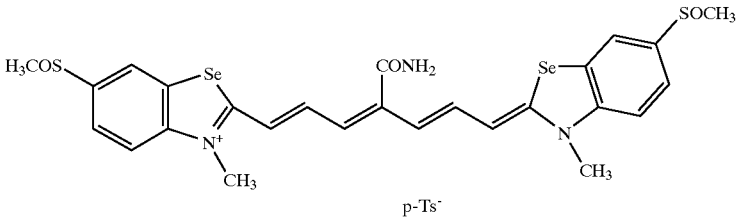
No.S-54
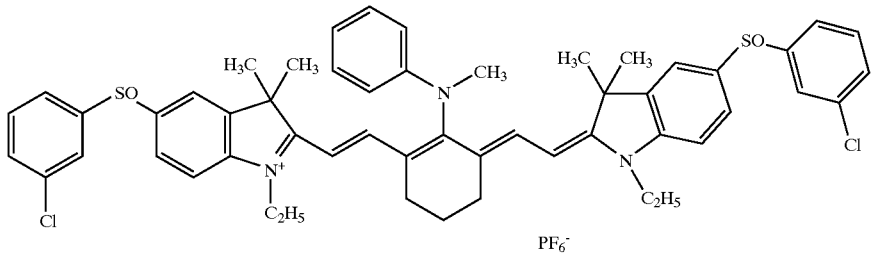
No.S-55
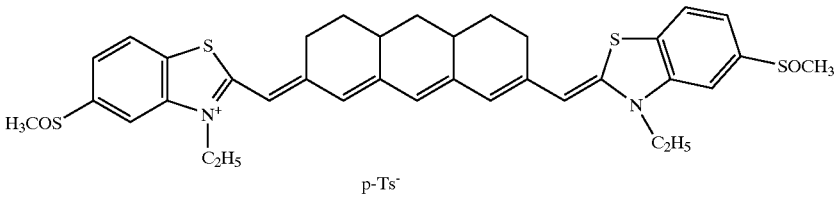

-continued
No.S-56
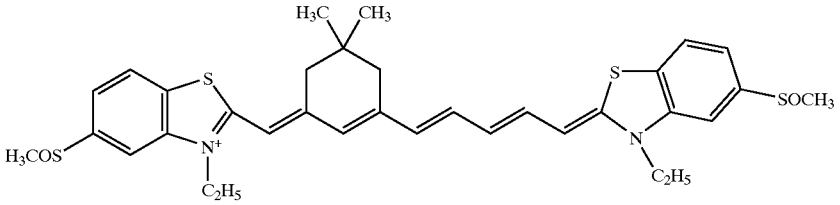
p-Ts⁻
No.S-57
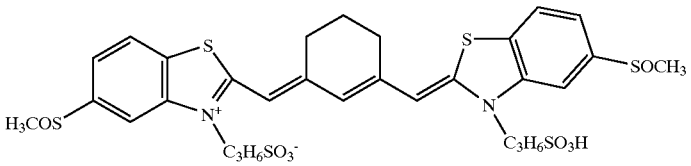
No.S-58
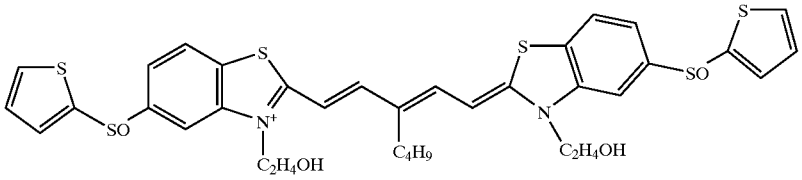
p-Ts⁻
No.S-59
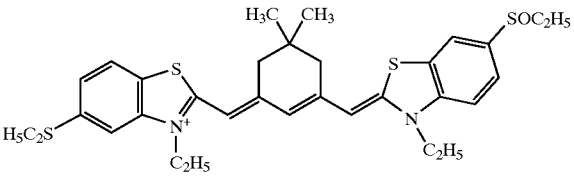
$BF_4^-$
No.S-60
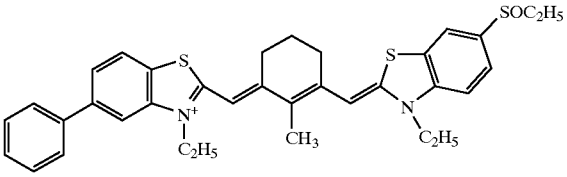
$BF_4^-$
No.S-61
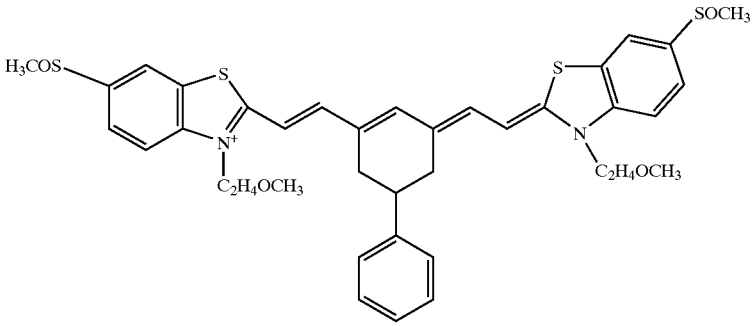
$PF_6^-$
No.S-62
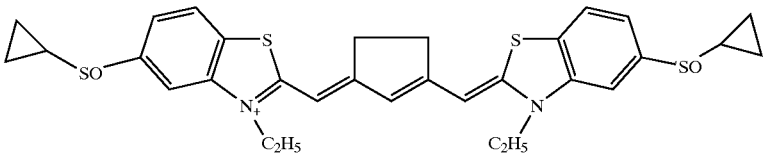
p-Ts⁻

-continued
No.S-63
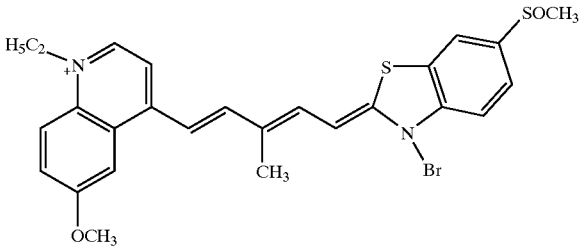
p-Ts⁻
No.S-64
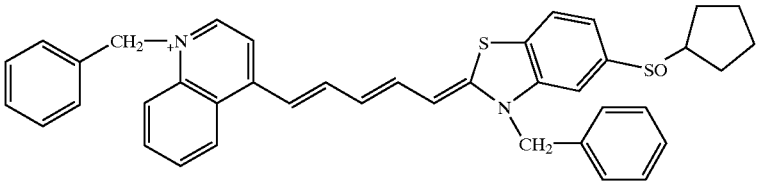
p-Ts⁻
No.S-65
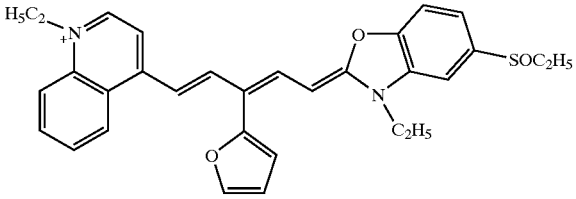
p-Ts⁻
No.S-66
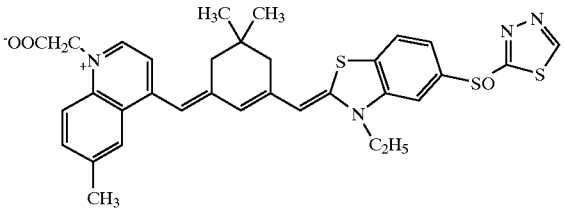
No.S-67
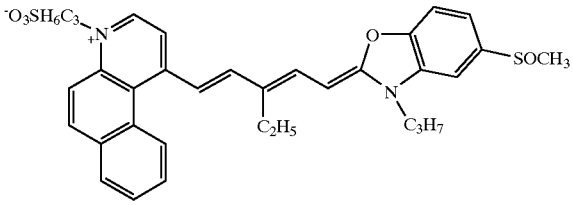
No.S-68
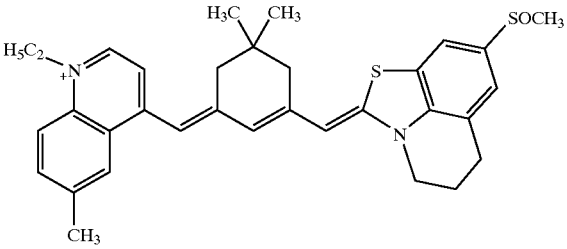
p-Ts⁻
No.S-69
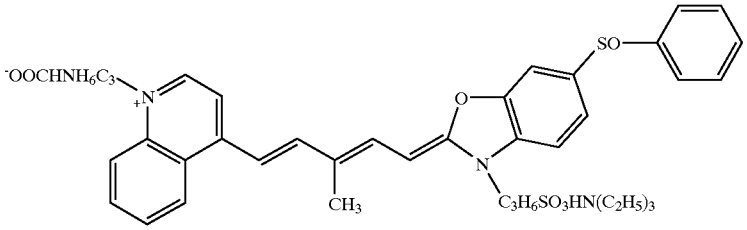
No.S-70
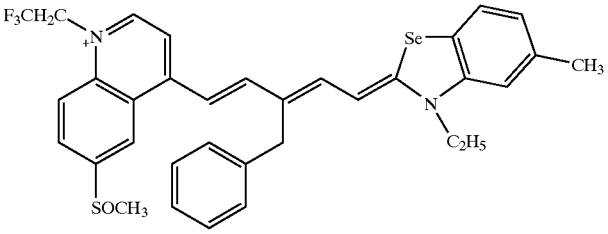
$CF_3SO_3^-$ The infrared sensitizing dyes and spectral sensitizing dyes described above can be readily synthesized according to the methods described in F. M. Hammer, The Chemistry of Heterocyclic Compounds vol.18, "The cyanine Dyes and Related Compounds" (A. Weissberger ed. Interscience Corp., New York, 1964).

These sensitizing dyes may be used alone or in combination thereof. The combined use of sensitizing dyes is often employed for the purpose of supersensitization. A supersensitizing compound, such as a dye which does not exhibit spectral sensitization or substance which does not substantially absorb visible light may be incorporated, in combination with a sensitizing dye, into the emulsion.

In cases when being super-sensitized, and specifically when a reducing agent is not deactivated, photosensitivity is enhanced, print-out is easily promoted after development. In such a case, the present invention is effective. In cases when being infrared-sensitized, an infrared sensitizing dye has an oxidation-reduction potential at which a silver halide or an organic silver salt is slightly reducible, easily producing a silver cluster forming fog silver in the presence of the reducing agent, even when placed in a dark room. The produced silver cluster also induces fogging as a catalyst nucleus, deteriorating storage stability in the dark room or promoting print-out when placed in a daylight room after development. Further, sensitivity of the infrared sensitive material extends to the thermal radiation region outside the visible region so that the present invention is effective for inhibiting print-out silver produced by thermal radiation. Such a effect is marked in infrared-sensitized photosensitive materials which is sensitized with a supersensitizer. Useful sensitizing dyes, dye combinations exhibiting supersensitization and materials exhibiting supersensitization are described in RD17643 (published in December, 1978), IV-J at page 23, JP-B 9-25500 and 43-4933 (herein, the term, JP-B means published Japanese Patent) and JP-A 59-19032, 59-192242 and 5-341432.

In the invention, an aromatic heterocyclic mercapto compound represented by the following formula (6) is preferred as a supersensitizer:

Formula (6)

Ar-SM wherein M is a hydrogen atom or an alkali metal atom; Ar is an aromatic ring or condensed aromatic ring containing a nitrogen atom, oxygen atom, sulfur atom, selenium atom or tellurium atom. Such aromatic heterocyclic rings are preferably benzimidazole, naphthoimidazole, benzothiazole, naphthothiazole, benzoxazole, naphthooxazole, benzoselenazole, benzotellurazole, imidazole, oxazole, pyrazole, triazole, triazines, pyrimidine, pyridazine, pyrazine, pyridine, purine, and quinoline. Other aromatic heterocyclic rings may also be included.

A disulfide compound which is capable of forming a mercapto compound when incorporated into a dispersion of an organic silver salt and/or a silver halide grain emulsion is also included in the invention. In particular, a preferred example thereof is a disulfide compound represented by the following formula:

Formula (7)

Ar-S-S-Ar wherein Ar is the same as defined in formula (6). The aromatic heterocyclic rings described above may be substituted with a halogen atom (e.g., Cl, Br, I), a hydroxy group, an amino group, a carboxy group, an alkyl group (having one or more carbon atoms, and preferably 1 to 4 carbon atoms) or an alkoxy group (having one or more carbon atoms, and preferably 1 to 4 carbon atoms).

Exemplary examples of mercapto-substituted aromatic heterocyclic compound are shown below but are not limited to these.

| | |
|---|---|
| M-1: | 2-mercaptobenzimidazole |
| M-2: | 2-mercaptobenzoxazole |
| M-3: | 2-mercaptobenzthiazole |
| M-4: | 5-methyl-2-mercaptobenzimidazole |
| M-5: | 6-ethoxy-2-mercaptobenzthiazole |
| M-6: | 2,2'-dithiobis(benzthiazole) |
| M-7: | 3-mercapto-1,2,4-triazole |
| M-8: | 4,5-diphenyl-2-imidazole |
| M-9: | 2-mercaptoimidazole |
| M-10: | 1-ethyl-2-mercaptobenzimidazole |
| M-11: | 2-mercaptoquinoline |
| M-12: | 8-mercaptopurine |
| M-13: | 2-mercapto-4(3H)-quinazoline |
| M-14: | 7-trifluoromethyl-4-quinolinethiol |
| M-15: | 2,3,5,6-tetrachloro-4-pyridinethiol |
| M-16: | 4-amino-6-hydroxy-2-mercaptopyridine monohydrate |
| M-17: | 2-amino-5-mercapto-1,3,4-thiazole |
| M-18: | 3-amino-5-mercapto-1,2,4-triazole |
| M-19: | 4-hydroxy-2-mercaptopyridine |
| M-20: | 2-mercaptopyridine |
| M-21: | 4,6-diamino-2-mercaptopyridine |
| M-22: | 2-mercapto-4-methylpyrimidine hydrochloride |
| M-23: | 3-mercapto-5-phenyl-1,2,4-riazole |
| M-24: | 2-mercapto-4-phenyloxazole |

The supersensitizer compound usable in the invention is incorporated into an emulsion layer containing the organic silver salt and silver halide grains, preferably in an amount of 0.001 to 1.0 mol, and more preferably 0.01 to 0.5 mo per mol of silver.

Binders suitable for the photothermographic materials used in the present invention are transparent or translucent, and generally colorless. Binders are natural polymers, synthetic resins, and polymers and copolymers, other film forming media; for example, gelatin, gum arabic, poly(vinyl alcohol), hydroxyethyl cellulose, cellulose acetate, cellulose acetatebutylate, poly(vinylpyrrolidone), casein, starch, poly (acrylic acid), poly(methylmethacrylic acid), poly(vinyl chloride), poly(methacrylic acid), copoly(styrene-maleic acid anhydride), copoly(styrene-acrylonitrile), copoly (styrene-butadiene), poly(vinyl acetal) series (for example, poly(vinyl formal)and poly(vinyl butyral), poly(ester) series, poly(urethane) series, phenoxy resins, poly (vinylidene chloride), poly(epoxide) series, poly(carbonate) series, poly(vinyl acetate) series, cellulose esters, poly (amide) series. These may be hydrophilic or hydrophobic polymers. Of these, as a binder preferable for the thermally developable light sensitive layer is polyvinyl acetals and more preferably polyvinyl butyral. Cellulose esters exhibiting higher softening temperature, such as triacetyl cellulose or cellulose acetatebutylate are preferred for non-light sensitive layers such as an over-coat layer or sub-coat layer, specifically, a protective layer or backing layer. These binders may be used in combination. The binder is used with a range effective to function as a binder. The effective range can optimally be determined by one skilled in the art. As a measure to hold at least an organic silver salt, a ratio of a binder to an organic silver salt, based on weight is preferably within a range of 15:1 to 1:2, more preferably 8:1 to 1:1. The amount of a binder in a light sensitive layer is preferably 1.5 to 6 g/m$^2$, and more preferably 1.7 to 5 g/m$^2$. The amount of less than 1.5 g/m$^2$ results in an increase density of an unexposed area to levels unacceptable to practical use.

Inclusion of a cross-linking agent is specifically effective in the invention. Although the mechanism has not been elucidated, it was proved that the combined use of the cross-linking agent and the labile species-generating compound used relating to the invention gave advantageous effects on storage stability on the dark room and production of print-out silver under daylight. Although it is commonly known that the use of a cross-linking agent in such a binder as described above improves layer adhesion and lessens unevenness in development, it is unexpected that the use of the crosslinking agent in combination with the labile species-generating compound was effective in fog inhibition during storage and prevention of print-out after development.

Crosslinking agents usable in the invention include various commonly known crosslinking agents used for photographic materials, such as aldehyde type, epoxy type, vinylsulfon type, sulfonester type, acryloyl type, carbodiimide type crosslinking agents, as described in JP-A 50-96216.

Specifically preferred are an isocyanate type compound, epoxy compound and acid anhydride, as shown below. One of the preferred crosslinking agents is an isocyanate or thioisicyanate compound represented by the following formula:

Formula (8)

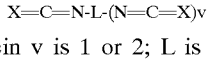

X=C=N-L-(N=C=X)v wherein v is 1 or 2; L is a bivalent linkage group of an alkylene, alkenylene, arylene or alkylarylene group; and X is an oxygen atom or a sulfur atom. An arylene ring of the arylene group may be substituted. Preferred substituent groups include a halogen atom (e.g., bromine atom, chlorine atom), hydroxy, amino, carboxy, alkyl and alkoxy.

The isocyanate crosslinking agent is an isocyanate compound containing at least two isocyanate group and its adduct. Examples thereof include aliphatic isocyanates, alicyclic isocyanates, benzeneisocyanates, naphthalenediisocyanates, biphenyldiisocyanates, diphenylmethandiisocyanates, triphenylmethanediisocyanates, triisocyanates, tetraisocyanates, their adducts and adducts of these isocyanates and bivalent or trivalent polyhydric alcohols. Exemplary examples are isocyanate compounds described in JP-A 56-5535 at pages 10–12, including: ethanediisocyanate, butanediisocyanate, hexanediisocyanate, 2,2-dimetylpentanediisocyanate, 2,2,4-trimethylpentanediisocyanate, decanediisocyanate, ω,ω'-diisocyanate-1,3-dimethylbenzol, ω,ω'-diisocyanate-1,2-dimethylcyclohexanediisocyanate, ω,ω'-diisocyanate-1,4-diethylbenzol, ω,ω'-diisocyanate-1,5-dimethylnaphthalene, ω,ω'-diisocyanate-n-propypbiphenyl, 1,3-phenylenediisocyanate, 1-methylbenzol-2,4-diisocyanate, 1,3-dimethylbenzol-2,6-diisocyanate, naphthalene-1,4-diisocyanate, 1,1'-naphthyl-2,2'-diisocyanate, biphenyl-2,4'-diisocyanate, 3,3'-dimethylbiphenyl-4,4'-diisocyanate, diphenylmethane-4,4'-diisocyanate, 2,2'-dimethyldiphenylmethane-4,4'-diisocyanate, 3,3'-dimethoxydiphenylmethane-4,4'-diisocyanate, 4,4'-diethoxydiphenylmethane-4,4'-diisocyanate, 1-methylbenzol-2,4,6-triisocyanate, 1,3,5-trimethylbenzene-2,4,6-triisocyanate, diphenylmethane-2,4,4'-triisocyanate, triphenylmethane-4,4',4'-triisocyanate, tolylenediisocyanate, 1,5-naphthylenediisocyanate; dimmer or trimer adducts of these isocyanate compounds (e.g., adduct of 2-mole hexamethylenediisocyanate, adduct of 3 mole hexamethylenediisicyanate, adduct of 2 mole 2,4-tolylenediisocyanate, adduct of 3 mole 2,4-tolylenediisocyanate); adducts of two different isocyanates selected from these isocyanate compounds described above; and adducts of these isocyanate compounds and bivalent or trivalent polyhydric alcohol (preferably having upto 20 carbon atoms, such as ethylene glycol, propylene glycol, pinacol, and trimethylol propane), such as adduct of tolylenediisocyanate and trimethylolpropane, or adduct of hexamethylenediisocyanate and trimethylolpropane. Of these, adduct of isocyanate and polyhydric alcohol improves adhesion between layers, exhibiting high capability of preventing layer peeling, image slippage or production of bubbles. These polyisocyanate compounds may be incorporated into any portion of the photothermographic material, for example, into the interior of a support (e.g., into size of a paper support) or any layer on the light sensitive layer-side of the support, such as a light sensitive layer, surface protective layer, interlayer, antihalation layer or sublayer. Thus it may be incorporated into one or plurality of these layers.

The thiosocyanate type crosslinking agent usable in the invention is a compound having a thioisocyanate structure, corresponding to the isocyanates described above.

The crosslinking agents described above are used preferably in an amount of 0.001 to 2 mol, and more preferably 0.005 to 0.5 mol of silver.

The isocyanate compounds and thioisocyanate compounds used in the invention are preferably those which are capable of functioning as a hardener. Even when "v" of formula (8) is zero, i.e., even a compound containing only one functional group provides favorred effects. Exemplary examples thereof are shown below but are not limited to these.

1 $C_8H_{17}NCO$

2 $C_{12}H_{25}NCO$

3

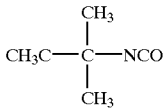

4

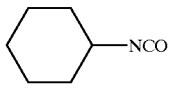

5

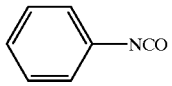

6

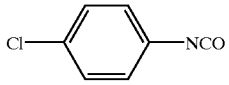

7

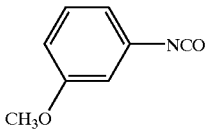

-continued

8

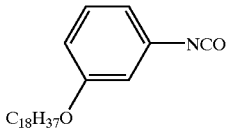

9

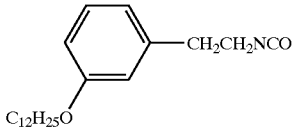

10

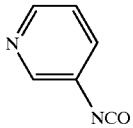

11

$C_8H_{17}NCS$

12

$C_{12}H_{25}NCS$

13

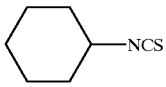

14

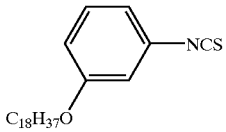

15

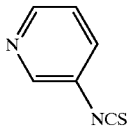

16

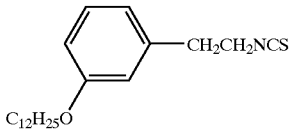

17

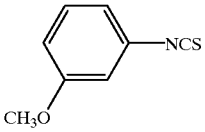

18

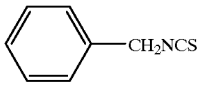

-continued

19

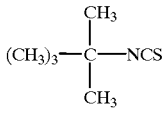

20

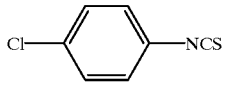

21

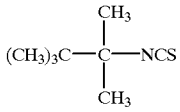

22

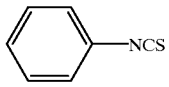

23

$SCNHCH_2CH_2NCS$

Further, preferred cross-linking agent is an epoxy compound containing at least an epoxy group and represented by the formula described below, or an acid anhydride.

The epoxy compound usable in the invention may be any one containing at least one epoxy group and is not limited with respect to the number of the epoxy group, molecular weight and other parameters. The epoxy group is preferably contained in the form of a glycidyl group through an ether bond or an imino bond in the molecule. The epoxy compound may be any one of a monomer, oligomer and polymer, in which the number of the epoxy group in the molecule is preferably 1 to 10 and more preferably 2 to 4. In cases where the epoxy compound is a polymer, it may be either one of a homopolymer and a copolymer. The number-averaged molecular weight (Mn) thereof is preferably 2,000 to 20,000. The epoxy compound used in the invention is preferably a compound represented by the following formula (9):

Formula (9)

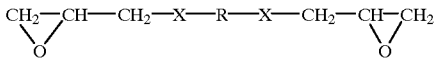

wherein an alkylene group or arylene group represented by R in formula (9) may be substituted by a substituent selected from a halogen atom, a hydroxyalkyl group and an amino group; R in formula (9) preferably contains an amido-linkage, ether linkage or thioether linkage; a bivalent linkage group represented by X is preferably —$SO_2$—, —$SO_2NH$—, —S—, —O— or —NR'—, in which R' is a univalent linkage group and preferably an electron-withdrawing group.

Exemplary examples of the epoxy compound are shown below but are not limited to these.

EP-1
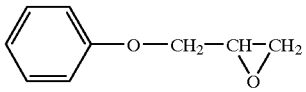
EP-2
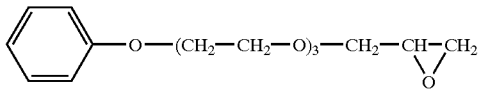
EP-3
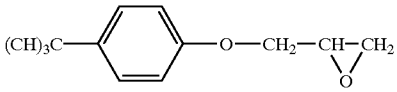
EP-4
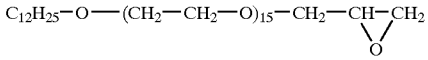
EP-5
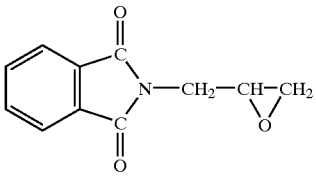
EP-6
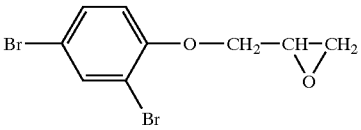
EP-7
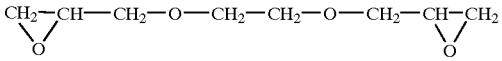
EP-8
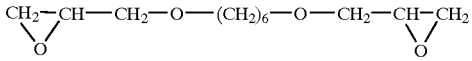
EP-9
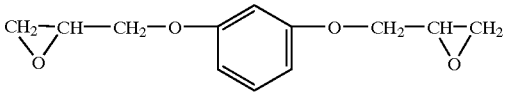
EP-10
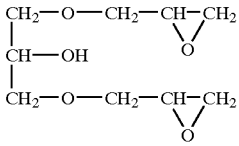
EP-11
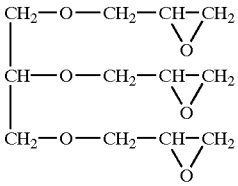
EP-12
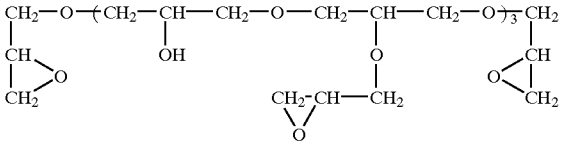
EP-13
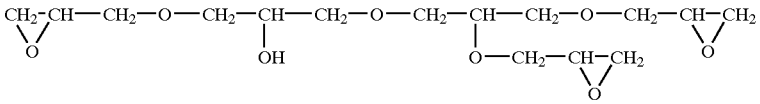
EP-14
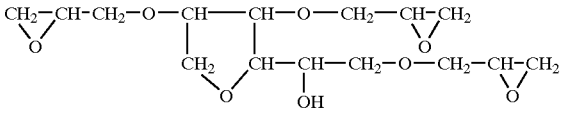
EP-15
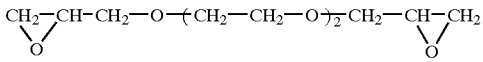
EP-16
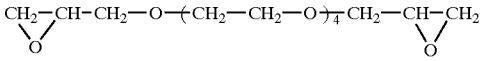
EP-17
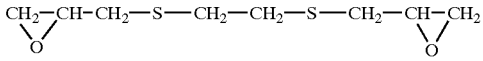
EP-18
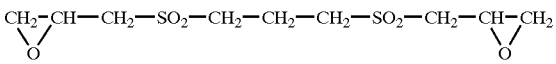
EP-19
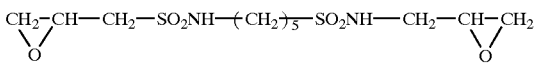
EP-20
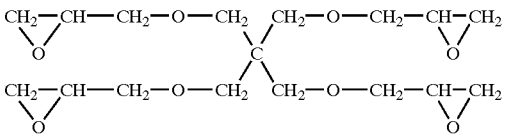

-continued

EP-21

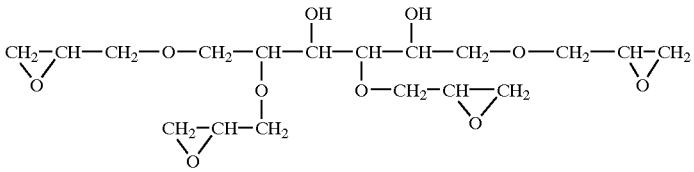

EP-22

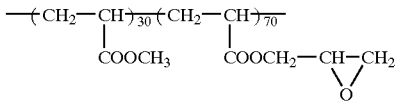

(Mn = 10000)

EP-23

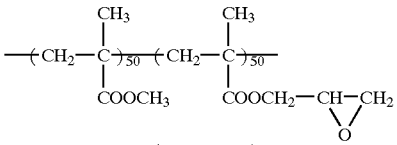

(Mn = 12000)

EP-24

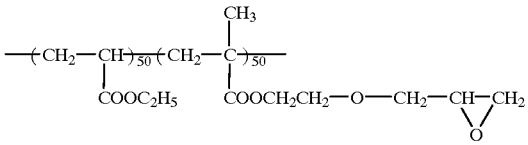

(Mn = 20000)

The epoxy compound may be used alone or combination thereof. The amount to be added is not specifically limited, but preferably $1\times10^{-6}$ to $1\times10^{-2}$ mol/m$^2$, and more preferably $1\times10^{-5}$ to $1\times10^{-3}$ mol/m$^2$. The epoxy compound may be added to any layer of a light sensitive layer, surface protective layer, interlayer, anti-halation layer and subbing layer provided on the light sensitive layer-side of the support and may be added to one or plurality of these layers. Further, it may be added to a layer provided on the opposite side of the support, in combination with the light sensitive layer-side. In the case of a photothermographic material having light sensitive layers on both sides of the support, it may be added to any one of the layers.

The acid anhydride used in the invention is preferably a compound containing at least an acid anhydride group represented as below:

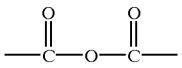

The acid anhydride usable in the invention may be any compound containing one or more acid anhydride group, the number of the acid anhydride group, molecular weight or other parameters are not specifically limited, and a compound represented by the following formula (B) is preferred:

Formula (B)

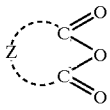

wherein Z is an atomic group necessary to form a monocyclic or polycyclic ring, which may be substituted. Examples of substituent include an alkyl group (e.g., methyl, ethyl, hexyl), an alkoxyl group (e.g., methoxy, ethoxy, octyloxy), an aryl group (e.g., phenyl, naphthyl, tolyl), hydroxy group, an aryloxy group (e.g., phenoxy), an alkylthio group (e.g., methylthio, butylthio), an arylthio group (e.g., phenylthio), an acyl group (e.g., acetyl, propionyl, butylyl), a sulfonyl group (e.g., methylsulfonyl, phenylsulfonyl), an acylamino group, a sulfonylamino group, an acyloxy group (e.g., acetoxy, benzoxy), carboxy group, cyano group, sulfo group and an amino group. It is preferred not to contain a halogen atom as a substituent.

Exemplary examples of the acid anhydride compound are shown below but are not limited to these.

B-1

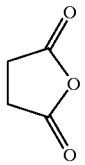

B-2

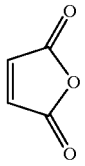

B-3

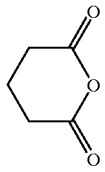

B-4

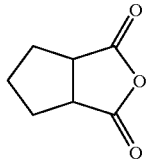

-continued

B-5

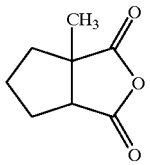

B-6

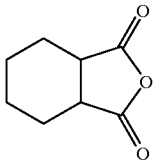

B-7

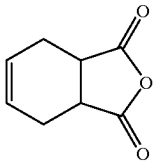

B-8

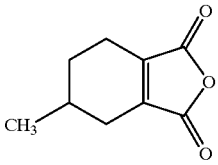

B-9

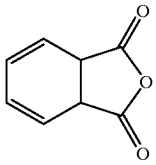

B-10

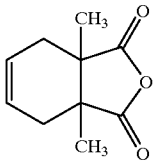

B-11

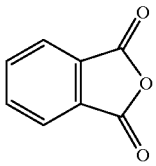

B-12

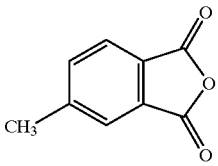

B-13

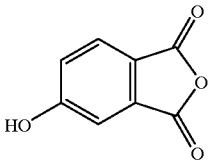

-continued

B-14

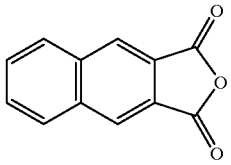

B-15

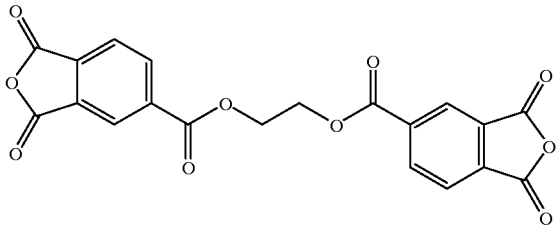

B-16

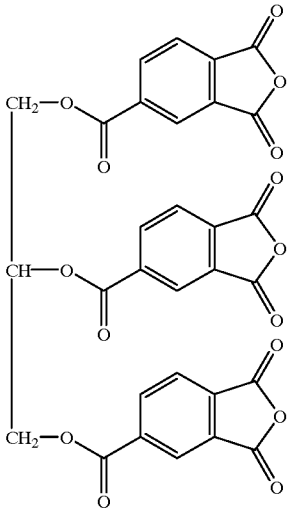

B-17

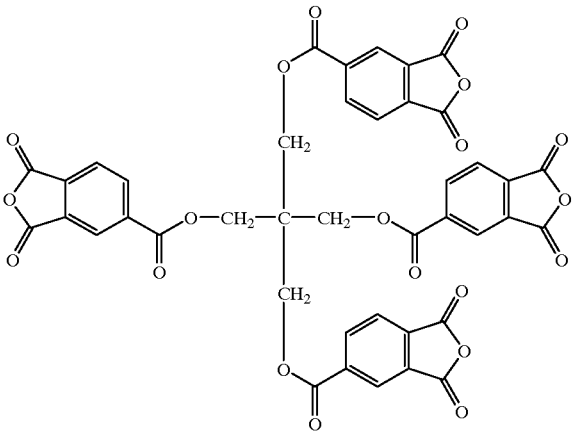

The acid anhydride compound may be used alone or combination thereof. The amount to be added is not specifically limited, but preferably $1\times10^{-6}$ to $1\times10^{-1}$ mol/m$^2$, and more preferably $1\times10^{-4}$ to $1\times10^{-2}$ mol/m$^2$. The acid anhydride compound may be added to any layer of a light sensitive layer, surface protective layer, interlayer, antihalation layer and subbing layer provided on the light sensitive layer-side of the support and may be added to one or plurality of these layers. Further, it may be added to a layer provided on the opposite side of the support, in combination with the light sensitive layer-side. In the case of a photothermographic material having light sensitive layers on both sides of the support, it may be added to any one of the layers.

Organic silver salts used in the invention are reducible silver source, and silver salts of organic acids or organic heteroacids are preferred and silver salts of long chain fatty acid (preferably having 10 to 30 carbon atom and more preferably 15 to 25 carbon atoms) or nitrogen containing heterocyclic compounds are more preferred. Specifically, organic or inorganic complexes, ligand of which have a total stability constant to a silver ion of 4.0 to 10.0 are preferred. Exemplary preferred complex salts are described in RD17029 and RD29963, including organic acid salts (for example, salts of gallic acid, oxalic acid, behenic acid, stearic acid, palmitic acid, lauric acid, etc.); carboxyalkylthiourea salts (for example, 1-(3-carboxypropyl)thiourea, 1-(3-caroxypropyl)-3,3-dimethylthiourea, etc.); silver complexes of polymer reaction products of aldehyde with hydroxy-substituted aromatic carboxylic acid (for example, aldehydes (formaldehyde, acetaldehyde, butylaldehyde, etc.), hydroxy-substituted acids (for example, salicylic acid, benzoic acid, 3,5-dihydroxybenzoic acid, 5,5-thiodisalicylic acid, silver salts or complexes of thiones (for example, 3-(2-carboxyethyl)-4-hydroxymethyl-4-(thiazoline-2-thione and 3-carboxymethyl-4-thiazoline-2-thione), complexes of silver with nitrogen acid selected from imidazole, pyrazole, urazole, 1,2,4-thiazole, and 1H-tetrazole, 3-amino-5-benzylthio-1,2,4-triazole and benztriazole or salts thereof; silver salts of saccharin, 5-chlorosalicylaldoxime, etc.; and silver salts of mercaptides. Of these organic silver salts, silver salts of fatty acids are preferred, and silver salts of behenic acid, arachidic acid and stearic acid are specifically preferred.

The organic silver salt compound can be obtained by mixing an aqueous-soluble silver compound with a compound capable of forming a complex. Normal precipitation, reverse precipitation, double jet precipitation and controlled double jet precipitation described in JP-A 9-127643 are preferably employed. For example, to an organic acid is added an alkali metal hydroxide (e.g., sodium hydroxide, potassium hydroxide, etc.) to form an alkali metal salt soap of the organic acid (e.g., sodium behenate, sodium arachidate, etc.), thereafter, the soap and silver nitrate are mixed by the controlled double jet method to form organic silver salt crystals. In this case, silver halide grains may be concurrently present.

In the present invention, organic silver salts have an average grain diameter of 10 μm or less and are monodisperse. The average diameter of the organic silver salt as described herein is, when the grain of the organic salt is, for example, a spherical, cylindrical, or tabular grain, a diameter of the sphere having the same volume as each of these grains. The average grain diameter is preferably between 0.05 and 10 μm, more preferably between 0.05 and 5 μm and still more preferably between 0.05 and 0.5 μm. Furthermore, the organic silver salt is preferably comprised of tabular grains.

Further, organic silver salts relating to this invention will be detailed with respect to preferred conditions. Thus, organic silver salts preferably comprise tabular grains which are preferably tabular grains exhibiting an aspect ratio of not less than 3, and to make smaller anisotropy in shape of two parallel opposite faces having a maximum area (also denoted as major faces) to achieve closer packing in the light sensitive layer, the tabular grains exhibit an average value of a needle ratio of not less than 1.1 and less than 10.0, and preferably not less than 1.1 and less than 5.0, which can be measured from the direction of the major face.

In this invention, the expression "comprise tabular grains exhibiting an aspect ratio of not less than 3" means that the tabular grains account for at least 50% by number of the total organic silver salt grains. It is more preferred that the organic silver salt comprises tabular grains accounting for at least 60% by number of the total organic silver salt grains, still more preferably at least 70% and most preferably at least 80% by number.

The tabular organic silver salt grain having an aspect ratio of not less than 3 refers to an organic salt grain exhibiting a ratio of grain diameter to grain thickness, being a so-called aspect ratio (also denoted as AR) of 3 or more, which is defined below:

$$AR = \text{diameter } (\mu m)/\text{thickness } (\mu m)$$

wherein when an organic silver salt particle is approximated to be a rectangular parallelepiped, the diameter is the maximum edge length (also denoted as MX LNG) and the thickness is the minimum edge length (also denoted as MN LNG).

The aspect ratio of the tabular organic silver salt particles is preferably within the range of 3 to 20, and more preferably 3 to 10. In the case of an aspect ratio of less than 3, the organic salt particles easily form closest packing and in the case of the aspect ratio being excessively high, organic silver salt particles are easily superposed and dispersed in the coating layer in the form of being brought into contact with each other, easily causing light scattering and leading to deterioration in transparency of the photothermographic material.

The grain diameter was determined in the following manner. An organic silver salt dispersion was diluted, dispersed on the grid provided with a carbon support membrane, and then photographed at a direct magnification of 5,000 times using a transmission type electron microscope (TEM, 2000 FX type, available from Nihon Denshi Co., Ltd.). The thus obtained negative electronmicrograph images were read as a digital image by a scanner to determine the diameter (circular equivalent diameter) using appropriate software. At least 300 grains were measured to determine the average diameter.

The grain thickness was determined using a transmission type electron microscope in the following manner. First, a light sensitive layer, coated onto a support, is pasted onto a suitable holder employing an adhesive and is cut perpendicular to the support surface employing a diamond knife to prepare an ultra-thin slice, at a thickness of 0.1 to 0.2 μm. The thus prepared ultra-thin slice is supported on a copper mesh, and is placed onto a carbon membrane, which has been made to be hydrophilic by means of a glow discharge. Then, while cooling the resulting slice to not more than −130° C., the image in a bright visual field is observed at a magnification of 5,000 to 40,000 employing a transmission electron microscope (hereinafter referred to as TEM), and then images are quickly recorded employing an image plate, a CCD camera, etc. In such a case, it is recommended to suitably select a portion of said slice, which has neither been torn nor distorted in the visual field for observation.

The carbon membrane, which is supported by an organic film such as an extremely thin collodion, Formvar, etc., is preferably employed, and a film composed of only carbon, which is obtained by forming the film on a rock salt substrate and then dissolving away the substrate or by removing the foregoing organic film, employing an organic solvent or ion etching, is more preferably employed. The acceleration voltage of said TEM is preferably 80 to 400 kV, and is most preferably 80 to 200 kV.

Details of other means such as electron microscopic technology and sample preparation techniques can be referred to in "Igaku-Seibutsugaku Denshikenbikyo Kansatsuho (Medical and Biological Electron Microscopy", edited by Nippon Denshikenbikyo Gakkai, Kanto Shibu, (Maruzen), and "Denshikenbikyo Seibutsu Shiryo Sakuseiho (Preparation Method of Biological Samples for Electron Microscopy)", edited by Nippon Denshikenbikyo Gakkai, Kanto Shibu, (Maruzen).

The TEM image, recorded in an appropriate medium, is decomposed to at least 1024×1024 pixels or preferably at least 2048×2048 pixels, and is then subjected to image processing employing a computer. In order to carry out image processing, an analogue image recorded on a film strip is converted into a digital image employing a scanner etc., and the resulting image is preferably subjected to shading correction, contrast-edge enhancement, etc., based on specific requirements. Thereafter, a histogram is prepared and the portions corresponding to organic silver are extracted employing binary processing. At least 300 grains of the organic silver salt were manually measured with respect to the thus extracted thickness employing appropriate software.

The average of the needle ratio of the tabular organic silver salt grains is determined according to the procedures described below.

First, a light sensitive layer, comprising tabular organic silver salt grains, is allowed to swell by employing an organic solvent which is capable of dissolving the binder of said light sensitive layer, and said layer is then peeled from the support. The operation is repeated five times, in which the peeled layer is subjected to ultrasonic cleaning with the above-mentioned solvent, and centrifugal separation, and the supernatant is removed. Further, the above-mentioned process is carried out under a photographic safelight.

Subsequently, dilution is carried out employing MEK (methyl ethyl ketone) so that the concentration of the organic silver solid portion becomes 0.01 percent. After carrying out ultrasonic dispersion, the resulting is dropped onto a polyethylene terephthalate film which has been made to be hydrophilic employing a glow discharge, and is subsequently dried.

The film, on which said grains are placed, is subjected to oblique evaporation of 3 nm thickness Pt-C by an electron beam from a 30° angle to the film surface employing a vacuum evaporation unit, and thereafter, is preferably employed for observation.

The prepared sample is observed through a secondary electron image, obtained by employing a field emission scanning electron microscope (hereinafter referred to as PE-SEM) under a magnification of 5,000 to 20,000 at an acceleration voltage of 2 to 4 kV, and the resulting image is stored on suitable recording media.

For the above-mentioned processing, it is convenient to use a device which is capable of directly recording the memory data as digital information, which is obtained by AD converting image signals from the electron microscope body. However, analogue images recorded onto Polaroid film etc. can be converted to digital images employing a scanner etc., and the resulting images may be employed upon carrying out shading correction, contrast enhancement as well as edge enhancement, etc. if desired.

One image recorded in a suitable medium is decomposed to at least 1024×1024 pixels and is preferably decomposed to 2048×2048 pixels. Said decomposed image is preferably subjected to image processing employing a computer.

Procedures of the above-mentioned image processing are as follows. First, a histogram is prepared and portions corresponding to tabular organic silver salt grains having an aspect ratio of 3 or more are extracted employing binary processing. Inevitable coagulated grains are cut employing a suitable algorithm or a manual operation and are subjected to boarder extract. Thereafter, both maximum length (MX LNG) and minimum width (WIDTH) between two parallel lines are measured for at least 1000 grains, and the needle ratio of each grain is obtained employing the formula described below. The maximum length (MX LNG) is the maximum value of the straight length between two points within a grain. The minimum width between two parallel lines is a minimum distance of two parallel lines drawn circumscribing the grain.

$$\text{Needle ratio}=(\text{MX LNG})/(\text{WIDTH})$$

Thereafter, the number average of the needle ratio is calculated for all measured particles. When measurements are carried out employing the above-mentioned procedures, it is desirable that in advance, employing a standard sample, the length correction (scale correction) per pixel as well as two-dimensional distortion correction of the measurement system is sufficiently carried out. As the standard sample, Uniform Latex Particles (DULP) marketed by Dow Chemical Co. in the USA are suitable. Polystyrene particles having a variation coefficient of less than 10 percent for a diameter of 0.1 to 0.3 $\mu$m are preferred. Specifically, a type having a particle diameter of 0.212 $\mu$m as well as a standard deviation of 0.0029 $\mu$m is commercially available.

Details of image processing technology may be had by referring to "Gazoshori Oyogijutsu (Applied Technology in Image Processing)", edited by Hiroshi Tanaka, (Kogyo Chosa Kai). Image processing programs or apparatuses are not particularly restricted, as long as the above-mentioned operation is possible. Cited as one example is Luzex-III, manufactured by Nireko Co.

Methods to prepare organic silver salt grains having the above-mentioned shape are not particularly restricted. The optimization of various conditions such as maintaining the mixing state during the formation of an organic acid alkali metal salt soap and/or the mixing state during the addition of silver nitrate to said soap. After tabular organic silver salt grains employed in the present invention are preliminarily dispersed together with binders, surface active agents, etc., if desired, the resulting mixture is preferably dispersed and pulverized by a media homogenizer, a high pressure homogenizer, or the like. During said preliminary dispersion, ordinary stirrers such as an anchor type, a propeller type, etc., a high speed rotation centrifugal radial type stirrer (Dissolver), as a high speed shearing stirrer (homomixer) may be employed.

Furthermore, employed as said media homogenizers may be rolling mills such as a ball mill, a satellite ball mill, a vibrating ball mill, medium agitation mills such as a bead mill, atriter, and others such as a basket mill. Employed as high pressure homogenizers may be various types such as a type in which collision occurs against a wall or a plug, a type in which liquid is divided into a plurality of portions and said portions are subjected to collision with each other, a type in which liquid is forced to pass through a narrow orifice, etc. Examples of ceramics employed as the ceramic beads include Al1O3, BaTiO3, SrTiO3, MgO, ZrO, BeO, Cr2O3, SiO3, SiO2—Al2O3, Cr2O3—MgO, MgO—CaO, MoO—C, MgO—Al2O3 (spinel), SiC, TiO2, K2O, Na2O, BaO, PbO, B2O3, BeAl2O4, Y3Al5O12, ZrO2—Y2O3 (cubic zirconia), 3BeO—Al2O3–6SiO2 (artificial emerald), C (artificial diamond), SiO2-nH2O, silicone nitride, yttrium-stabilized-zirconia, zirconia-reinforced-alumina. Yttrium-stabilized-zirconia and zirconia-reinforced-alumina are preferably employed in view that little impurity is generated by friction among the beads or the classifier during classifying them. The ceramics containing zirconia are called zirconia as an abbreviation.

In devices employed for dispersing the tabular organic silver salt grains employed in the present invention, preferably employed as the members which are in contact with the organic silver salt grains are ceramics such as zirconia, alumina, silicone nitride, boron nitride, or diamond. Of these, zirconia is the one most preferably employed.

While carrying out of the above-mentioned dispersion, the binder is preferably added so as to achieve a concentration of 0.1 to 10 wt % with reference to the weight of the organic silver salt, and the temperature is preferably maintained at no less than 45° C. from the preliminary dispersion to the main dispersion process. An example of the preferable operation conditions of a homogenizer, when employing high-pressure homogenizer as the dispersing machine, is twice or more operations at 300 to 1,000 kgf/cm$^2$. In the case when a media-dispersing machine is employed, a circumferential speed of 6 to 13 m/sec. is preferable. In the case when zirconia is employed as a part of the beads or of the machine, it is ground and mixed into the dispersion during the mixing process. This is specifically advantageous in view of photographic characteristics. Fragments of zirconia may be supplementally added to the dispersion or preliminarily added during preliminary dispersing. A high concentration zirconia liquid can be obtained, for example, by circulating methylethylketone in a bead mill filled with zirconia beads. The obtained zirconia liquid may be added in the adequate amount at adequate stages. The content of the zirconia in a light sensitive emulsion containing light sensitive silver halide and anorganic silver salt is preferably 0.01 to 0.5 mg, and more preferably 0.01 to 0.3 mg per g of silver. The zirconia is preferably in the form of fine particles having a diameter of not more than 0.02 $\mu$m.

In one preferred embodiment of this invention, light sensitive silver halide used in this invention is subjected to chemical sensitization which is performed using an organic sensitizer containing a chalcogen atom in the absence of an oxidizing agent during the manufacturing process of the photothermographic material, the silver halide being mixed with the organic silver salt, dispersed, dewatered and dried. One feature of the light sensitive emulsion used in the invention is that when the cross section, vertical to the support of the photothermographic material is observed through an electron microscope, organic silver salt particles exhibiting a grain projected area of less than 0.025 $\mu$m$^2$ account for at least 70% of the total grain projected area and organic silver salt particles exhibiting a grain projected area of not less than 0.2 $\mu$m$^2$ account for not more than 10% of the total grain projected area. In such a case, coagulation of the organic silver salt grains is minimized in the light sensitive emulsion, resulting in a homogeneous distribution thereof.

The conditions for preparing the light sensitive emulsion having such a feature are not specifically limited but include, for example, mixing at the time of forming an alkali metal soap of an organic acid and/or mixing at the time of adding silver nitrate to the soap being maintained in a favorable state, optimization of the ratio of the soap to the silver nitrate, the use of a media dispersing machine or a high pressure homogenizer for dispersing pulverization, wherein dispersion is conducted preferably in a binder content of 0.1 to 10% by weight, based on the organic silver salt, the dispersion including the preliminary dispersion is carried out preferably at a temperature of not higher than 45° C., and a dissolver, as a stirrer is preferably operated at a circumferential speed of at least 2.0 m/sec.

The projected area of organic silver salts grain having a specified projection area and the desired proportion thereof, based on the total grain projection area can be determined by the method using a transmission type electron microscope (TEM) in a similar manner, as described in the determination of the average thickness of tabular grains having an aspect ratio of 3 or more. In this case, coagulated grains are regarded as a single grain when determining the grain area (AREA). At least 1000 grains, and preferably at least 2000 grains are measured to determine the area and classified into three groups, i.e., A: less than 0.025 $\mu$m$^2$, B: not less than 0.025 $\mu$m$^2$ and less than 0.2 $\mu$m$^2$ and C: more than 0.2 $\mu$m$^2$. In this invention, it is preferable that the total projected area of grains falling within the range of "A" accounts for at least 70% of the projected area of the total grains and the total projected area of grains falling within the range of "C" accounts for not more than 10% of the projected area of total grain.

The organic silver salt grains used in this invention are preferably monodisperse. The degree of monodispersion is preferably 1 to 30% and monodisperse particles in this range lead to the desired high density images. The degree of monodispersion is defined as below:

Degree of monodispersion=(standard deviation of particle size)/(average particle size)×100 (%). The average particle size of organic silver salt is preferably 0.01 to 0.8 $\mu$m, and more preferably 0.05 to 0.5 $\mu$m. The particle size refers to the diameter of a circle having an area equivalent to the projected area of the particle (i.e., circular equivalent diameter).

To prevent hazing of the light sensitive material, the total amount of silver halide and organic silver salt is preferably 0.5 to 2.2 g in equivalent converted to silver per m$^2$, thereby leading to high contrast images.

The thermally developable photosensitive material (hereinafter, also referred to as photothermographic material), which forms images upon thermal development, comprises a reducible silver source (such as an organic silver salt), light sensitive silver halide, reducing agent and optionally an image toning agent to modify silver image color, which are dispersed in an (organic) binder matrix. The photothermographic material is stable at ordinary temperatures, which is developed, after exposure, upon heating at a high temperature (e.g., 80 to 140° C.). On heating, silver is formed through oxidation-reduction reaction between the organic silver salt (which acts as an oxidant) and the reducing agent. The oxidation-reduction reaction is catalyzed by silver latent images formed upon exposure to light. Silver formed by reaction of the organic silver salt in exposed areas provides a black image in contrast to non-exposed areas, forming images. This reaction process proceeds without supplying processing solution such as water from the exterior.

Image toning agents are preferably incorporated into the photothermographic material used in the present invention. Examples of preferred image toning agents are disclosed in Research Disclosure Item 17029, and include the following:

imides (for example, phthalimide), cyclic imides, pyrazoline-5-one, and quinazolinone (for example, succinimide, 3-phenyl-2-pyrazoline-5-on, 1-phenylurazole, quinazoline and 2,4-thiazolidione); naphthalimides (for example, N-hydroxy-1,8-naphthalimide); cobalt complexes (for example, cobalt hexaminetrifluoroacetate), mercaptans (for example, 3-mercapto-1,2,4-triazole); N-(aminomethyl) aryldicarboxyimides[for example, N-(dimethylaminomethyl)phthalimide]; blocked pyrazoles, isothiuronium derivatives and combinations of certain types of light-bleaching agents (for example, combination of N,N'-hexamethylene(1-carbamoyl-3,5-dimethylpyrazole), 1,8-(3,6-dioxaoctane)bis-(isothiuroniumtrifluoroacetate), and 2-(tribromomethyl-sulfonyl)benzothiazole; merocyanine dyes (for example, 3-ethyl-5-((3-etyl-2-benzothiazolinylidene-(benzothiazolinylidene))-1-methylethylidene-2-thio-2,4-oxazolidinedione); phthalazinone, phthalazinone derivatives or metal salts thereof (for example, 4-(1-naphthyl)phthalazinone, 6-chlorophthalazinone, 5,7-dimethylphthalazinone, and 2,3-dihydro-1,4-phthalazinedione); combinations of phthalazinone and sulfinic acid derivatives (for example, 6-chlorophthalazinone and benzenesulfinic acid sodium, or 8-methylphthalazinone and p-trisulfonic acid sodium); combinations of phthalazine and phthalic acid; combinations of phthalazine (including phthalazine addition products) with at least one compound selected from maleic acid anhydride, and phthalic acid, 2,3-naphthalenedicarboxylic acid or o-phenylenic acid derivatives and anhydrides thereof (for example, phthalic acid, 4-methylphthalic acid, 4-nitrophthalic acid, and tetrachlorophthalic acid anhydride); quinazolinediones, benzoxazine, naphthoxazine derivatives, benzoxazine-2,4-diones (for example, 1,3-benzoxazine-2,4-dione); pyrimidines and asymmetry-triazines (for example, 2,4-dihydroxypyrimidine), and tetraazapentalene derivatives (for example, 3,6-dimercapto-1,4-diphenyl-1H,4H-2,3a,5,6a-tatraazapentalene). Preferred image color control agents include phthalazone or phthalazine.

Antifoggants may be incorporated into the photothermographic material to which the present invention is applied. The substance which is known as the most effective antifoggant is a mercury ion. The incorporation of mercury compounds as the antifoggant into photosensitive materials is disclosed, for example, in U.S. Pat. No. 3,589,903. However, mercury compounds are not environmentally preferred. As mercury-free antifoggants, preferred are those antifoggants as disclosed in U.S. Pat. Nos. 4,546,075 and 4,452,885, and P-A 59-57234. Particularly preferred mercury-free antifoggants are heterocyclic compounds having at least one substituent, represented by —C(X1)(X2)(X3) (wherein X1 and X2 each represent halogen, and X3 represents hydrogen or halogen), as disclosed in U.S. Pat. Nos. 3,874,946 and 4,756,999. As examples of suitable antifoggants, employed preferably are compounds described in paragraph numbers [0030] through [0036] of JP-A 9-288328. Further, as another examples of suitable antifoggants, employed preferably are compounds described in paragraph numbers [0062] and [0063] of JP-A 9-90550. Furthermore, other suitable antifoggants are disclosed in U.S. Pat. Nos. 5,028,523, and European Patent 600,587; 605,981 and 631,176.

In the present invention, a matting agent is preferably incorporated into the image forming layer side. In order to minimize the image abrasion after thermal development, the matting agent is provided on the surface of a photosensitive material and the matting agent is preferably incorporated in an amount of 0.5 to 30 per cent in weight ratio with respect to the total binder in the emulsion layer side.

In cases where a non light sensitive layer is provided on the opposite side of the support to the light sensitive layer, it is preferred to incorporate a matting agent into at least one of the non-photosensitive layer (and more preferably, into the surface layer) in an amount of 0.5 to 40% by weight, based on the total binder on the opposite side to the light sensitive layer.

Materials of the matting agents employed in the present invention may be either organic substances or inorganic substances. Examples of the inorganic substances include silica described in Swiss Patent No. 330,158, etc.; glass powder described in French Patent No. 1,296,995, etc.; and carbonates of alkali earth metals or cadmium, zinc, etc. described in U.K. Patent No. 1,173,181, etc. Examples of the organic substances include starch described in U.S. Pat. No. 2,322,037, etc.; starch derivatives described in Belgian Patent No. 625,451, U.K. Patent No. 981,198, etc.; polyvinyl alcohols described in Japanese Patent Publication No. 44-3643, etc.; polystyrenes or polymethacrylates described in Swiss Patent No. 330,158, etc.; polyacrylonitriles described in U.S. Pat. No. 3,079,257, etc.; and polycarbonates described in U.S. Pat. No. 3,022,169.

The shape of the matting agent may be crystalline or amorphous. However, a crystalline and spherical shape is preferably employed. The size of a matting agent is expressed in the diameter of a sphere having the same volume as the matting agent. The particle diameter of the matting agent in the present invention is referred to the diameter of a spherical converted volume. The matting agent employed in the present invention preferably has an average particle diameter of 0.5 to 10 $\mu$m, and more preferably of 1.0 to 8.0 $\mu$m. Furthermore, the variation coefficient of the size distribution is preferably not more than 50 percent, is more preferably not more than 40 percent, and is most preferably not more than 30 percent. The variation coefficient of the size distribution as described herein is a value represented by the formula described below:

(Standard deviation of particle diameter)/(average particle diameter)×100

The matting agent according to the present invention can be incorporated into any layer. In order to accomplish the object of the present invention, the matting agent is preferably incorporated into the layer other than the light sensitive layer, and is more preferably incorporated into the farthest layer from the support.

Addition methods of the matting agent include those in which a matting agent is previously dispersed into a coating composition and is then coated, and prior to the completion of drying, a matting agent is sprayed. When plural matting agents are added, both methods may be employed in combination.

In addition to these materials, a variety of additives may be optionally incorporated into the light sensitive layer, non-photosensitive layer or other component layer(s). The photothermographic materials of the invention may be added with a surfactant, an antioxidant, a stabilizer, a plasticizer, a UV absorbent or a coating aid. As these additives and other additives described above are preferably employed compounds described in RD17029 (June, 1978, pages 9 to 15).

Supports usable in the photothermographic materials include various kinds of polymeric materials, glass, wool fabric, cotton fabric, paper, metal (e.g., aluminum) and those which are convertible to flexible sheets or rolls are preferred in terms of handling as information recording material. Preferred supports usable in photothermographic materials are plastic resin films (e.g., cellulose acetate film, polyester film, polyethylene terephthalate film, polyethylene naphthalate film, polyamide film, polyimide film, cellulose triacetate film, polycarbonate film) and biaxially stretched polyethylene terephthalate film is specifically preferred. The thickness of the support is preferably 50 to 300 μm, and more preferably 70 to 180 μm.

In the present invention, to improve an electrification property, a conducting compound such as a metal oxide and/or a conducting polymer can be incorporated into a construction layer. These compounds can be incorporated into any layer, preferably into a sublayer, a backing layer and an intermediate layer between a light sensitive layer and a sublayer, etc. In the present invention, the conducting compounds described in U.S. Pat. No. 5,244,773, column 14 through 20, are preferably used.

The coating method of the light sensitive layer, protective layer and backing layer is not specifically limited. Coating can be conducted by any method known in the art, including air knife, dip-coating, bar coating, curtain coating, and hopper coating. Two or more layers can be simultaneously coated. As a solvent for coating solution are employed organic solvents such as methyl ethyl ketone (also denoted as MEK), ethyl acetate and toluene.

The photothermographic material according to the invention comprises a support having thereon a light sensitive layer, and preferably further on the light sensitive layer having a non-photosensitive layer. For example, it is preferred that a protective layer is provided on the light sensitive layer to protect the light sensitive layer and that a back coating layer is provided on the opposite side of the support to the light sensitive layer to prevent adhesion between photosensitive materials or sticking of the photosensitive material to a roller. Further, there may be provided a filter layer on the same side or opposite side to the light sensitive layer to control the amount or wavelengths of light transmitting the thermally developable light sensitive layer. Alternatively, a dye or pigment may be incorporated into the light sensitive layer. In this case, dyes described in JP-A 8-201959 are preferably used therein. The light sensitive layer may be comprised of plural layers. To adjust contrast, a high-speed layer and low speed layer may be provided in combination. Various adjuvants may be incorporated into the light sensitive layer, non-photosensitive layer or other component layer(s).

The photothermographic material, which is stable at ordinary temperatures, is exposed and heated at a high temperature (preferably 80 to 200° C., and more preferably 100 to 150° C.) to undergo development. In cases when heated at a temperature of lower than 80° C., sufficient image density can be obtained within a short time. Further, in cases when heated at a temperature of higher than 200° C., a binder melts and is transferred to a roller, adversely affecting not only images but also transportability and a developing machine. The organic silver salt (functioning as an oxidant) and the reducing agent undergo oxidation-reduction reaction upon heating to form silver images. The reaction process proceeds without supplying any processing solution such as water.

Any light source within the infrared region is applicable to exposure of the photothermographic material and infrared semiconductor lasers (780 nm, 820 nm) are preferred in terms of high power and transmission capability through the photosensitive material.

In the invention, exposure is preferably conducted by laser scanning exposure. It is also preferred to use a laser exposure apparatus, in which scanning laser light is not exposed at an angle substantially vertical to the exposed surface of the photosensitive material. The expression "laser light is not exposed at an angle substantially vertical to the exposed surface" means that laser light is exposed preferably at an angle of 55 to 88°, more preferably 60 to 86°, still more preferably 65 to 84, and optimally 70 to 82°. When the photosensitive material is scanned with laser light, the beam spot diameter on the surface of the photosensitive material is preferably not more than 200 μm, and more preferably not more than 100 μm. Thus, the less spot diameter preferably reduces an angle displacing from verticality of the laser incident angle. The lower limit of the beam spot diameter is 10 μm. The thus laser scanning exposure can reduce deterioration in image quality caused by to reflection light, such as occurrence of interference fringe-like unevenness.

Exposure applicable in the invention is conducted preferably using a laser scanning exposure apparatus producing longitudinally multiple scanning laser light, whereby deterioration in image quality such as occurrence of interference fringe-like unevenness is reduced, as compared to scanning laser light with longitudinally single mode. Longitudinal multiplication can be achieved by a technique of employing backing light with composing waves or a technique of high frequency overlapping. The expression "longitudinally multiple" means that the exposure wavelength is not a single wavelength. The exposure wavelength distribution is usually not less than 5 nm and not more than 10 nm. The upper limit of the exposure wavelength distribution is not specifically limited but usually about 60 nm.

It is preferred that when subjected to thermal development, the photothermographic material contains an organic solvent. Examples of solvents include ketones such as acetone, isophorone, ethyl amyl ketone, methyl ethyl ketone, methyl isobutyl ketone; alcohols such as methyl alcohol, ethyl alcohol, n-propyl alcohol, isopropyl alcohol, n-butyl alcohol, isobutyl alcohol, diacetone alcohol, cyclohexanol, and benzyl alcohol; glycols such as ethylene glycol, dimethylene glycol, triethylene glycol, propylene glycol and hexylene glycol; ether alcohols such as ethylene glycol monomethyl ether, and dimethylene glycol monomethyl ether; ethers such as ethyl ether, dioxane, and isopropyl ether; esters such as ethyl acetate, butyl acetate, amyl acetate, and isopropyl acetate; hydrocarbons such as n-pentane, n-hexane, n-heptane, cyclohexene, benzene, toluene, xylene; chlorinated compounds such as chloromethyl, chloromethylene, chloroform, and dichlorobenzene; amines such as monomethylamine, dimethylamine, triethanol amine, ethylenediamine, and triethylamine; and water, formaldehyde, dimethylformaldehyde, nitromethane, pyridine, toluidine, tetrahydrofuran and acetic acid. The solvents are not to be construed as limiting these examples. These solvents may be used alone or in combination.

The solvent content in the photosensitive material can be adjusted by varying conditions such as temperature conditions at the drying stage after the coating stage. The solvent content can be determined by means of gas chromatography under the conditions suitable for detecting the solvent. The total solvent content (based on weight) of the photothermographic material used in the invention is preferably adjusted to be 5 to 1,000 mg per $m^2$ of the photothermographic material and more preferably 100 to 500 $mg/m^2$ (based on the weight of constituting components of the photosensitive material, except for a support). The solvent content within the range described above leads to a photothermographic material with low fog density as well as high sensitivity.

EXAMPLES

The present invention will be further described based on examples but embodiments of the invention are by no means limited to these examples.

Example 1

Preparation of a Subbed PET Photographic Support

Both surfaces of a biaxially stretched thermally fixed 175 μm PET film, available on the market, was subjected to corona discharging at 8 w/m$^2$·min. Onto one side of the film, the subbing coating composition a-1 descried below was applied so as to form a dried layer thickness of 0.8 μm, which was then dried. The resulting coating was designated Subbing Layer A-1. Onto the opposite surface, the subbing coating composition b-1 described below was applied to form a dried layer thickness of 0.8 μm. The resulting coating was designated Subbing Layer B-1.

| Subbing Coating Composition a-1 | |
|---|---|
| Latex solution (solid 30%) of a copolymer consisting of butyl acrylate (30 weight %), t-butyl acrylate (20 weight %) styrene (25 weight %) and 2-hydroxy ethyl acrylate (25 weight %) | 270 g |
| (C-1) | 0.6 g |
| Hexamethylene-1,6-bis(ethyleneurea) | 0.8 g |
| Water to make | 1 liter |
| **Subbing Coating Composition b-1** | |
| Latex liquid (solid portion of 30%) of a copolymer consisting of butyl acrylate (40 weight %) styrene (20 weight %) glycidyl acrylate (25 weight %) | 270 g |
| (C-1) | 0.6 g |
| Hexamethylene-1,6-bis(ethyleneurea) | 0.8 g |
| Water to make | 1 liter |

Subsequently, the surfaces of Subbing Layers A-1 and B-1 were subjected to corona discharging with 8 μm$^2$·minute. Onto the Subbing Layer A-1, the upper subbing layer coating composition a-2 described below was applied so as to form a dried layer thickness of 0.8 μm, which was designated Subbing Layer A-2, while onto the Subbing Layer B-1, the upper subbing layer coating composition b-2 was applied so at to form a dried layer thickness of 0.8 μm, having a static preventing function, which was designated Subbing Upper Layer B-2.

| Upper Subbing Layer Coating Composition a-2 Gelatin in an amount (weight) to make 0.4 g/m$^2$ | |
|---|---|
| (C-1) | 0.2 g |
| (C-2) | 0.2 g |
| (C-3) | 0.1 g |
| Silica particles (av. size 3 μm) | 0.1 g |
| Water to make | 1 liter |
| **Upper Subbing Layer Coating Composition b-2** | |
| (C-4) | 60 g |
| Latex solution (solid 20% comprising) (C-5) as a substituent | 80 g |
| Ammonium sulfate | 0.5 g |
| (C-6) | 12 g |
| Polyethylene glycol (average molecular weight of 600) | 6 g |
| Water to make | 1 liter |

(C-1)

-continued

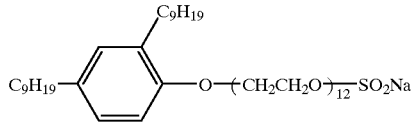

(C-2)

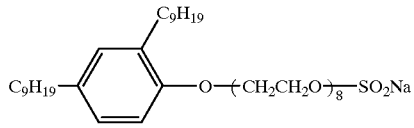

(C-3)

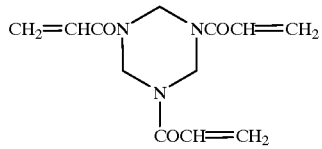

(C-4)

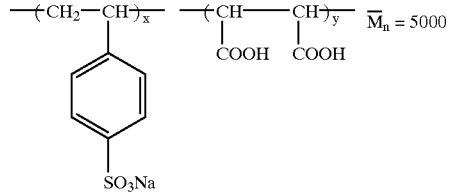

($\overline{M}$n is a number average molecular weight)
x:y = 75:25 (weight ratio)

(C-5)

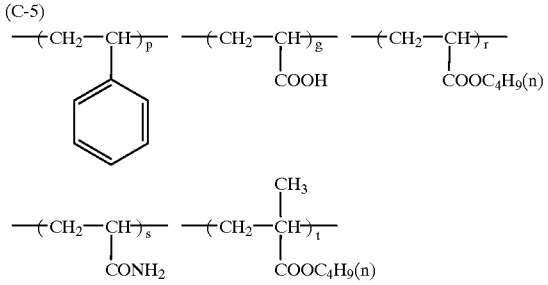

p:g:r:s:t = 40:5:10:5:40 (weight ratio)

(C-6)

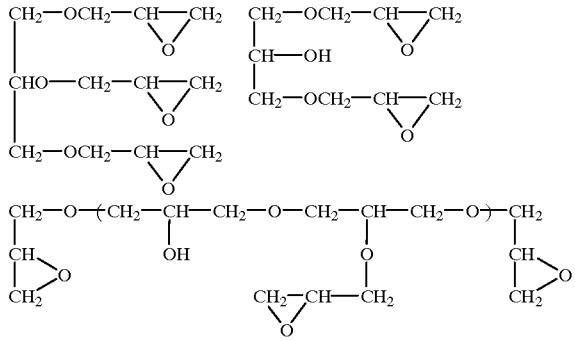

Mixture consisting of the three compounds illustrated above

Coating of Backing Layer-side

To 830 g of methyl ethyl ketone, 84.2 g of cellulose acetate-butylate (CAB381-20, available from Eastman Chemical Co.) and 4.5 g of polyester resin (Vitel PE2200B, available from Bostic Corp.) were added with stirring and dissolved therein. To the resulting solution was added 0.30 g of infrared dye 1 and 4.5 g fluorinated surfactant (Surflon KH40, available from ASAHI Glass Co. Ltd.) and 2.3 g fluorinated surfactant (Megafag F120K, available from DAINIPPON INK Co. Ltd.) which were dissolved in 43.2 g methanol, were added thereto and stirred until being dissolved. Then, 75 g of silica (Siloid 64×6000, available from W. R. Grace Corp.), which was dispersed in methyl ethyl ketone in a concentration of 1 wt % using a dissolver type homogenizer, was further added thereto with stirring to obtain a coating solution A for backing layer. The thus prepared backing layer coating solution was coated so as to form a dry thickness of 3.5 μm by means of an extrusion coater and dried at a drying temperature of 100° C. and a dew point of 10° C.

| Preparation of Light-sensitive Silver Halide Eulsion A | |
|---|---|
| Solution A1 | |
| Phenylcarbamoyl gelatin | 88.3 g |
| Compound (A) (10% methanol solution) | 10 ml |
| Potassium bromide | 0.32 g |
| Water to make | 5429 ml |
| Solution B1 | |
| 0.67 mol/l Aqueous silver nitrate solution | 2635 ml |
| Solution C1 | |
| Potassium bromide | 51.55 g |
| Potassium iodide | 1.47 g |
| Water to make | 660 ml |
| Solution D1 | |
| Potassium bromide | 154.9 g |
| Potassium iodide | 4.41 g |
| Iridium chloride (1% solution) | 0.93 ml |
| Water to make | 1982 ml |
| Solution E1 | |
| 0.4 mol/l aqueous potassium bromide solution | |
| Amount necessary to adjust silver potential | |
| Solution F1 | |
| Potassium hydroxide | 0.71 g |
| Water to make | 20 ml |
| Solution G1 | |
| Aqueous 56% acetic acid solution | 18 ml |
| Solution H1 | |
| Anhydrous sodium carbonate | 1.72 g |
| Water to make | 151 ml |
| Compound (A) | |
| $HO(CH_2CH_2O)_n—(CH(CH_3)CH_2O)_{17}—CH_2CH_2O)_mH$ | |
| (m + n = 5 to 7) | |

Using a stirring mixer described in JP-B 58-58288 and 58-58289, ¼ of solution B1, the total amount of solution Cl were added to solution Al by the double jet addition for 4 min 45 sec. to form nucleus grain, while maintaining a temperature of 45° C. and a pAg of 8.09. After 1 min., the total amount of solution F1 was added thereto. After 6 min, ¾ of solution B1 and the total amount of solution D1 were further added by the double jet addition for 14 min 15 sec., while mainlining a temperature of 45° C. and a pAg of 8.09. After stirring for 5 min., the reaction mixture was cooled to 40° C. and solution G1 was added thereto to coagulate the resulting silver halide emulsion. Remaining 2000 ml of precipitates, the supernatant was removed and after adding 10 lit. water with stirring, the silver halide emulsion was again coagulated. Remaining 1500 ml of precipitates, the supernatant was removed and after adding 10 lit. water with stirring, the silver halide emulsion was again coagulated. Remaining 1500 ml of precipitates, the supernatant was removed and solution H1 was added. The temperature was raised to 60° C. and stirring continued for 120 min. Finally, the pH was adjusted to 5.8 and water was added there to so that the weight per mol of silver was 1161 g, and light-sensitive silver halide emulsion A was thus obtained. It was proved that the resulting emulsion was comprised of monodisperse silver iodobromide cubic grains having an average grain size of 0.058 μm, a coefficient of variation of grain size of 12% and a [100] face ratio of 92%.

The thus prepared emulsion A was heated to a temperature of 50° C., then, the following infrared sensitizing dye solution was added in an amount of 100 ml per mol of silver and after 30 min., organic sensitizer C-1 was further added in an amount of $2\times10^{-3}$ mol/Ag mol and ripening was conducted for 90 min. to undergo spectral sensitization and chemical sensitization. Thereafter, to the ripened emulsion, an aqueous q mol/l potassium bromide solution was added to adjust the pAg to 10 and the pH was adjusted to 4 with an aqueous 0.5 mol/l sulfuric acid solution. After stirring for 30 min., the emulsion was coagulated by adding a gelatin coagulating agent to perform desalting. Then, 0.1 g of phenoxyethanol was added and the pH and pAg were adjusted to 5.9 and 7.5, respectively to obtain chemically sensitized light-sensitive silver halide emulsion A (C-1). Separately, the emulsion, A was ripened without adding the organic sensitizer. The resulting emulsion was denoted as emulsion AO, as a comparative emulsion.

Preparation of Infrared-sensitizing Dye Solution A

Infrared sensitizing dye No. S-43 of 350 mg, selected from the compounds represented by formulas (1) through (4) and 14 g of 2-chlorobenzoic acid were dissolved in methanol in a dark room to obtain an infrared sensitizing dye solution A.

Preparation of Powdery Organic Silver Salt A (C-1)

In 4720 ml water were dissolved at 80° C. 130.8 g of behenic acid, 67.7 g of arachidic acid, 43.6 g of stearic acid and palmitic acid. The, after adding 540.2 ml of 1.5M aqueous sodium hydroxide solution with stirring and further adding 6.9 ml of concentrated nitric acid, the solution was cooled to a temperature of 55° C. to obtain an aqueous organic acid sodium salt solution. To the solution were added 45.3 g of the silver halide emulsion obtained above, A (C-1) and 450 ml water and stirring further continued for 5 min., while maintained at a temperature of 55° C. Subsequently, 702.6 ml of 1M aqueous silver nitrate solution was added in 2 min. and stirring continued further for 10 min. to obtain an organic silver salt dispersion. The obtained organic silver salt dispersion was put into a washing vessel and deionized wwater was added with stirring. Thereafter, the dispersion was allowed to stand and separate float of the organic silver salt dispersion from the reaction mixture to remove the lower soluble salts. Then, washing with deionized water and filtration were repeated until the filtrate reached a conductivity of 2 μS/cm, and after subjecting to centrifugal dehydration, the cake-like organic silver salt was dried in a nitrogen gas atmosphere employing a gas stream type dryer, Flash Jet Dryer (available from SEISHIN KIGYO Co., Ltd.) until reached a moisture content of 0.1%. Powdery organic silver salt A (C-1) was thus obtained. The moisture content was measured employing an infrared aquameter.

Preparation of Powdery Organic Silver Salt B (C-1)

In 4720 ml water were dissolved at 90° C. 217.6 g of behenic acid, 28.2 g of arachidic acid, and 6.4 g of stearic acid. The, after adding 93.3 ml of 4M aqueous sodium hydroxide solution with stirring, the solution was cooled to a temperature of 40° C. to obtain an aqueous organic acid sodium salt solution. To the solution were added 45.3 g of the silver halide emulsion obtained above, A (C-1) and 450 ml water and stirring further continued for 5 min., while maintained at a temperature of 40° C. Thereafter, the procedure was conducted in a manner similar to the preparation of organic silver salt A (C-1) to obtain powdery organic silver salt B (C-1).

Preparation of Powdery Organic Silver Salt C (C-1)

Powdery organic silver salt C (C-1) was prepared in a manner similar to powdery organic silver salt A (C-1), provided that light sensitive silver halide emulsion AO added in place of light sensitive silver halide emulsion A (C-1).

Preparation of Preliminarily-dispersed Solution A (C-1)

In 1457 g methyl ethyl ketone was dissolved 14.57 g of polyvinyl butyral powder (Butvar B-79, available from Monsanto Corp.) and further thereto, 500 g of the powdery organic silver salt A (C-1) with stirring by dissolver DISPERMAT CA-40M type (available from VMA-GETZMANN Corp.) was gradually added to obtain a preliminary dispersion A (C-1).

Preparation of Preliminarily-dispersed Solution B (C-1)

Preliminary dispersion B (C-1) was prepared similarly to preliminary dispersion A (C-1), provided that powdery organic silver salt A (C-1) was replaced by powdery organic silver salt B (C-1).

Preparation of Preliminarily-dispersed Solution C (C-1)

Preliminary dispersion C (C-1) was prepared similarly to preliminary dispersion A (C-1), provided that powdery organic silver salt A (C-1) was replaced by powdery organic silver salt C (C-1).

Preparation of Light-sensitive Emulsion dispersing Solution 1

Preliminary dispersion A (C-1) was supplied to a media type dispersion machine, DISPERMAT SL-C12EX (available from VMA-GETMANN Corp.), which was packed 0.5 mm in diameter Zirconia beads (available from Toray Co. Ltd.) by 80%, and dispersed at a circumferential speed of 13 m for 10 min. of a retention time in the mill to obtain light sensitive emulsion dispersing solution 1.

Preparation of Light-sensitive Emulsion dispersing Solution 2

Preliminary dispersion A (C-1) was supplied to the dispersing machine used in the preparation of light sensitive emulsion-dispersing solution 1 and dispersed at a circumferential speed of 13 m for 3 min. of a retention time in the mill to obtain light sensitive emulsion dispersing solution 2.

Preparation of Light-sensitive Emulsion dispersing Solution 3

Using pressure homogenizer type GM-2 (available from S.M.T. Corp.), Preliminary dispersion A (C-1) was subjected to two-pass dispersion to obtain light sensitive emulsion dispersing solution 3, in which the treatment pressure at the first pass was 27.46 MPa and that of the second pass was 54.92 MPa.

Preparation of Light-sensitive Emulsion dispersing Solution 4

Preliminary dispersion B (C-1) was supplied to the dispersing machine used in the preparation of light sensitive emulsion-dispersing solution 1 and dispersed at a circumferential speed of 13 m for 3 min. of a retention time in the mill to obtain light sensitive emulsion dispersing solution 4.

Preparation of Light-sensitive Emulsion dispersing Solution 5

Using pressure homogenizer type GM-2 (available from S.M.T. Corp.), Preliminary dispersion B (C-1) was subjected to two-pass dispersion to obtain light sensitive emulsion dispersing solution 5, in which the treatment pressure at the first pass was 27.46 MPa and that of the second pass was 54.92 MPa.

Preparation of Light-sensitive Emulsion dispersing Solution 6

Light sensitive emulsion dispersing solution 6 was prepared similarly to light sensitive emulsion dispersing solution 1, provided that preliminary dispersion A (C-1) was replaced by preliminary dispersion C (C-1).

Preparation of Stabilizer Solution

In 4.97 g of methanol, 1.0 g of stabilizer 1 and 0.31 g of potassium acetate were dissolved to obtain a stabilizer solution.

Preparation of Infrared-sensitizing Dye Solution B

Infrared sensitizing dye No. S-43 of 19.2 mg, 1.488 g of 2-chlorobenzoic acid,2.779 g of stabilizer 2 and 365 mg of 5-methyl-2-mercaptobenzimidazole were dissolved in 31.3 ml of MEK in a dark room to obtain an infrared sensitizing dye solution B.

Preparation of Additive Solution a

Developing agent A-3 of 27.98 g, 1.54 g of 4-methylphthalic acid and 0.48 g of infrared dye were dissolved in 110 g of MEK to obtain additive solution a.

Preparation of Additive Solution b

Antifoggant of 3.56 g, and 3.43 g of phthalazine were dissolved in 40.9 g of MEK to obtain additive solution b.

Preparation of coating solution of light sensitive layer

The light-sensitive emulsion-dispersing solution 1 of 50 g and 15.11 g MEK were maintained at 21° C. with stirring. Then, 390 μl of antifoggant 1 solution (10% methanol solution) was added and stirred for 1 hr. and 494 μl of calcium bromide solution (10% methanol solution) was added and further stirred for 20 min. Subsequently, 167 mg of the stabilizer solution was further added thereto and after stirring for 10 min., 1.32 g of the infrared sensitizing dye solution was added, stirred for 1 hr., and then, cooled to 13° C. and further stirred for 30 min.

Further, 13.31 g of polyvinyl butyral (Butvar B-79, available from Monsanto Corp.) was added thereto and after 30 min., 1.084 g of tetrachlorophthalic acid (9.4% by weight MEK solution) was added. Then, 12.43 g of additive solution a, 1.6 ml of an aliphatic isocyanate, Desmodur N3399, available from Movey Corp. (10% MEK solution) and 4.27 g og additive solution b were successively added thereto to obtain light sensitive layer coating solution.

Preparation of Matting Agent Dispersion

Cellulose acetate butyrate (7.5 g of CAB171–15, available from Eastman Chemical Co.) was dissolved in 42.5 g of MEK, then, 5 g of calcium carbonate (Super-Pflex 200, available from Specility Mineral Corp.) was added thereto and dispersed using a dissolver type homogenizer at 8000 rpm for 30 min to obtain a matting agent dispersion.

Preparation of Protective Layer Coating Solution

To 865 g of methyl ethyl ketone were added with stirring 96 g of cellulose acetate butyrate (CAB171-15, available from Eastman Chemical Co.), 4.5 g of polymethyl methacrylate (Paraloid A-21, available from Rohm & Haas Corp.). Further thereto were added and dissolved 1.5 g of vinylsulfone compound (HD-1), 1.0 g of benzotriazole and 1.0 g of fluorinated surfactant (Surflon KH40, available from ASAHI Glass Co. Ltd.). Then, 30 g of the matting agent dispersion was further added thereto to obtain a coating solution of the surface protective layer.

Stabilizer 1

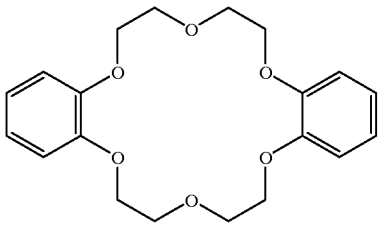

Antifoggant 1

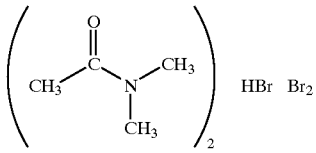

Antifoggant 2

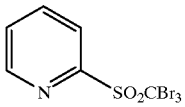

Infrared dye

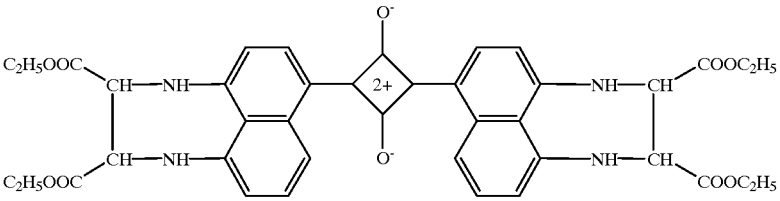

Vinylsulfon compound (HD-1)

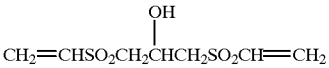

Light-sensitive Layer Coating

Coating solutions of the light sensitive layer and surface protective layer were simultaneously coated using an extrusion coater so that the silver coverage of the light sensitive layer was 1.9 g/m$^2$ and the dry thickness of the surface protective layer was 2.5 $\mu$m. Drying was conducted with hot air at a drying temperature of 75° C. and a dew point of 10° C. for 10 min to obtain a photothermographic material sample No. 1.

Photothermographic material samples No. 2 through 6 were prepared similarly to photothermographic material sample No. 1, provided that light sensitive emulsion dispersing solution 1 was replaced by light sensitive emulsion dispersing solution 2 to 6.

Exposure and processing

The thus prepared photothermographic material was subjected to laser scanning exposure from the emulsion side using an exposure apparatus having a light source of 800 to 820 nm semiconductor laser of a longitudinal multi-mode, which was made by means of high frequency overlapping. In this case, exposure was conducted at 75° of an angle between the exposed surface and exposing laser light. (As a result, unevenness in density was reduced and unexpectedly superior sharpness was achieved, as compared to exposure at an angle of 90°.) The exposed photothermographic material was subjected to thermal development at 115° C. for 15 sec., while bringing the protective layer surface of the photothermographic material into contact with the heated drum surface. Exposure and thermal development were conducted in an atmosphere of 23° C. and 50% RH. The thus obtained image was measured to evaluate sensitivity and fog density. Sensitivity was represented by a relative value of the reciprocal of exposure giving a density of 1.0 higher than an unexposed area density (i.e., fog density), based on the sensitivity of sample No. 1 being 100.

Measurement of Degree of Monodispersity

An organic silver salt dispersion was diluted with MEK, dispersed on the grid provided with a carbon support membrane, and then photographed at a direct magnification of 5,000 times using a transmission type electron microscope (TEM, 2000 FX type, available from Nihon Denshi Co., Ltd.). In this case, the sample holder was cooled to a temperature of 120° C. to prevent damage. The thus obtained negative electronmicrograph images were read as a digital image by a scanner to determine the diameter (circular equivalent diameter) using appropriate software. At least 300 grains were measured to determine the average diameter, whereby the average value and a coefficient of variation thereof were determined.

Measurement of Solvent Content of Film

Film samples were each measured with respect to the solvent content. Thus, sample films each were cut to an area of 46.3 cm$^2$, further finely cut to about 5 mm, contained into a specified vial, which was closely packed with septum and aluminum cap, and set to head space sampler HP769 (available Hewlett Pachard Co.), which was connected to gas chromatography (GC) Hewlett Packard type 5971 provided with a hydrogen flame ion detector (FID). Chromatograms were obtained under the measurement conditions including a head space sampler heating temperature of 120° C. for 20 min., a GC-introducing temperature of 150° C., column of DB-624 (available from J & W co.) and temperature-increasing of 45° C. (3 min.) to 100° C. at a rate of 8°/min. Solvents to be measure were methyl ethyl ketone and methanol. A given amount of each solvent, which was further diluted with butanol was contained into a vial and subjected to the chromatographic measurement in a manner similar to above. Using a calibration curve prepared from the obtained chromatogram peak area, the solvent content of each film sample was determined.

Evaluation of Average Needle Ratio of Organic Silver Salt Grains

Samples were prepared employing a Type JFD-7000 (manufactured by Nippon Denshi Co.) as a vacuum deposition device. Type S-5000H (manufactured by Hitachi, Ltd.), was employed as an FE-SEM, and each sample was observed at an acceleration voltage of 2.0 kV in such a manner that a visual field was selected in which at least 1,000 organic silver grains were present. Each image was digitized, transmitted to a filing device (VIDEO BANK), and stored in an MO disk. Subsequently, employing Type LUZEX-III (manufactured by Nireko Co.), and manual operation when grains were overlapped or in contact with each other, each grain was extracted and its MX LNG/WIDTH was measured, by which the average was obtained. Results are shown in Table 1. It was proved that in light sensitive emulsion dispersing solutions 1 to 6, organic silver salt grains exhibiting an aspect ratio of 3 or more accounted for not less than 80% of the total grain projected area.

The solvent contents of photothermographic material samples No. 1 through 6 were within the range of 32 mg/M$^2$ to 55 mg/m$^2$. Effects of these solvent contents on characteristics of thermal development of the photothermographic material can be regarded as substantially the same and in fact, no difference was observed with respect to effects on photographic performance.

TABLE 1

| Sample No. | Average of Needle Ratio | Degree of Monodispersity (%) | Solvent Content (mg/m$^2$) | Chemical Sensitization | Sensitivity | Fog | Remark |
|---|---|---|---|---|---|---|---|
| 1 | 1.5 | 19 | 32 | Yes | 265 | 0.27 | Inv. |
| 2 | 3.5 | 29 | 38 | Yes | 278 | 0.20 | Inv. |
| 3 | 5.4 | 33 | 40 | Yes | 260 | 0.22 | Inv. |
| 4 | 8.2 | 40 | 55 | Yes | 255 | 0.25 | Inv. |
| 5 | 11.5 | 46 | 53 | Yes | 200 | 0.46 | Comp. |
| 6 | 3.4 | 28 | 40 | No | 100 | 0.20 | Comp. |

As can be seen from Table 1, inventive samples exhibited low fog density as well as enhanced sensitivity, relative to comparative samples.

Example 2

Photothermographic material samples No. 21 through 25 were prepared in a manner similar to Example 1, provided that light sensitive emulsion dispersing solutions 21 through 25 described below were used.

Preparation of Light-sensitive Emulsion dispersing Solution 21

Preliminary dispersion A (C-1) was supplied to a media type dispersion machine, DISPERMAT SL-C12EX (available from VMA-GETMANN Corp.), which was packed 0.5 mm in diameter Zirconia beads (available from Toray Co. Ltd.) by 80%, and dispersed at a circumferential speed of 13 m for 3 min. of a retention time in the mill to obtain light sensitive emulsion dispersing solution 21.

Preparation of Light-sensitive Emulsion dispersing Solution 22

Using pressure homogenizer type GM-2 (available from S.M.T. Corp.), Preliminary dispersion A (C-1) was subjected to two-pass dispersion to obtain light sensitive emulsion dispersing solution 3, in which the treatment pressure at the first pass was 27.46 MPa and that of the second pass was 54.92 MPa.

Preparation of Light-sensitive Emulsion dispersing Solution 23

Light sensitive emulsion dispersing solution 23 was prepared similarly to light sensitive emulsion dispersing solution 22, provided that MEK used for preparation of preliminary dispersion A (C-1) was supplied to the dispersing machine used in the preparation of light sensitive emulsion-dispersing solution 1 and dispersed at a circumferential speed of 13 m for 3 min. of a retention time in the mill.

Preparation of Light-sensitive Emulsion dispersing Solution 24

Preliminary dispersion A (C-1) was supplied to a media type dispersion machine, DISPERMAT SL-C12EX (available from VMA-GETMANN Corp.), which was packed 0.5 mm in diameter Zirconia beads (available from Toray Co. Ltd.) by 80%, and dispersed at a circumferential speed of 13 m for 3 min. of a retention time in the mill to obtain light sensitive emulsion dispersing solution 24.

Preparation of Light-sensitive Emulsion dispersing Solution 25

Preliminary dispersion A (C-1) was supplied to a media type dispersion machine, DISPERMAT SL-C12EX (available from VMA-GETMANN Corp.), which was packed 0.5 mm in diameter Zirconia beads (available from Toray Co. Ltd.) by 80%, and dispersed at a circumferential speed of 13 m for 0.5 min. of a retention time in the mill to obtain light sensitive emulsion dispersing solution 25.

Projection Area of the Organic Silver Salt Grains

A slice was prepared vertically to the support employing a microtome (Ultratome NOVA, manufactured by LKB Co.), and each sample was observed at an acceleration voltage of 200 kV in such a manner that a visual field was selected in which at least 1,000 organic silver grains were present. Negative image was converted to a digital image with resolution 600 dpi through a scanner, and was subjected by image processing employing Type LUZEX-III (manufactured by Nireko Co.), and histogram of projection area of grains were generated, subsequently the proportion of grains having projection area of not more than 0.025 $\mu$m$^2$ and the proportion of grains having projection area of not less than 0.2 $\mu$m$^2$ were calculated. Results thereof are shown in Table 2.

The solvent content, degree of monodispersity, sensitivity and fog density were each measured and results there of are also shown in Table 2. The solvent contents of photothermographic material samples No. 21 through 25 were within the range of 32 mg/m$^2$ to 75 mg/m$^2$. Effects of these solvent contents on characteristics of thermal development of the photothermographic material can be regarded as substantially the same and in fact, no difference was observed with respect to effects on photographic performance.

TABLE 2

| Sample No. | Average of Needle Ratio | Degree of Monodispersity (%) | Solvent Content (mg/m$^2$) | Projection Area Ratio (%)* | Chemical Sensitization | Sensitivity | Fog | Remark |
|---|---|---|---|---|---|---|---|---|
| 21 | 3.5 | 19 | 32 | 80/7 | Yes | 165 | 0.19 | Inv. |
| 22 | 5.4 | 28 | 40 | 75/9 | Yes | 155 | 0.23 | Inv. |
| 23 | 5.4 | 29 | 75 | 65/20 | Yes | 145 | 0.24 | Inv. |
| 24 | 5.4 | 32 | 64 | 62/25 | Yes | 142 | 0.26 | Inv. |
| 25 | 10.1 | 40 | 60 | 40/32 | Yes | 100 | 0.40 | Comp. |

*Projection area ratio = proportion of grains having an projection area of not more than 0.025 $\mu m^2$ (%)/proportion of grains having an projection area of not less than 0.2 $\mu m^2$ (%)

As can be seen from Table 2, inventive samples exhibited low fog density as well as enhanced sensitivity, relative to comparative samples.

Example 3

Photographic material samples No. 101 through 113 were prepared in a manner similar to Example 1, provided that light sensitive silver halide emulsion A was chemically sensitized with an organic sensitizer, and an image stabilizer represented by general formula (1) or (2) or a cross-linking agent represented by general formula (8), (10% MEK solution of 1.60 ml) was incorporated into the light sensitive layer, as shown in Table 3. In Sample 101 to 103, silver halide emulsion A was not subjected to chemical sensitization.

TABLE 3

| Sample No. | Organic Sensitizer | Additive: Cross-linking agent (mg) | Additive: Image Stabilizer (mg) | Remark |
|---|---|---|---|---|
| 101 | — | — | — | Comp. |
| 102 | — | HDI + HD-1 (200 + 50) | — | Comp. |
| 103 | — | HDI + HD-1 (200 + 50) | BI-4 (2500) | Comp. |
| 104 | — | HDI + HD-1 (200 + 50) | I-1 (300) | Comp. |
| 105 | C-1 | — | — | Inv. |
| 106 | C-1 | HDI + HD-1 (200 + 50) | — | Inv. |
| 107 | C-1 | HDI + HD-1 (200 + 50) | BI-4 (2500) | Inv. |
| 108 | C-1 | HDI + HD-1 (200 + 50) | I-1 (300) | Inv. |
| 109 | C-3 | HDI + HD-1 (200 + 50) | I-1 (300) | Inv. |
| 110 | C-4 | HDI + HD-1 (200 + 50) | I-1 (300) | Inv. |
| 111 | C-5 | HDI + HD-1 (200 + 50) | I-1 (300) | Inv. |
| 112 | C-31 | HDI + HD-1 (200 + 50) | I-1 (300) | Inv. |
| 113 | C-32 | HDSI + HD-1 (200 + 50) | I-1 (300) | Inv. |

In Table 3, the term, HDI and HDSI means hexamethylene diisocyanate and hexamethylene dithioisocyanate, respectively.

Raw stock stability

Phtothermographic material samples were each allowed to stand for 10 days under the following condition A or B, and then, subjected to exposure and thermal development. Obtained images were subjected to densitomery. The difference in minimum density (Dmin) between conditions A and B, i.e., Dmin (B)−Dmin(A) was determined as a measure of raw stock stability of photothermographic materials. Results are shown in Table 4.

Condition A:25° C., 55% RH (aging A)

Condition B:40° C., 80% RH (aging B)

Image storage stability

Photothermographic material samples were also allowed to stand for 10 days under the above-described condition A and subjected to exposure and thermal development. Further, after being allowed to stand for 7 days in an atmosphere of 25° C. and 55% RH under fluorescent lamp, thermally developed samples were evaluated with respect image color tone, based on the following criteria:

5: No problem in image tone,

4: No problem in image tone for practical use,

3: Slightly yellowish tone but acceptable tone,

2: Unpleasant tone and problem in image tone

1: Marked variation in tone and unacceptable in practical use.

TABLE 4

| Sample No. | Aging A (10 days): Fog | Aging A (10 days): Sensitivity | Raw Stock Stability | Image storage Stability | Remark |
|---|---|---|---|---|---|
| 101 | 0.45 | 100 | 0.40 | 1 | Comp. |
| 102 | 0.27 | 118 | 0.26 | 2 | Comp. |
| 103 | 0.09 | 124 | 0.09 | 5 | Comp. |
| 104 | 0.08 | 122 | 0.10 | 5 | Comp. |
| 105 | 0.48 | 230 | 0.43 | 1 | Inv. |
| 106 | 0.29 | 268 | 0.29 | 2 | Inv. |
| 107 | 0.10 | 270 | 0.13 | 5 | Inv. |
| 108 | 0.09 | 275 | 0.12 | 5 | Inv. |
| 109 | 0.11 | 269 | 0.13 | 5 | Inv. |
| 110 | 0.12 | 265 | 0.13 | 5 | Inv. |
| 111 | 0.10 | 260 | 0.12 | 5 | Inv. |
| 112 | 0.14 | 290 | 0.15 | 5 | Inv. |
| 113 | 0.15 | 285 | 0.15 | 5 | Inv. |

It was further proved that when the silver halide emulsion was similarly subjected to chemical sensitization under the condition that pyridinum perbromide hydrobromide, a an oxidizing agent was concurrently present, the sensitivity was 60% of the case of no such an oxidizing agent being present, and reproducibility of sensitivity was unacceptable levels in practical use.

As can be seen from Table 4, inventive samples exhibited enhanced sensitivity, lower fog density and superior raw stock stability. It is specifically noted that the use of a cross-linking agent and image stabilizer led to further super results with respect to sensitivity, fog density and image storage stability.

Example 4

Photothermographic material samples 201 through 213 were prepared in a manner similar to Example 3, provided that an image stabilizer of general formula (1) or (2), and cross linking agents, epoxy compound of general formula (9) and acid anhydride were used, as shown in Table 5.

TABLE 5

| Sample No. | Organic Sensitizer | Additive: Cross-linking agent (mg) | Additive: Image Stabilizer (mg) | Remark |
|---|---|---|---|---|
| 201 | — | EP-1 + B-11 (200 + 50) | — | Comp. |
| 202 | C-1 | EP-1 + B-11 (200 + 50) | — | Inv. |
| 203 | C-1 | EP-1 + B-11 (200 + 50) | BI-4 (2500) | Inv. |
| 204 | C-1 | EP-1 + B-11 (200 + 50) | I-33 (300) | Inv. |
| 205 | C-1 | EP-9 + B-11 (200 + 50) | BI-4 (2500) | Inv. |
| 206 | C-1 | EP-9 + B-11 (200 + 50) | I-33 (300) | Inv. |
| 207 | C-3 | EP-1 + B-11 (200 + 50) | I-33 (300) | Inv. |
| 208 | C-4 | EP-1 + B-11 (200 + 50) | I-33 (300) | Inv. |
| 209 | C-5 | EP-1 + B-11 (200 + 50) | I-33 (300) | Inv. |
| 210 | C-31 | EP-1 + B-11 (200 + 50) | I-33 (300) | Inv. |
| 211 | C-32 | EP-1 + B-11 (200 + 50) | I-33 (300) | Inv. |
| 212 | C-3 | EP-9 + B-11 (200 + 50) | I-1 (300) | Inv. |
| 213 | C-3 | EP-9 + B-11 (200 + 50) | I-33 (300) | Inv. |

Similarly to Example 3, the photothermographic material samples were evaluated with respect to raw stockstability and image storage stability. Results thereof are shown in Table 6. In the Table, sensitivity is represented by a relative value, based on the sensitivity of Sample No. 201 being 100.

TABLE 6

| Sample No. | Aging A (7 days): Fog | Aging A (7 days): Sensitivity | Raw Stock Stability | Image storage Stability | Remark |
|---|---|---|---|---|---|
| 201 | 0.36 | 100 | 0.34 | 1 | Comp. |
| 202 | 0.38 | 235 | 0.39 | 3 | Inv. |
| 203 | 0.10 | 273 | 0.12 | 5 | Inv. |
| 204 | 0.10 | 270 | 0.12 | 5 | Inv. |
| 205 | 0.11 | 269 | 0.12 | 5 | Inv. |
| 206 | 0.12 | 275 | 0.13 | 5 | Inv. |
| 207 | 0.12 | 272 | 0.13 | 5 | Inv. |
| 208 | 0.12 | 263 | 0.13 | 5 | Inv. |
| 209 | 0.11 | 265 | 0.12 | 5 | Inv. |
| 210 | 0.15 | 293 | 0.16 | 5 | Inv. |
| 211 | 0.15 | 280 | 0.17 | 5 | Inv. |
| 212 | 0.11 | 270 | 0.12 | 5 | Inv. |
| 213 | 0.12 | 273 | 0.13 | 5 | Inv. |

As can be seen from Table 6, inventive samples exhibited enhanced sensitivity, lower fog density and superior raw stock stability. It is specifically noted that the use of a cross-linking agent and image stabilizer led to further super results with respect to sensitivity, fog density and image storage stability.

What is claimed is:

1. A photothermographic material comprising on a support a light sensitive layer containing an organic silver salt, light sensitive silver halide grains and a solvent, wherein the organic silver salt comprises tabular organic silver salt grains exhibiting an average needle ratio of not less than 1.1 and less than 10.0, the light sensitive silver halide grains having been subjected to chemical sensitization.

2. The photothermographic material of claim 1, wherein the tabular grains exhibit an aspect ratio of not less than 3, accounting for at least 50% by number of total organic silver salt grains.

3. The photothermographic material of claim 2, wherein the tabular grains exhibit an aspect ratio of 3 to 20.

4. The photothermographic material of claim 2, wherein the chemical sensitization is performed using an organic sensitizer containing a chalcogen atom.

5. The photothermographic material of claim 4, wherein the chemical sensitization is performed in the absence of an oxidizing agent.

6. The photothermographic material of claim 4, wherein the organic sensitizer is represented by the following formula (C):

formula (C)

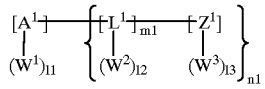

wherein $A^1$ represents an atomic group containing a group for promoting adsorption onto silver halide; $L^1$ represents a bivalent linkage group; $Z^1$ represents an atomic group containing a labile chalcogen atom site; $W^1$, $W^2$ and $W^3$ each represent a carboxylic acid group, a sulfonic acid group, sulfinic acid group, phosphoric acid group, phosphorous acid group or a boric acid group; m1 is 0 or 1; n1 is an integer of 1 to 3; 11, 12, and 13 each are an integer of 0 to 2.

7. The photothermographic material of claim 6, wherein the organic sensitizer is used in an amount of $10^{-8}$ to $10^{-2}$ mol per mol of silver halide.

8. The photothermographic material of claim 1, wherein when a cross section vertical to the surface of the support of the photothermographic material is observed by an electron microscope, not less than 70% of total projected area of the organic silver salt grains is accounted for by grains having a grain projected area of less than 0.025 $\mu m^2$ and not more than 10% of the total projected area of the organic silver salt particles is accounted for by grains having a grain projected area of not less than 0.2 $\mu m^2$.

9. The photothermographic material of claim 1, wherein the chemical sensitization is performed using an organic sensitizer containing a chalcogen atom.

10. The photothermographic material of claim 9, wherein the chalcogen atom is selected from the group consisting of a sulfur atom, a selenium atom and tellurium atom.

11. The photothermographic material of claim 9, wherein the chemical sensitization is performed in the absence of an oxidizing agent.

12. The photothermographic material of claim 9, wherein the organic sensitizer is a compound containing a group promoting adsorption onto silver halide and a labile chalcogen atom site.

13. The photothermographic material of claim 9, wherein the chalcogen atom is linked to a carbon atom by a double bond.

14. The photothermographic material of claim 9, wherein the organic sensitizer is represented by the following formula (C):

formula (C)

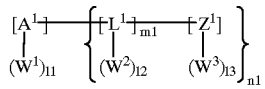

wherein $A^1$ represents an atomic group containing a group for promoting adsorption onto silver halide; $L^1$ represents a bivalent linkage group; $Z^1$ represents an atomic group containing a labile chalcogen atom site; $W^1$, $W^2$ and $W^3$ each represent a carboxylic acid group, a sulfonic acid group, sulfinic acid group, phosphoric acid group, phosphorous acid group or a boric acid group; m1 is 0 or 1; n1 is an integer of 1 to 3; 11, 12, and 13 each are an integer of 0 to 2.

15. The photothermographic material of claim 9, wherein the organic sensitizer is used in an amount of $10^{-8}$ to $10^{-2}$ mol per mol of silver halide.

16. The photothermographic material of claim 9, wherein the organic sensitizer is used in an amount of $10^{-8}$ to $10^{-2}$ mol per mol of silver halide.

* * * * *